US006677109B2

(12) United States Patent
Saitou et al.

(10) Patent No.: US 6,677,109 B2
(45) Date of Patent: Jan. 13, 2004

(54) PHOTOGRAPHIC SILVER HALIDE EMULSION

(75) Inventors: Mitsuo Saitou, Kanagawa (JP); Masaaki Miki, Kanagawa (JP); Katsuhisa Ohzeki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/351,366

(22) Filed: Jan. 27, 2003

(65) Prior Publication Data

US 2003/0207220 A1 Nov. 6, 2003

Related U.S. Application Data

(63) Continuation-in-part of application No. 10/252,433, filed on Sep. 24, 2002.

(30) Foreign Application Priority Data

Sep. 27, 2001 (JP) ..... P. 2001-297023
Sep. 28, 2001 (JP) ..... P. 2001-301183

(51) Int. Cl.[7] ..... G03C 1/035
(52) U.S. Cl. ..... 430/469
(58) Field of Search ..... 430/569

(56) References Cited

U.S. PATENT DOCUMENTS 5,985,535 A * 11/1999 Urabe ..... 430/569

* cited by examiner

*Primary Examiner*—Hoa Van Le
(74) *Attorney, Agent, or Firm*—Sughrue Mion, PLLC

(57) ABSTRACT

A producing method of a silver halide emulsion comprising the steps of adding silver halide fine grains $AgX_0$ having an to a silver halide seed crystal emulsion containing at least water, dispersion medium 1 and silver halide crystal, and growing the seed crystal by dissolving the added $AgX_0$, wherein $AgX_0$ are formed in dispersion medium solution 2 containing dispersion medium 2, the pH of dispersion medium solution 2 of the time when $AgX_0$ are formed is from 7.3 to 12.2, the average equivalent-circle projected area diameter of $AgX_0$ is from 0.001 to 0.2 $\mu$m, and $AgX_0$ are non-twin crystal grains not substantially having twin planes.

9 Claims, 11 Drawing Sheets x 26 x $10^4$ x 85000 x 2500 x 4700

PHOTOGRAPHIC SILVER HALIDE EMULSION

CROSS REFERENCE TO RELATED APPLICATION

This is a continuation-in-part application of U.S. patent application Ser. No. 10/252,433 filed Sep. 24, 2002.

FIELD OF THE INVENTION

The present invention relates to a silver halide photographic material, a photographic material containing thin tabular grains, and a method for producing the same.

BACKGROUND OF THE INVENTION

Silver halide grains are generally produced by the reaction of a silver salt aqueous solution and a halide salt aqueous solution in a colloidal aqueous solution in a reaction solution. That is, a single jet method of pouring a protective colloid represented by gelatin and a halide salt aqueous solution into a reaction vessel and adding a silver salt aqueous solution thereto with stirring the above aqueous solution, and a double jet method of pouring a gelatin aqueous solution into a reaction vessel, and adding a halide salt aqueous solution and a silver salt aqueous solution thereto are known. Comparing both methods, silver halide grains having narrow grain size distribution can be obtained by a double jet method, and the halide composition can be changed freely with the growth of the grains.

Further, it is known that the growing speed of silver halide-grains is largely influenced by the concentration of silver ions (halide ions) in a reaction vessel, the concentration of a silver halide solvent, the distance between grains and the grain size. In particular, the uniformity in concentration of silver ions or halide ions produced of a silver salt aqueous solution and a halide salt aqueous solution added to a reaction vessel differs in growing speed by each concentration, which results in the formation of a heterogeneous silver halide emulsion. For preventing this ununiformity, it is necessary to make the reaction of a silver salt aqueous solution and a halide salt aqueous solution supplied into a colloidal aqueous solution by rapid and uniform mixture so as to make the concentration of silver ions or halide ions in a reaction vessel uniform. However, it has been difficult to produce homogeneous silver halide grains by prior art techniques of the addition of a halide salt aqueous solution or a silver salt aqueous solution, since an area where the concentration of halide ions or silver ions is high is brought about in the vicinity of the place of addition of each reaction solution.

For resolving the uniform distributions of concentrations of silver ions and halide ions as above, a trial for growing silver halide grains has been made by providing a reaction vessel with a mixer separately, and supplying a silver salt aqueous solution and a halide salt aqueous solution to the mixer, and mixing the aqueous solutions rapidly. For example, there are disclosed in JP-A-53-37414 (the term "JP-A" as used herein means an "unexamined published Japanese patent application") and JP-B-48-21045 (the term "JP-B" as used herein means an "examined Japanese patent publication") a method of circulating a protective colloid aqueous solution (containing silver halide grains) in a reaction vessel from the bottom of the reaction vessel by a pump, providing the reaction vessel with a mixer midway in the circulating system, supplying a silver salt aqueous solution and a halide salt aqueous solution to the mixer, and mixing the aqueous solutions rapidly in the mixer, to thereby grow silver halide grains, and an apparatus used for that purpose. A method of circulating a protective colloid aqueous solution (containing silver halide grains) in a reaction vessel from the bottom of the reaction vessel by a pump, and pouring a halide salt aqueous solution and a silver salt aqueous solution by a pump midway in the circulating system is disclosed in U.S. Pat. No. 3,897,935. A method of circulating a protective colloid aqueous solution in a reaction vessel (containing silver halide grains) by a pump from the reaction vessel, pouring a halogenated alkali metal salt aqueous solution, diffusing the aqueous solution until it becomes homogeneous, and thereafter pouring a silver salt aqueous solution to the system and mixing them, to thereby form silver halide grains, and an apparatus used for that purpose are disclosed in JP-A-53-47397. It is certainly possible to independently change the flow of an aqueous solution in a reaction vessel and the stirring efficiency of a mixer in a circulating system according to these methods, therefore, grains can be grown on more uniform condition of concentration distribution. However, silver halide crystal fed from a reaction vessel with a protective colloid aqueous solution is eventually subjected to uniform and rapid growth at the inlets of a halide salt aqueous solution and a silver salt aqueous solution. Therefore, it is theoretically impossible to get rid of the concentration distribution in the vicinity of a mixing zone or the inlets of aqueous solutions, thus the object of growing silver halide grains uniformly cannot be achieved.

As one means for solving this problem fundamentally, a method of growing silver halide grains in a reaction vessel by adding fine grains which have been formed in advance in an external mixer to the reaction vessel is disclosed in U.S. Pat. Nos. 5,035,991, 5,270,159, 5,250,403, EP 274852, EP 523842 and Japanese Patent 2684397. According to this method,a silver and a halogen seed are fed as silver halide fine grains. Since the silver halide fine grains are spread all over the reaction vessel, and then dissolved and silver ions and halide ions are supplied at the same time, the distributions of concentrations of silver ions and halide ions are largely improved (become uniform).

However, when fine grains supplied from an external mixer are large in size, time is taken to dissolve the fine grains, which causes inefficiency such that grain formation is prolonged. It is disclosed in Japanese Patent Nos. 2,008,051 and 2,060,301 that low temperature formation is effective to form small size silver halide grains. However, gelatin which is the most ordinary dispersion medium coagulates at low temperature, and it is very difficult to form grains at 30° C. or lower. In particular, continuous nucleation is difficult in a closed type external mixer due to the generation of clogging. For the solution of this problem, JP-B-7-111550 discloses that silver halide grains can be formed even at temperature as low as 15° C. or lower without being accompanied by coagulation of a reaction solution by using gelatin or synthetic protective colloid having a lowered molecular weight.

As described above, in the techniques of growing silver halide grains by feeding fine grains, the miniaturization of the fine grains for supply has been contrived, but the size distribution of the fine grains to be supplied is far from satisfaction, and the size of the fine grains disclosed in JP-B-7-111550 is 20 nm or greater. Therefore, finer grains have been earnestly desired.

On the other hand, tabular silver halide grains are ordinarily used in photographic materials, in particular, photographic materials for photographing. The reason is mainly because tabular silver halide grains have a great surface area/volume ratio and this is advantageous to spectral sensitization. That is, silver halide having light absorption sensitivity only in a blue region is generally spectrally sensitized by adsorbing a sensitizing dye onto the surface of a grain, and tabular grains having a great surface area/volume ratio have a large dye adsorption amount per a grain, thus light absorption amount increases and high sensitivity can be achieved. Therefore, studies of making a surface area/volume ratio greater have been advanced. In particular, as an effective means to form a thin tabular grain, a method of restricting the growth of a tabular grain in the thickness direction by making use of a crystal phase-controlling agent is known. The examples of these methods are disclosed in U.S. Pat. Nos. 5,411,853, 5,418,125 and JP-A-10-104769, but a crystal phase-controlling agent is not preferred, since it is competitive with the adsorption of a sensitizing dye. The techniques of forming a thin tabular grain without using a crystal phase-controlling agent is disclosed in U.S. Pat. No. 4,713,320 and JP-A-11-108536, but these methods are not sufficient and the technique capable of forming a thinner tabular grain is required.

Further, it has been found from the results of our study that when tabular grains are grown by adding fine grains, dissolving and depositing them on tabular grains, non-twin crystal fine grains are preferred as the fine grains. The reason is that if twin crystal grains are contained in the fine grains, the twin crystal grains are easy to grow, which causes inefficiency such that the resulting grains become polydispersed grains. Methods of adding non-twin crystal fine grains to a seed crystal emulsion and growing the seed crystal emulsion are disclosed in JP-A-4-34544, JP-A-4-330427 and JP-A-11-202435, but these patent do not disclose that the fine grains are formed on high pH condition.

SUMMARY OF THE INVENTION

The objects of the present invention are to provide a silver halide photographic material of high sensitivity, in particular, to accomplish the above object using thin tabular grains by an improved fine grain addition-growing method, and to provide fine grains for growth which makes it possible to form the tabular grains.

These and other objects of the present invention have been achieved by the following means:

(1) A producing method of a silver halide emulsion comprising the steps of adding silver halide fine grains $AgX_0$ ($X_0$ means chloride, bromide, iodide or a mixture of their 2 or 3 components, preferably $AgX_0$ has an AgBr content of from 60to 100 mol %) to a silver halide seed crystal emulsion containing at least water, dispersion medium 1 and silver halide crystal, and growing the seed-crystal by dissolving the added $AgX_0$, wherein $AgX_0$ are formed indispersion medium solution 2 containing dispersion medium 2, the pH of dispersion medium solution 2 of the time when $AgX_0$ are formed is from 7.3 to 12.2, the average equivalent-circle (projected area) diameter of $AgX_0$ is from 0.001 to 0.2 $\mu$m, and $AgX_0$ are non-twin crystal grains not substantially having twin planes.

(2) The producing method of a silver halide emulsion as described in the above item (1), wherein the temperature of dispersion medium 2 of the time when $AgX_0$ are formed is from 0 to 10° C.

(3) The producing method of a silver halide emulsion as described in the above item (1), wherein the variation coefficient of the equivalent-circle diameter of $AgX_0$ is 20% or less.

(4) The producing method of a silver halide emulsion as described in the above item (1), wherein the average equivalent-circle diameter,of $AgX_0$ is 20 nm or less.

(5) The producing method of a silver halide emulsion as described in the above item (1), wherein $AgX_0$ are fine grains formed by a batch system of adding a silver salt solution and a halide salt solution to dispersion medium solution 2 in a reaction vessel by a double jet method.

(6) The producing method of a silver halide emulsion as described in the above item (1), wherein $AgX_0$ are fine grains formed by a continuous system of continuously supplying a silver ($Ag^+$) salt solution and a halide ($X^-$) salt solution to a continuous mixer through a hollow pipe, mixing both solutions in the mixer, and continuously discharging the mixed solution through a feed pipe.

(7) The producing method of a silver halide emulsion as described in the above item (5) or (6), wherein at least one of a silver ($Ag^+$) salt solution and a halide ($X^-$) salt solution to be added contains from 0.01 to 15 mass % of dispersion medium 3.

(8) A silver halide photographic material having at least one light-sensitive emulsion layer containing the silver halide grains produced by the producing method of a silver halide emulsion as described in the above item (1), wherein grains having an aspect ratio of 10 or more occupy 50% or more of the total projected area of all the silver halide grain and the silver halide grain have an average thickness of 0.05 $\mu$m or less.

Preferred Embodiment (1) A producing method of a silver halide emulsion comprising the steps of adding silver halide fine grains $AgX_0$ preferably having an AgBr content of from 60 to 100 mol % ($AgBr_0$), more preferably from 80 to 100 mol %, and further more preferably from 90 to 100 mol %, to a silver halide seed crystal emulsion containing at least water, dispersion medium 1 and silver halide seed crystal, and growing the seed crystal by dissolving and depositing the added $AgX_0$ on the seed crystal, wherein $AgX_0$ are formed in dispersion medium solution 2 containing dispersion medium 2 by reacting silver ion ($Ag^+$) and halide ion ($X^-$), the pH of dispersion medium solution 2 of the time when $AgX_0$ are formed is from 7.3 to 12.2, preferably from 8.0 to 1.2.0, and more preferably from 9.5 to 11.7, the average equivalent-circle (projected area) diameter of $AgX_0$ is from 0.001 to 0.2 $\mu$m, preferably from 0.002 to 0.1 $\mu$m, more preferably from 0.002 to 0.05 $\mu$m, and still more preferably from 0.002 to 0.02 $\mu$m, and $AgX_0$ are non-twin crystal fine grains not substantially having twin planes.

(2) The producing method of a silver halide emulsion as described in the above item (1), wherein $AgX_0$ are fine grains formed by a batch system of adding an $Ag^+$ salt solution and an $X^-$ salt solution to dispersion medium solution 2 in a reaction vessel by a double jet method.

(3) The producing method of a silver halide emulsion as described in the above item (1), wherein $AgX_0$ are fine grains formed by a continuous system of continuously supplying the $Ag^+$ salt solution and the $X^-$ salt solution to a continuous mixer through a hollow pipe, mixing both solutions in the mixer, and continuously discharging the mixed solution through a feed pipe.

(4) The producing method of a silver halide emulsion as described in the above item (1), wherein the temperature of dispersion medium solution 2 of the time when $AgX_0$ are formed is from 0 to 40° C., preferably from 0 to 20° C., more preferably from 0 to 15° C., and still more preferably from 0 to 10° C.

(5) The producing method of a silver halide emulsion as described in the above item (2) or (3), wherein at least one of the $Ag^+$ salt solution and the $X^-$ salt solution to be added, preferably both of them, contains from 0.01 to 15 mass % (i.e., weight %), preferably from 0.05 to 5 mass %, of dispersion medium 3.

(6) The producing method of a silver halide emulsion as described in the above item (2) or (3), wherein the pH of an $X^-$ salt solution to be added when $AgX_0$ are formed is from 7.3 to 12.2, preferably from 8.0 to 12, and more preferably from 9.3 to 12.

(7) The producing method of a silver halide emulsion as described in the above item (2) or (3), wherein the temperature of at least one of the $Ag^+$ salt solution and the $X^-$ salt solution to be added, preferably both of them, is from 0 to 40° C., preferably from 0 to 25° C., and more preferably from 0 to 10° C.

(8) The producing method of a silver halide emulsion as described in the above item (1), wherein the pH of dispersion medium solution 2 during at least a period of nucleation at $AgX_0$ formation falls within the pH range as described in the above item (1).

(9) The producing method of a silver halide emulsion as described in the above item (8), wherein the period of nucleation of $AgX_0$ is the period of time of 5 seconds from the start of simultaneous mixed addition of $Ag^+$ and $X^-$ to dispersion medium solution 2, preferably 30 seconds, more preferably 2 minutes, and still more preferably 6 minutes.

(10) The producing method of a silver halide emulsion as described in the above item (8), wherein dispersion medium solution 2 during the period of nucleation of $AgX_0$ is a dispersion medium solution present in the area in the hollow pipe through which the added $Ag^+$ and $X^-$ travel during the period of time of 5 seconds from the start of addition, preferably 30 seconds, more preferably 2 minutes, and still more preferably 6 minutes.

(11) The producing method of a silver halide emulsion as described in any of the above items. (8) to (10), wherein an acid is added to the emulsion containing $AgX_0$ during the time after the period of nucleation of $AgX_0$ until the addition of the $AgX_0$ emulsion to the seed crystal emulsion, and the $AgX_0$ emulsion is added to the seed crystal emulsion after the pH of the $AgX_0$ emulsion has been lowered by 0.3 to 10, preferably by 0.6 to 10, and more preferably by 1.0 to 10.

(12) The producing method of a silver halide emulsion as described in the above item (1) or (8), wherein the variation width of pH during the period of nucleation of $AgX_0$ or during the period of formation of the $AgX_0$ emulsion is within ±1.0, and preferably within ±0.2.

(13) The producing method of a silver halide emulsion as described in the above item (1) or (5), wherein the concentration of dispersion medium 1 or 2 or 3 is from 0.1 to 20 mass %, and preferably from 0.1 to 10 mass %.

(14) The producing method of a silver halide emulsion as described in the above item (1) or (5), wherein dispersion medium 1 or 2 or 3 is gelatin, and the methionine (Met) group content in the gelatin is from 0 to 25 μmol/g, preferably from 0 to 5 μmol/g, and more preferably from 0 to 1 μmol/g.

(15) The producing method of a silver halide emulsion as described in the above item (1), wherein the content of Met group in gelatin in the $AgX_0$ emulsion is reduced to 0 to 90% of the content before the start of the addition, preferably from 0 to 30%, and more preferably from 0 to 10%, during the time after the period of nucleation of $AgX_0$ until the addition of the $AgX_0$ emulsion to the seed crystal emulsion.

(16) The producing method of a silver halide emulsion as described in the above item (1), (4) or (13) , wherein the viscosity ($10^{-3}$Pa·s) of dispersion medium solution 2 is from 1.0 to 80, preferably from 1.0 to 40, and more preferably from 1.0 to 10, when allowed to stand for 30 minutes on temperature condition as described in the above item (4).

(17) The producing method of a silver halide emulsion as described in the above item (4), wherein the $AgX_0$ emulsion is formed after the temperature of dispersion medium solution 2 has been lowered by 1 to 30° K, and preferably by 5 to 30° K, by adding a coolant of from 1 to 290° K, and preferably from 50 to 280° K to dispersion medium solution 2.

(18) The producing method of a silver halide emulsion as described in the above item (17), wherein the coolant is an ice having an $H_2O$ content of from 70 to 100%, preferably from 97 to 100%, liquefied gas or dry ice.

(19) The producing method of a silver halide emulsion as described in the above item (1), (13) or (14), wherein dispersion medium 1 or 2 or 3 contains low molecular weight gelatin having a molecular weight of from 3,000 to $5\times10^4$, preferably from 5,000 to $2\times10^4$, in an amount of from 25 to 100 mass %, preferably from 70 to 100 mass %, and more preferably from 95 to 100 mass %.

(20) The producing method of a silver halide emulsion as described in the above item (19), wherein the low molecular weight gelatin is low molecular weight gelatin produced by adding an acid to a gelatin aqueous solution, and then hydrolyzing the gelatin or collagen in the aqueous solution on an acidic condition of pH of from −1 to 5, preferably from −0.5 to 3, to thereby lower the molecular weight.

(21) The producing method of a silver halide emulsion as described in the above item (19), wherein the low molecular weight gelatin is low molecular weight gelatin produced by adding an alkali agent to a gelatin aqueous solution, and then hydrolyzing the gelatin or collagen in the aqueous solution on an alkaline condition of pH of from 8 to 15, preferably from 10 to 14, to thereby lower the molecular weight.

(22) The producing method of a silver halide emulsion as described in the above item (20), wherein the acid is one or more oxo acid(s).

(23) The producing method of a silver halide emulsion as described in the above item (20) or (21), wherein the gelatin is gelatin produced by removing from 5 to 100%, preferably from 50 to 100%, and more preferably from 90 to 100%, of the acid or base added from the gelatin aqueous solution by one or more methods described below after the molecular weight of the gelatin has been lowered, a1) a method of subjecting the gelatin solution to ultrafiltration, a2) a method of subjecting the gelatin solution to electrodialysis, a3) a method of subjecting the gelatin solution to washing with water after being subjected to gelation, a4) a method of adding a flocculation-precipitant to the gelatin solution to flocculate and precipitate the gelatin, and then separating and collecting the flocculated product, a5) a method of adding a water-soluble organic solvent (e.g., methanol or ethanol) to the gelatin solution to flocculate and precipitate the gelatin, and then separating and collecting the flocculated product, a6) a method of bringing the gelatin solution into contact with washing water via a semipermeable membrane, wherein the semipermeable membrane is a membrane which is permeable to a water molecule, ions and molecules having a molecular weight of 500 or less but is impermeable to molecules having a molecular weight of 3,000 or more, a7) a method of bringing the gelatin solution into contact with an ion exchange resin.

(24) The producing method of a silver halide emulsion as described in any of the above items (19) to (21), wherein the low molecular weight gelatin is used, after the molecular weight of the gelatin has been lowered, by adding a base or an acid to the gelatin solution to adjust the pH of the solution to 2 to 12.5, preferably 2 to 11, more preferably from 3 to 10.

(25) The producing method of a silver halide emulsion as described in any of the above items (20) to (22), wherein the low molecular weight gelatin is used after the molecular weight of the gelatin has been lowered, with 1 to 100%, preferably from 10 to 100%, and more preferably from 30 to 100%, of the base or acid added being remaining in the gelatin.

(26) The producing method of a silver halide emulsion as described in any of the above items (1) to (13) , wherein dispersion medium 1 or 2 or 3 is gelatin, and from30 to 100 mass %, preferably from 60 to 100 mass %, and more preferably from 90 to 100 mass %, of the gelatin has a hydroxyproline (Hyp) content (the number of Hyp groups per 1,000 amino acid residues) of from 0 to 100, preferably from 0 to 80, more preferably from 0 to 40, and still more preferably from 0 to 10.

(27) The producing method of a silver halide emulsion as described in the above item (26), wherein the gelatin is gelatin extracted from the animal living in the frigid zone or the frigid sea of the temperature of from −50 to 25° C., preferably from −50 to 15° C., and more preferably from −50 to 5° C., preferably extracted from the bone, skin or scale of the animal living in the frigid sea, and more preferably extracted from the skin of the fish living in the frigid sea.

(28) The producing method of a silver halide emulsion as described in the above item (26) or (27), wherein the methionine (Met) group content of the gelatin is reduced to 0 to 90% of the Met content of the collagen protein in the original animal, preferably from 0 to 40%, and more preferably from 0 to 10%.

(29) The producing method of a silver halide emulsion as described in the above item (26) or (27), wherein the histidine (His) group content of the gelatin is reduced to 0 to 90% of the His group content of the original natural collagen, preferably from 0 to 40%, and more preferably from 0 to 10%.

(30) The producing method of a silver halide emulsion as described in any of the above items (1) to (13), wherein dispersion medium 1 or 2 or 3 is gelatin, and from 10 to 100%, preferably from 30 to 100%, and more preferably from 60 to 100%, of the carboxyl groups in from 30 to 100 mass % of the gelatin, preferably from 60 to 100 mass %, and more preferably from 90 to 100 mass %, are chemically modified.

(31) The producing method of a silver halide emulsion as described in the above item (1), (5) or (13), wherein from 1 to 100 mass %, preferably from 10 to 90 mass %, and more preferably from 20 to 70 mass %, of dispersion medium 1 or 2 or 3 comprises a water-soluble synthetic high polymer having a molecular weight of from $10^3$ to $10^6$, and preferably from $10^3$ to $10^5$ produced by polymerizing from one to twenty kinds, and preferably from one to ten kinds, of monomers.

(32) The producing method of a silver halide emulsion as described in the above item (13) or (31), wherein the synthetic high polymer is not subject to gelation (the state where the viscosity ($10^{-3}$Pa·s) is 100 or more, preferably 50 or more) when a 3 mass % aqueous solution of the water-soluble synthetic high polymer, preferably a 5 mass % aqueous solution (pH of from 2 to 12), is allowed to stand at 1 to 15° C., preferably from 1 to 8° C., for 30 minutes.

(33) The producing method of a silver halide emulsion as described in the above item (1), wherein the total concentration of the inorganic ions in dispersion medium solution 2 at the time of the start of formation of the fine grains is from 0 to 1 mol/liter, preferably from 0 to 0.2 mol/liter, and more preferably from 0 to 0.02 mol/liter.

(34) The producing method of a silver halide emulsion as described in the above item (1), wherein the concentration of the excess amount of $Ag^+$ or $X^-$ in dispersion medium solution 2 at the start of $AgX_0$ formation is preferably from 0 to $10^{-}1.6$ mol/liter, more preferably from 0 to $10^{-2}$ mol/liter, and still more preferably from 0 to $10^{2.3}$ mol/liter.

(35) The producing method of a silver halide emulsion as described in the above item (1), wherein the twin plane formation inhibitor described in the following a10) is added to dispersion medium solution 2 at $AgX_0$ formation, preferably at the start of $AgX_0$ formation, in an amount of from $10^{-8}$ to 1 mol/liter, preferably from $10^{-7}$ to 0.1 mol/liter, to thereby reduce the ratio of the number of grains having two or more twin planes in one grain, or the ratio of the number of grains having one or more twin planes in one grain, to 0 to 90%, preferably from 0 to 40%, and more preferably from 0 to 10%, of the number of grains at the time not containing the twin plane formation-inhibitor:

Compounds a10):

(i) compounds containing one or more onium salt groups in one molecule and excluding gelatin and $NH_4$+, preferably compounds also excluding ammonium compounds having two or less carbon atoms, and more preferably compounds having from one to three pyridinium salt groups in one molecule, (ii) aromatic compounds having one or more iodo groups and one or more —OH groups substituted on an aromatic ring, (iii) nitrogen-containing heterocyclic compounds, which contains, in one molecule, one or more heterocyclic rings having two or more nitrogen atoms in a 4- to 7-membered ring, (iv) cyanine dyes, (v) compounds having a divalent sulfur group-containing heterocyclic group, (vi) thiourea compounds, (vii) amino thioethers, and (viii) divalent sulfur group-containing organic compounds having 25 or less total carbon atoms.

(36) The producing method of a silver halide emulsion as described in the above item (2) or (3), wherein at least either one of the $Ag^+$ salt solution and the $X^-$ salt solution, preferably both of them, is added from porous addition pores of from 2 to $10^{15}$, preferably from 8 to $10^{15}$, and more preferably from 30 to $10^{15}$.

(37) The producing method of a silver halide emulsion as described in the above item (36), wherein the porous addition pores or porous addition system having porous addition pores are composed of a rubber-like elastic body, and the rubber-like elastic body is a material which reversibly elastically deforms to the length of 1.05 to 20 times the original length in the working temperature region, preferably from 1.1 to 20 times, and more preferably from 1.3 to 10 times, and the rubber elastic modulus (=Young's modulus ($N/m^2$)) of the material is from $10^4$ to $_{10}^{9}$, and preferably from $10^5$ to $10^8$.

(38) The producing method of a silver halide emulsion as described in the above item (36) or (37), wherein the addition pores are closed when addition is ceased, and an addition solution and a reaction solution are out of contact with each other.

(39) The producing method of a silver halide emulsion as described in the above item (1), wherein after the $AgX_0$ emulsion has been formed, the $AgX_0$ emulsion is subjected to ultrafiltration, and then the $AgX_0$ emulsion is added to the seed crystal emulsion after the $NO_3^-$ content (mol/mol AgX) in the $AgX_0$ emulsion has been reduced to 0 to 90% of the $NO_3^-$ content by being subjected to ultrafiltration, preferably from 0 to 40%, and more preferably from 0 to 10%.

(40) The producing method of a silver halide emulsion as described in the above item (23), (38) or (39), wherein the ultrafiltration is performed by cross flow system of feeding a solution in the parallel direction to a filtration film.

(41) The producing method of a silver halide emulsion as described in the above item (23), (38) or (39), wherein the. ultrafiltration is performed by using a hollow pipe type filtration film of feeding a solution into the hollow pipe.

(42) The producing method of a silver halide emulsion as described in the above item (1), wherein the $AgX_0$ are fine grains not substantially having screw dislocation lines.

(43) The producing method of a silver halide emulsion as described in the above item (1), wherein silver halide fine grains $AgI_0$ having an AgI content of from 80 to 100 mol %, preferably from 95 to 100 mol %, are added to the seed crystal emulsion in the growing method, and from 20 to 100% of the total content of $I^-$ added during growing, preferably from 60 to 100%, and more preferably from 90 to 100%, is added in the form of $AgI_0$.

(44) The producing method of a silver halide emulsion as described in the above item (43), wherein the $AgI_0$ are non-twin crystal fine grains not substantially having twin planes.

(45) The producing method of a silver halide emulsion as described in the above item (43), wherein the $AgI_0$ are formed in fresh dispersion medium solution 2 and the pH of dispersion medium solution 2 of the time when $AgI_0$ are formed is from 4 to 12, and preferably from 5 to 12.

(46) The producing method of a silver halide emulsion as described in the above item (1), wherein silver halide fine grains $AgCl_0$ having an AgCl content of from 60 to 100 mol %, preferably from 80 to 100 mol %, are added to the seed crystal emulsion in the growing method, and from 20 to 100% of the total content of Cl_ added during growing, preferably from 60 to 100%, and more preferably from 90 to 100%, is added in the form of $AgCl_0$.

(47) The producing method of a silver halide emulsion as described in the above item (46), wherein the $AgCl_0$ are non-twin crystal fine grains not substantially having twin planes.

(48) The producing method of a silver halide emulsion as described in the above item (46), wherein the $AgCl_0$ are formed in fresh dispersion medium solution 2 by reacting $Ag^+$ and $X^-$, and the pH of dispersion medium solution 2 of the time when $AgCl_0$ are formed is from 1 to 12, preferably from 1 to 9, and more preferably from 1 to 6.

(49) The producing method of a silver halide emulsion as described in the above item (1), wherein the $AgX_0$ are grains having multiple structure comprising a core layer and one or more shell layers, and the AgX composition between contiguous layers is different by 0.01 to 30 mol % in a AgCl content or an AgI content, preferablyby 0.01 to 10mol %, and more preferably by 0.1 to 15 mol %.

(50) The producing method of a silver halide emulsion as described in the above item (49), wherein the AgI content in the outermost shell layer is higher than the AgI content in the core layer in the multiple structure by 0.1 to 40 mol %, preferably by 1 to 30 mol %.

(51) The producing method of a silver halide emulsion as described in the above item (1), wherein the $AgX_0$ contain, in the grains and/or on the surfaces of the grains, one or more simple atoms of atomic numbers of from 1 to 92 or compounds of the atoms as dopants, in a total amount of from $10^{-9}$ to $10^{-1}$ mol/mol AgX, and preferably from $10^{-8}$ to $10^{-2}$ mol/mol AgX.

(52) The producing method of a silver halide emulsion as described in the above item (51), wherein the dopant is a simple atom of a metal atom (atoms on the left side of the line connecting boron B and At in the Periodic Table (long period)), the neutral body or ion of the compound of the metal atom, more preferably a simple atom of a transition metal atom, the neutral body. or ion of the compound of a transition metal atom.

(53) The producing method of a silver halide emulsion as described in the above item (52), wherein the compound is a metal complex having from 1 to 3 metal atoms and from 2 to 20 ligands, and from 1 to all of the ligands are inorganic ligands and/or organic ligands having from 1 to 30 carbon atoms.

(54) The producing method of a silver halide emulsion as described in the above item (53), wherein the metal complex is a tetra- or hexa-coordinated complex.

(55) The producing method of a silver halide emulsion as described in the above item (51), wherein the dopant is a compound containing from 1 to $10^5$ chalcogen atoms in one molecule.

(56) The producing method of a silver halide emulsion as described in the above item (55), wherein the dopant is a compound containing from 1 to $10^5$ thiosulfonyl groups in one molecule.

(57) The producing method of a silver halide emulsion as described in the above item (55), wherein the dopant is a compound containing from 1 to $10^5$ thiosulfonate groups in one molecule.

(58) The producing method of a silver halide emulsion as described in the above item (1), wherein the pH of the $AgX_0$ emulsion immediately before being added to the seed crystal emulsion is from 2 to 11, preferably from 3 to 9, and more preferably from 4 to 8.

(59) The producing method of a silver halide emulsion as described in the above item (1), wherein the fine grains are formed, and the fine grains are added to the seed crystal emulsion when (the average diameter of the grains/the average diameter of the grains just after formation) (A14) reaches 1 to 3, preferably from 1 to 2, and more preferably from 1 to 1.3.

(60) The producing method of a silver halide emulsion as described in the above item (1), wherein the reaction vessel for forming the fine grains is installed in the range of preferably from 0 to 100 m from the reaction vessel for growing the seed crystal, and more preferably from 0 to 10 m.

(61) The producing method of a silver halide emulsion as described in the above item (1), wherein after the $AgX_0$ emulsion has been formed, the $AgX_0$ emulsion (which means emulsion containing at least one of $AgBr_0$, $AgI_0$, $AgCl_0$ and $AgX_0$) is subjected to ultrafiltration, and the $AgX_0$ emulsion is added to the seed crystal emulsion after the volume of the $AgX_0$ emulsion has been reduced to 1 to 90% of the volume before being subjected to ultrafiltration, preferably from 1 to 60%, and more preferably from 1 to 30%.

(62) The producing method of a silver halide emulsion as described in the above item (14), (15) or (28), wherein the reduction of the Met group content is performed by adding an oxidant, preferably $H_2O_2$, to the gelatin aqueous solution, to thereby oxidize Met groups.

(63) The producing method of a silver halide emulsion as described in the above item (1), wherein an antifoggant and/or a cyanine dye is added to dispersion medium solution 2 when $AgX_0$ are formed in an amount of from $10^{-8}$ to $10^{-1}$ mol/liter, and preferably from $10^{-7}$ to $10^{-2}$ mol/liter.

(64) The producing method of a silver halide emulsion as described in the above item (1), (13) or (14), wherein dispersion medium 1 or 2 or 3 is gelatin having ad-molecules by covalent bonding by 0.1 to 80 molecules per one molecule, preferably from 0.1 to 20 molecules on average, and when the molecules are added to the $AgX_0$ emulsion at 40° C. in the state of 40 to 50% of saturated adsorption amount, an adsorption equilibrium constant K (the number of molecules in the state of adsorption/the number of molecules in the state of non-adsorption) is from 3 to $10^8$, preferably from 10 to $10^8$, and more preferably from 100 to $10^8$.

(65) The producing method of a silver halide emulsion as described in the above item (1), wherein dispersion medium 1 or 2 or 3 is gelatin, and the Met group content in the gelatin is from 25.1 to 60 $\mu$mol/g.

(66) The producing method of a silver halide emulsion as described in the above item (1), wherein dispersion medium 1 or 2 or 3 has a weight average molecular weight of from 3,000 to $10^6$.

(67) The producing method of a silver halide emulsion as described in the above item (1) or (66), wherein dispersion medium 1 or 2 or 3 has from 2 to 10 peaks in a molecular weight distribution curve.

(68) The producing method of a silver halide emulsion as described in the above item (1), (43) or (46), wherein after the $AgBr_0$ or $AgI_0$ or $AgCl_0$ have been formed, a flocculation-precipitant is added to flocculate and precipitate the emulsion, a supernatant is removed, and then the $AgBr_0$ or $AgI_0$ or $AgCl_0$ are added to the seed crystal emulsion.

(69) The producing method of a silver halide emulsion as described in the above item (68), wherein the flocculation-precipitant is an organic sulfonic acid having from 1 to $10^5$ carbon atoms, preferably from 1 to $10^3$ or a salt thereof, and the addition amount is from 1 to 25 mass % of the gelatin in the emulsion, preferably from 3 to 15 mass %.

(70) The producing method of a silver halide emulsion as described in the above item (1), wherein from 60 to 100%, preferably from 90 to 100%, and more preferably from 97 to 100%, of the total projected area of the seed crystal grains of the seed crystal emulsion is occupied by tabular grains having a thickness of from 0.01 to 0.4 $\mu$m, preferably from 0.01 to 0.2 $\mu$m, more preferably from 0.01 to 0.1, and still more preferably from 0.01 to 0.05, an aspect ratio [circle-equivalent (projected area) diameter ($\mu$m)/thickness ($\mu$m)] of from 1.2 to 200, preferably from 2 to 200, and more preferably from 5 to 200, and a grain diameter of from 0.1 to 5 $\mu$m, and preferably from 0.1 to 2 $\mu$m.

(71) The producing method of a silver halide emulsion as described in the above item (1), wherein from 60 to 100%, preferably from 90 to 100%, and more preferably from 97 to 100%, of the total projected area of the AgX grains of the AgX emulsion finally obtained by the growth of the seed crystal grains is occupied by tabular grains having a thickness of from 0.01 to 0.5 $\mu$m, preferably from 0.01 to 0.2 $\mu$m, more preferably from 0.01 to 0.1, and still more preferably from 0.01 to 0.05, an aspect ratio of from 2 to 500, preferably from 10 to 500, and more preferably from 30 to 500, and a grain diameter of from 0.2 to 20 $\mu$m, and preferably from 0.5 to 10 $\mu$m.

(72) The producing method of a silver halide emulsion as described in the above item (70) or (71), wherein the tabular grain is a {111} tabular grain having {111} planes as principal planes and two twin planes parallel to the principal planes in the grain.

(73) The producing method of a silver halide emulsion as described in the above item (70) or (71), wherein the tabular grain is a {100} tabular grain having {100} planes as principal planes.

(74) The producing method of a silver halide emulsion as described in the above item (73), wherein the tabular grain has from 1 to 5 screw dislocation lines in the grain, and preferably from 1 to 3.

(75) The producing method of a silver halide emulsion as described in the above item (70), wherein the tabular seed crystal grains are formed through the stages of at least from nucleation to ripening, and the number average projected area diameter of the nuclei at the point of the termination of nucleation (at the point when the addition of $Ag^+$ for nucleation is terminated) is from 1 to 40 nm, preferably from 1 to 20 nm, and more preferably from 1 to 10 nm.

(76) The producing method of a silver halide emulsion as described in the above item (70), (71) or (72), wherein the distance between the outermost twin planes of the {111} tabular grain (the distance between the twin plane closest to one principal plane and the twin plane closest to another principal plane) is from 1 to 30 nm, preferably from 1 to 15 nm, and more preferably 0 to 10 nm.

(77) The producing method of a silver halide emulsion as described in the above item (1), wherein in the growing method of the seed crystal, the seed crystal emulsion is subjected to ultrafiltration during the growing of the seed crystal, and the increasing amount of the seed crystal emulsion by the addition of the fine grain emulsion is reduced to 3 to 90% of the increasing amount of the time not performing ultrafiltration, preferably from 3 to 60%, and more preferably from 5 to 40%.

(78) The producing method of a silver halide emulsion as described in the above item (1), wherein in the growing method of the seed crystal, the seed crystal emulsion is subjected to ultrafiltration during the growing of the seed crystal, and the total amount of the seed crystal emulsion at the termination of the growing of the seed crystal is reduced to 10 to 90% of the total amount of the time not performing ultrafiltration, preferably from 10 to 60%, and more preferably from 10 to 40%.

(79) The producing method of a silver halide emulsion as described in the above item (70) or (72), wherein the nucleation of the seed crystal is performed by the double jet addition of the $Ag^+$ salt solution and the $X^-$ salt solution for 1 second to 15 minutes, preferably for 10 seconds to 5 minutes, at pBr of from 1 to 3, preferably from 2 to 3, pH of from 1 to 12, preferably from 1.5 to 10, and temperature of from 0 to 50° C., preferably from 0to 25° C., and more preferably from 0 to 10° C.

(80) The producing method of a silver halide emulsion as described in the above item (79), wherein the seed crystal is subjected to ripening after the nucleation to increase the ratio of the number of tabular grains by 1.5 to $10^5$ times, preferably 5 to $10^5$ times and then used as the seed crystal for growth.

(81) The producing method of a silver halide emulsion as described in the above item (79), wherein after the nucleation, the $Ag^+$ salt solution and the $X^-$ salt solution are added to the crystal nuclei for 1 to $10^6$ seconds, to thereby grow the projected area diameter of the tabular grain by 1.2 to 100 times, preferably from 2 to 100 times, and then the seed crystal emulsion is used for growth.

(82) The producing method of a silver halide emulsion as described in the above item (81), wherein the ratio of the number of tabular grains is increased by 2 to $10^4$ times, and then the seed crystal is used for growth.

(83) The producing method of a silver halide emulsion as described in the above item (70), wherein the ratio of the mean diameter (d1) of the $AgX_0$ to the mean thickness (d2) of the tabular seed grains (d1/d2) is 0.1 to 2.0, preferably 0.1 to 1.4, more preferably 0.3 to 1.2.

(84) The producing method of a silver halide emulsion as described in the above item (22), wherein the oxo acid species are $HNO_3$ and/or $H_2SO_4$.

(85) The producing method of a silver halide emulsion as described in the above item (23), wherein the removing is carried out by the a1) method.

(86) The producing method of a silver halide emulsion as described in the above item (15), wherein the Met group content (μmol/g) of the gelatin before the reducing process is preferably 3.1 to 70, more preferably 10 to 50.

(87) The producing method of a silver halide emulsion as described in the above item (15), wherein the Met group content (μmol/g) of the gelatin after the reducing process is preferably 0to 30, more preferably 0 to 10.

(88) The producing method of a silver halide emulsion as described in the above item (2), wherein the solution containing $Ag^+$ and the solution containing $X^-$ are introduced into the reaction vessel solution through tube hose directly under the surface, (the length of the tube hose under the surface/the diameter of the vessel) is preferably 0.5 to 50, more preferably 0.8 to 20, more preferably 1.5 to 20 in at least one tube hose, more preferably both tube hose.

(89) The producing method of a silver halide emulsion as described in the above item (2), (45) or (48), wherein the $Ag^+$ addition rate (mol/minute) for producing $AgX_0$, $AgBr_0$, $AgCl_0$ or $AgI_0$ is preferably as follows: {the maximum addition rate during the precipitation/the addition rate of the first stage (0.1%, preferably 0.3% time duration of the total grain formation duration)}=1.6 to 1000, preferably 3 to 100.

(90) The producing method of a silver halide emulsion as described in the above item (2), (45) or (48), wherein the value of {the maximum addition rate during the precipitation/the addition rate of the last stage (0.1%, preferably 0.3% time duration of the total grain formation duration)} is 1.6 to 1000, preferably 3 to 100.

(91) The producing method of a silver halide emulsion as described in the above item (9) or (10), wherein the ratio [{100} crystal surface area/total surface area] of the $AgBr_0$ seed grains produced during the nucleation stage is 10 to 100, preferably 20 to 100, more preferably 40 to 100, most preferably 70 to 100.

(92) The producing method of a silver halide emulsion as described in the above item (1), wherein the ratio [{100) crystal surface area/total surface area] of the $AgBr_0$ grains is 10 to 100, preferably 20 to 100, more preferably 40 to 100, most preferably 70 to 100.

(93) The producing method of a silver halide emulsion as described in the above item (92), wherein the shape of the $AgBr_0$ grain is a hexahedron, or a rounded one whose corners and/or edges are rounded, preferably a cubic grain or a rounded one, wherein the ratio {the curvature diameter (d3) of the round portion/the grain diameter (d4) } is 0.01 to 10, preferably 0.1 to 10.

(94) The producing method of a silver halide emulsion as described in the above item (1), (2), (3), (43) or (46), wherein at least one of the $AgX_0$, $AgBr_0$, $AgCl_0$ and $AgI_0$ is added to the silver halide emulsion containing seed grains after 10 to $10^6$ sec (preferably 100 to $10^6$, more preferably $10^3$ to $10^6$ sec) reservation after the formation of the $AgX_0$, $AgBr_0$, $AgCl_0$ and $AgI_0$.

(95) The producing method of a silver halide emulsion as described in the above item (94), wherein at least one of the $AgX_0$, $AgBr_0$, $AgCl_0$ and $AgI_0$ is added to the silver halide emulsion containing seed grains after the diameter of the $AgX_0$, $AgBr_0$, $AgCl_0$ and $AgI_0$ increases to 1.0 to 5 times,. preferably 1.01 to 5 times, more preferably 1.05 to 2 times, as large as just formed.

(96) The producing method of a silver halide emulsion as described in the above item (94), wherein at least one of the $AgX_0$, $AgBr_0$, $AgCl_0$ and $AgI_0$ is added to the silver halide emulsion containing seed grains after the variation coefficient of the diameter distribution of the $AgX_0$, $AgBr_0$, $AgCl_0$ or $AgI_0$ decrease to 10 to 99%, preferably 10 to 90% by the reservation.

(97) The producing method of a silver halide emulsion as described in the above item (94), wherein the reservation temperature is 0 to 70, preferably 2 to 50 ° C.

(98) The producing method of a silver halide emulsion as described in the above item (1), (2), (3) (43), (46) or (94), wherein at least one of the $AgX_0$, $AgBr_0$, $AgCl_0$ and $AgI_0$ is added to the silver halide emulsion containing seed grains after removing large grains whose diameter is larger than 2 times (preferably from 3 to $10^4$ times) of average diameter by passing through a filter.

(99) The producing method of a silver halide emulsion as described in the above item (98), wherein the removing indicates that the value of the ratio [the removed large grains mole/the large grains mole before the removing] is 0.2 to 1.0, preferably 0.5 to 1.0, more preferably 0.7 to 1.0.

(100) The producing method of a silver halide emulsion as described in the above item (1), wherein the pH, pAg and pBr condition of the dispersing solution 2 for producing $AgBr_0$ is existed in the region $B_1$ in FIG. 5, preferably $B_2$, more preferably $B_3$, most preferably $B_4$, wherein $B_1$ region is surrounded by $b_1$ line and pH 12.2, $B_2$ region is surrounded by $b_1$ line and pH 12.0.

DESCRIPTION OF REFERENCE CHARACTERS

1-1: Mixing chamber
1-2: Feed pipe
1-3: Stirring blades
2-1: Porous membrane
6-1: Dispersion medium solution
6-2: Hollow pipe
6-3: Thermostatic jacket
6-4: Cooling water-circulating apparatus
6-5: Mixing box

DETAILED DESCRIPTION OF THE INVENTION

The fine grains for growth ($AgX_0$) in the present invention are necessary to be dissolved rapidly after being added to a reaction vessel. The following performances are required of the fine grains for that sake.

(1) The diameter of the fine grains is small, preferably 20 nm or less on average, particularly preferably 10 nm or small.

(2) The fine grains is monodispersed grains. The mixing of large size grains in the fine grains delays the dissolution, and they remain in the final grains in the worst case and impair the uniformity of the grains at large. The variation coefficient of the equivalent-sphere diameter of the fine grains for growth is preferably 20% or less, more preferably 15% or less, and particularly preferably 10% or less.

(3) The mixture of twin crystal grains is diminished. Since twin crystal grains are hard to be dissolved as compared with regular grains, they are unsuitable for the fine grains for growth. The fine grains for growth are preferably non-twin crystal grains.

"$AgBr_0$, $AgI_0$ and $AgCl_0$ are substantially non-twin crystal grains" described above means that the ratio of the number of grains having two or more twin planes in one grain (A11) is from 0 to 3%, preferably from 0 to 1%, more preferably from 0 to 0.1%, still more preferably from 0 to 0.01%, and most preferably from 0 to 0.001%. It is preferred that the ratio of the number of $AgBr_0$, $AgI_0$ and $AgCl_0$ having one or more twin planes in one grain (A12) is from 0 to 6%, preferably from 0 to 1%, and more preferably from 0 to 0.1%. Further, it is preferred that the ratio of the number of $AgBr_0$, $AgI_0$ and $AgCl_0$ having one or more screw dislocation lines in one grain (A13) is from 0 to 6%, preferably from 0 to 1%, more preferably from 0 to 6.1%, and still more preferably from 0 to 0.01%. This corresponds to the above item (42).

(A11) and (A12) can be obtained by the following methods.

Figure 3:
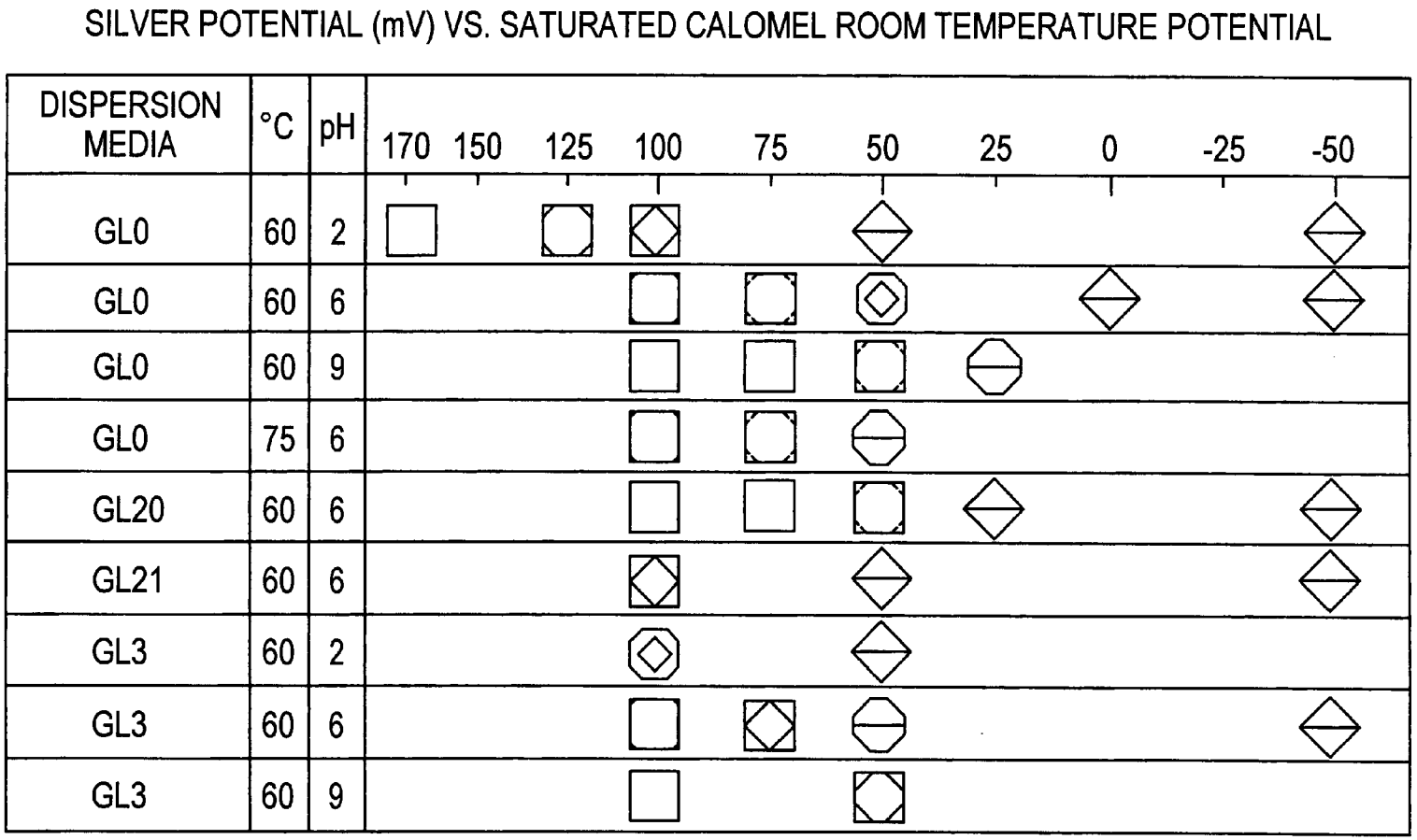
FIG. 3 shows the relationship between the condition of growth of AgBr grains (pH, silver potential, temperature, kinds of dispersion media) and the top figures of grains formed.

$Ag^+$ and $Br^-$ are added to the fine grain emulsion at pBr of 1.5 to 2 at a velocity not generating new nuclei, and the grains are grown until the figures of the grains clarify. The TEM image (transmission electron microphotograph) of the replica of the grains is photographed, and the relationship between the figures of the grains and the existence probabilities is obtained, from which (A11) and (A12) can be obtained with reference to the later described literature 22, FIG. 3, 29. The replica film is a carbon replica film with Au-Pd shadow.

When (A11) is 0.1% or less, a great number of grains must be counted and laborious. In such a case, when the fine grains are subjected to growing after ripening at pBr 1.7 and 60° C. for 7 minutes, (A11) value is heightened and can be obtained more easily. The value of this time is taken as (A10) value. The reason is that the multiple twin crystal grains grow and non-twin crystal fine grains vanish by the ripening. According to this method, the existence frequency of multiple twin crystal grains can be checked accurately with a few times of observation of grain number. (A10) value is preferably from 0 to 6, more preferably from 0 to 1, still more preferably from 0 to 0.1, and most preferably from 0 to 0.01.

As the AgX composition in a grain of fine grains, multiple structural grains comprising a core layer and one or more shell layers as described in item (49) can be more preferably used besides uniform type grains. The number of shell layer is preferably from 1 to 20, and more preferably from 2 to 10. As the variations of AgX compositions between layers, there are a gently varying type [variation of AgX compositions from the central part of a grain to the peripheral part on the shortest straight line indicates (2.0 mol %/0.1 μm) or less] and a steep type [the same variation indicates (2.0 mol %/0.1 μm) or more]. The former is preferred to the latter.

Every combination of AgX compositions of the core layer and the shell layer (AgCl content, AgBr content, AgI content) can be used in the present invention.

The more the $I^-$ content in $AgBr_0$, the more is the ratio of the grains having the defects. For preventing this problem, the following methods are preferred.

1) Since various problems are caused from the fact that AgI having different crystal structure and lattice constant is forcedly mixed to face-centered cubic structure such as AgBr and AgCl, the problems can be solved if the mixture is got rid of. For this purpose, it is effective to perform the addition of $I^-$ by the addition of $AgI_0$ fine grains having an AgI content of from 80 to 100 mol %, preferably from 95 to 100 mol %, at the same time. The defect is hardly generated by $AgI_0$ formation. The AgI content in $AgBr_0$ can be suppressed by this method, hence the above problem can be solved. The AgI content in $AgBr_0$ in this case is preferably from 0 to 15 mol %, more preferably from 0 to 5 mol %, and still more preferably from 0 to 1 mol %.

Only one kind of $AgBr_0$ fine grains can be added, but it is preferred to supplementally add $AgCl_0$ described in the items (46) to (48) and, further, $AgI_0$ described in the items (43) to (45). In the preparation of pure AgI at 0 to 100° C., beta-type, gamma-type or the mixture of both are obtained in general. The mixtures of every mode of molar ratio of beta-type and gamma-type (beta/gamma: from 0.1/99.9 to 99.9/0.1) can be used as $AgI_0$. In the preparation of pure AgI in an excess amount of $Ag^+$, a gamma-type is predominant, and in an excess amount of $I^-$, a beta-type is predominant. The content of beta-type is generally from 30 to 100 mol %, preferably from 70 to 100 mol %, and more preferably from 90 to 100 mol %.

2) Since the defect is liable to be generated especially at nucleation, it is preferred that the AgI content of AgX nuclei formed at nucleation of $AgBr_0$ is from 0 to 15 mol %, preferably from 0 to 5 mol %, and more preferably from 0 to 1 mol %, and the AgI content is increased after termination of nucleation. That is, the embodiment of the AgI content is preferably (a core layer<a shell layer) , and more preferably (a layer closer to the surface>a layer farther from the surface). Further, contiguous layers are preferably in the relationship described in item (49).

1. Measurement of Fine Grain Diameter

In measuring the diameter of a fine grain, attention must be given to the following points. The diameter of a grain increases due to generation of Ostwald ripening of a grain during storage of an emulsion, and so the ripening is prevented by saturation adsorption of an adsorbent onto the surface of a grain just after grain formation. Cyanine dyes are preferably used as the adsorbents, and benzoxazoles and benzothiazoles (e.g., the later-described dye 1) are more preferred. Since the later-described compounds containing a pyridinium salt group ($Pyr^+$) do not have the preventing function of Ostwald ripening, the adsorptive force of the conjugated system is effective. Antifoggants bonded with $Ag^+$ (e.g., 1-phenyl-5-mercaptotetrazole (PMT) and 4-hydroxy-6-methyl-1,3,3a,7-tetraazaindene (TAI)) do nothave the function of preventing the ripening. The reason is that the antifoggants deform by forming antifogging-silver crystal.

A producing apparatus for use in the present invention is described below. An $AgBr_0$ emulsion can be produced by the batch system as described in item (2). In this case, fine grains comprising uniform AgX composition in the grain can be produced by changing the $X^-$ composition of the $X^-$ salt solution ($X^-$ solution) during the period of time from the start of addition until the termination or adding an $X^-$ salt solution comprising different $X^-$ composition from the $X^-$ composition of the reaction solution to the reaction solution. Fine grains having uniform composition can be prepared if the $X^-$ composition is not changed.

Figure 1:
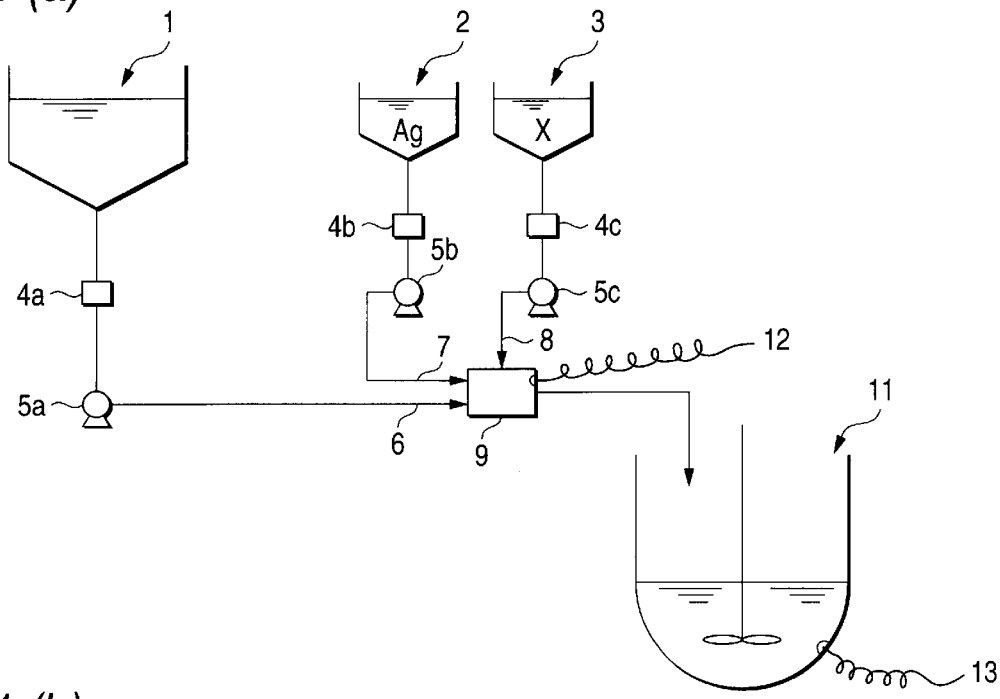
FIG. 1 are drawings showing an example of continuous production apparatus.
Figure 1:
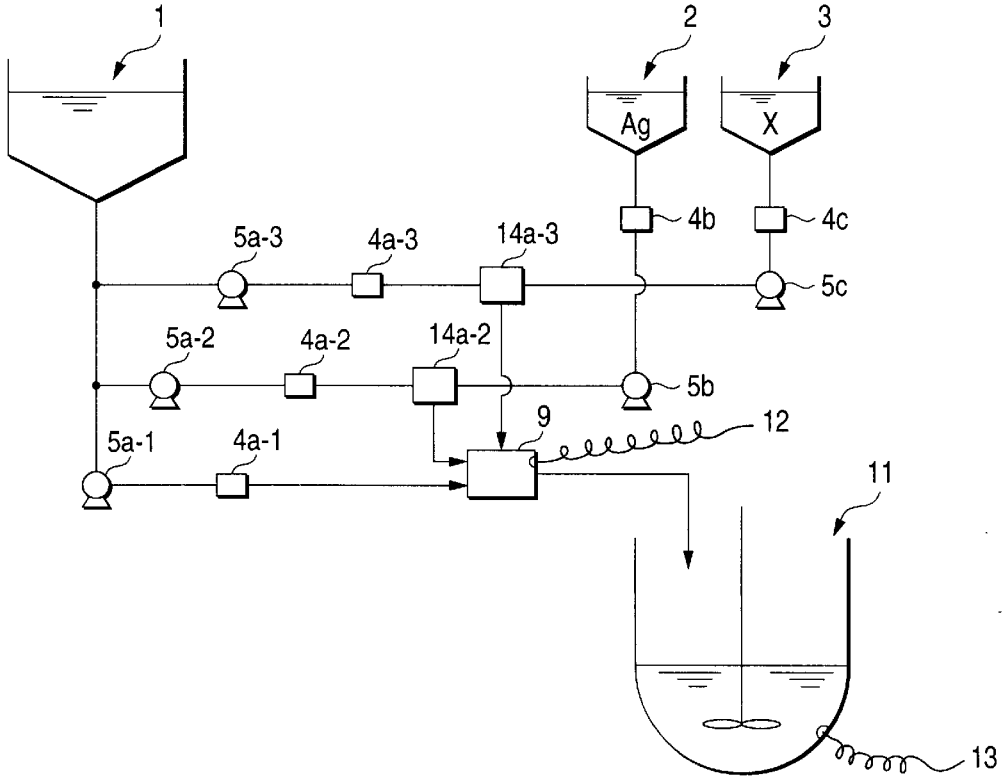

Further, an $AgBr_0$ emulsion can be produced by the continuous system described in item (3). The example thereof is shown in FIG. 1 (JP-A-2-167817). The production apparatus consists of a mixer represented by 1 and a reaction vessel represented by 2. An important point in forming grains is that a reaction vessel is used only for adjusting pAg and the addition of a silver salt aqueous solution and a halide salt aqueous solution is not performed in a reaction vessel, further the circulation of the protective colloid aqueous solution (including silver halide grain) in the reaction vessel to the mixer is not also performed. Into the reaction vessel are introduced silver halide fine grains which are dissolved to supply silver and halide ions (they are called fine grains for growth). By this structure, uniform grain growth not accompanied by the local distribution of silver or halide ions can be achieved.

On the basis of the above point, preferred conditions for forming fine grains are shown below similarly to Japanese Patent Nos. 2008051 and 2060301.

(1) The time from the introduction of silver and halogen aqueous solutions into a mixer until the introduction of fine grains for growth into a reaction vessel must be short as far as possible. If fine grains formed are present in a mixer for long time, the grains begin to grow. The grains also grow by ripening among grains (so-called Ostwald ripening) outside the mixer. For preventing the grains from growing, residence time t in the mixer is made short. Residence time t is defined by the following equation.

$$t=V/(a+b+c)$$

wherein v represents the volume of the reaction chamber of the mixer (ml); and a, b and c represent addition rate (ml/min.) of a silver salt aqueous solution, a halide salt aqueous solution and a protective colloid aqueous solution respectively. In the present invention t is preferably 20 sec. or less, more preferably 1 sec. or less, and particularly preferably 0.1 sec. or less. The time required in the movement from the mixer to the reaction vessel is preferably as short as possible.

Figure 2:
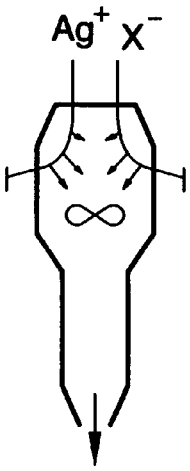
FIG. 2 are top views of cross-sections of mixers for forming fine grains.
Figure 2:
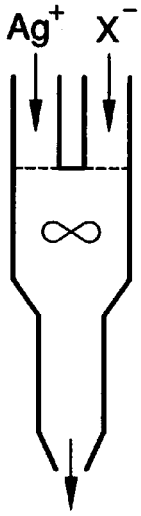
Figure 2:
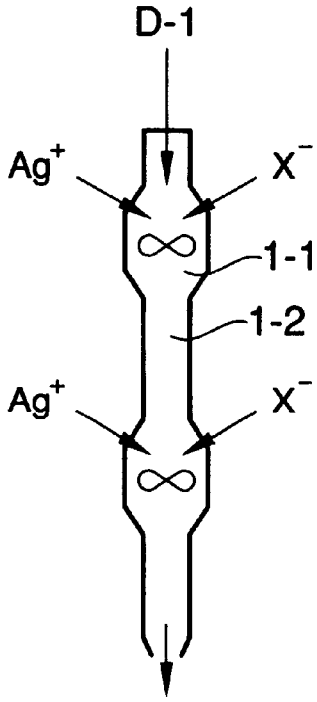

(2) Stirring in the mixer should be performed efficiently. There is described in James, *The Theory of the Photographic Process* (p. 93) that "since crystals far away from each other come into contact directly and coalesce in coalescence ripening, to thereby form big crystals, so that grain sizes suddenly change. Both of Ostwald ripening and coalescence ripening occur not only after termination of precipitation but also during precipitation". The coalescence ripening described here is liable to occur when grain sizes are small, in particular when stirring is insufficient. Therefore, the mixer according to the present invention is equipped with stirring blades inside the mixer. Mixers may be those having stirring blades having rotation axis as described in FIG. 2 in JP-A-2-167817, or mixers having stirring blades not having a through type rotation axis as disclosed in JP-A-10-239787 or JP-A-10-43570. Stirring blades rotate at high velocity and mix the added solutions. Engine speed is preferably 1,000 rpm or higher, more preferably 2,000 rpm or higher, and particularly preferably 3,000 rpm or higher. Silver halide fine grains formed by rapidly mixing are immediately moved to the reaction vessel. The examples of mixers are shown in FIG. 2.

During the fine grain formation, the pH value can be reduced, increased or can be maintained constant within the above pH range. The fine grains can be formed on almost the same pH condition through the grain formation, or pH can be lowered by adding an acid after nucleation. However, the pH during nucleation, preferably the pH during grain formation, is preferably maintained almost constant (±0, preferably within ±0.2).

Figure 5:
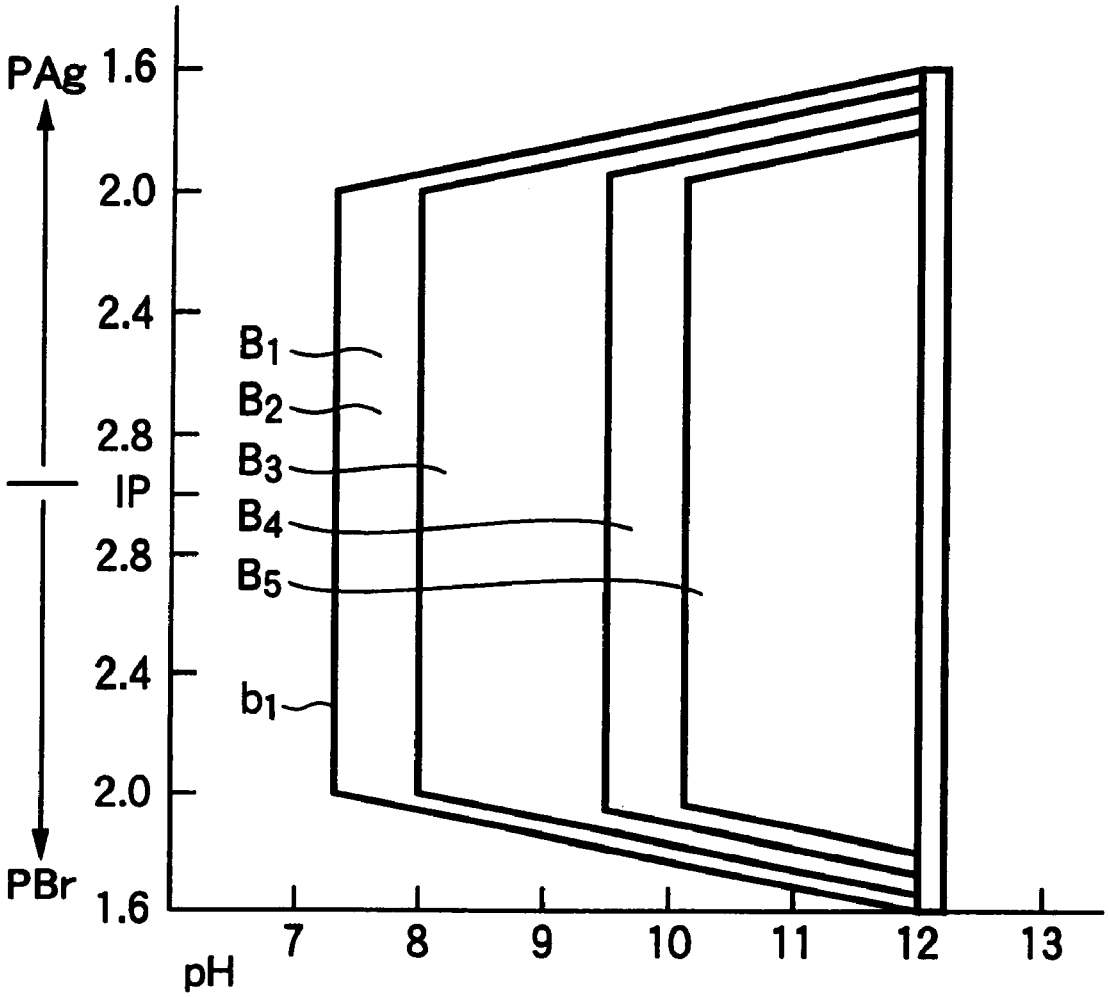
FIG. 5 is a drawing showing a preferable pH-pAg(pX) region at the formation of $AgX_0$ grains.

FIG. 5 indicates a preferable pH-pAg(pBr) condition of a dispersion medium solution 2 when the $AgBr_0$ is formed (preferably when the nucleus of $AgBr_0$ is formed).

IP indicates an equivalence point that an Ag ion concentration is equal to a Br ion concentration.

Region $B_1$ indicates a region surrounded by the outermost frame and Region $B_2$ indicates a region surrounded by a line of pH 12 and the outermost frame $b_1$.

Regions $B_3$ to $B_5$ indicate a region surrounded by a line of pH 12 and each frames shown, and the frame of inside is preferred, and particularly the Region of $B_5$ is most preferred.

In the above item (2), the $Ag^+$ solution and the $X^-$ solution can be added at a prescribed flow rate, or can be added by CDJ method of adding the solutions by controlling the silver potential of the solutions in a prescribed value. A method of adding the solutions at a prescribed flow rate for 5 to $10^3$ sec. preferably from 30 to 200 sec., at the start of the addition at a prescribed flow rate, and then performing the addition by CDJ method is more preferred. Both solutions may also be added by accelerating addition to make the number of new nuclei occurring at the start of grain formation 1.1 to 10 times as many as those occurring in the case of constant flow rate addition. Besides the simultaneous start of addition, it is also possible to perform precedent addition of either $Ag^+$ solution or $X^-$ solution by 0.1 to 10 sec., preferably from 0.5 to 3 sec., at the start of addition.

The temperature of the fine grains during grain formation is especially important in the present invention, the temperature is preferably 10° C. or lower, more preferably 8° C. or lower, and particularly preferably 5° C. or lower. It is necessary that the silver salt solution and the halide salt solution to be fed to a mixer should be maintained at low temperature in advance, preferably at 5° C. or lower, and particularly preferably 2° C. or lower. The fine grains formed are immediately moved into a reaction vessel. The time required during this procedure is preferably as short as possible so as not to increase the temperature of the fine grains. When the time is required for the movement, it is preferred to keep cooling. The preferred temperature in this case is 10° C. or lower, more preferably 8° C. or lower, and particularly preferably 5° C. or lower.

The temperature of the reaction vessel is preferably 60° C. or higher, particularly preferably 75° C. or higher, for rapidly dissolving the grains supplied from the mixer and accelerating the growth of the grains.

With respect to the apparatus for forming the fine grains, the later-described literature 2 and 3 can be referred to. The alkali agent to be added during the fine grain formation is preferably neutralized in the embodiment described in item (11), but after the fine grains are added to a seed crystal, the alkali agent may be neutralized with the acid added to the seed crystal.

2. Addition of Additives

In item (35), it is preferred that the twin plane formation-inhibitor is added to dispersion medium solution 2 before 90% of the total addition amount of $Ag^+$ during fine grain formation is added, preferably 20%, more preferably 1%, and most preferably the compound is added before the start of the addition of $Ag^+$. All the amount of the compound may be added at one time, may be divided to two or more times during formation, or may be added continuously. The more preferred compound in a10) is compound (i). When the compound is added continuously, it may be added with one or more solutions to be added as mixture.

Regarding the twin plane formation-inhibitors, the later-described literature 17 can be referred to. As the antifoggants and cyanine dyes described in item (63), the compounds described in the later-described literature 1, 14, 19 and 22 can be used.

3. Formation of $AgI_0$ and $AgCl_0$ $AgI_0$ and $AgCl_0$ described in items (43) to (48) are also preferably formed according to the description on $AgBr_0$ formation, but $AgI_0$ may be formed on pH conditions other than that (pH 2 to 12). However, in the case of $AgI_0$, tabular grains are liable to be formed at pH condition lower than 4, hence pH is preferably from 4 to 12, more preferably from 5 to 12. In the case of $AgCl_0$, it is preferred to perform grain formation on the pH condition described in item (48). The pH condition is applied in particular to the period of nucleation described in item (9).

4. Control of Silver Nucleus Amount Formed

When more than the desired amount of reduced silver nuclei are formed in the fine grains $AgBr_0$, $AgI_0$ and $AgCl_0$ formed, the silver nucleus amount can be reduced by oxidation before the addition of the emulsion to a seed crystal emulsion or after the addition to a seed crystal emulsion. In the latter case, oxidation efficiency is good when the oxidation is performed during the step of dissolving the fine grains and depositing on the seed crystal emulsion. From 5 to 100%, preferably from 20 to 100%, and more preferably from 80 to 100% of the total amount of reduced silver nuclei can be oxidized and return to $Ag^+$. The oxidation is performed by the addition of an amount of from $10^{-7}$ to 1 mol/liter, preferably from $10^{-6}$ to $10^{-1}$ mol/liter, of an oxidant of normal electrode potential (V) of from 0.5 to 3, preferably from 1 to 3 and pH of from 1 to 10, preferably from 1 to 6.

5. Porous Addition System

The porous addition system described in items (36) and (37) can be preferably used, and the later-described literature 4 can be referred to. Since the $Ag^+$ and $X^-$ solutions are added as very fine grain solutions, noticeable high oversaturation areas disappear and (A11) to (A13) values come to be small. The diameter of one addition pore is preferably from 1 to $5\times10^6$ nm, more preferably from 1 to $1\times10^6$ nm, and still more preferably from 1 to $1\times10^5$ nm. The CV value of pore diameter distribution is preferably from.0.01 to 0.6, more preferably from 0.01 to 0.3, and still more preferably from 0.01 to 0.1.

It is preferred that the addition pores are closed when addition is ceased, and the solution not added yet in the addition system and dispersion medium solution 2 are out of contact with each other. A hollow pipe is preferably used as the supplying pipe, more preferably a hollow rubber-like elastic porous membrane. A closed type volume-variable reaction vessel [(vapor phase volume)/(vapor phase volume+liquid phase volume) is from 0 to 0.3, preferably from 0 to 0.1, and more preferably from 6 to 0.03] is preferably used, and the disclosure in JP-A-6-162478 can be referred to. The distribution of addition pores in the solution is preferably uniform. The CV of the dispersion of the distances between contiguous pores is preferably from O.01 to 0.70, more preferably from 0.01 to 0.40, and still more preferably from 0.01 to 0.15, and concerning the details of these addition system and apparatus, and the later-described literature 1 to 4 can be referred to.

It is also more preferred embodiment in the continuous addition method that the $Ag^+$ solution and the $X^-$ solution are added to the mixer through porous membrane described items (36) to (38). The back flow of the reaction solution in the mixer into the $Ag^+$ solution and the $X^-$ solution can be advantageously prevented by this embodiment. An embodiment wherein the mixer and the addition solutions are partitioned by a porous membrane (e.g., the embodiment shown in FIG. 2(*b*)) is preferred. FIG. 2(*a*) shows the arrangement of the hollow pipe porous membrane addition system in the mixer.

6. Method of Cooling

As the coolants for use in items (4), (7) and (17), wellwater-freezing liquids (e.g.,ice, snow, and frozen products of organic solvents), liquefied gases (e.g., liquid nitrogen and liquid air), freezing gases (e.g., dry ice), refrigerants, cooling water, cooling organic solvent solution, and mixtures of two or more of these can be used. Commercially available circulating apparatus for cooling liquids (water, organic liquid compounds) can also be used. The details thereof are described in the later-described literature 18. The temperature of a coolant is from 1 to 300° K, and preferably from 200 to 285° K.

Cooling can be performed by bringing the coolant into contact with the external walls of a reaction vessel and a feed pipe, or by bringing the coolant put in a container or a bag into contact with the liquid to be cooled, or by bringing a hollow external wall through which a coolant is flowing into contact with the liquid to be cooled, or by the embodiments described in items (17) and (18). When a solution is cooled by putting liquefied gas or freezing gas in the solution, the coolant is vaporized after cooling and the increment of the. reaction solution is advantageously inhibited. Concerning the coolants and the cooling methods, the later-described literature 17 and 18 can be referred to.

7. Ultrafiltration

It is a particularly preferred embodiment to concentrate the fine grain emulsion in the embodiments described in the above items (39) to (41) and (61). The more the addition amount of $AgNo_3$ per a unit solution amount (mol/liter) is increased for the purpose of increasing the AgX mol/liter of the emulsion, the more the grain size of the formed grain becomes large, thus (A11) value increases. The above embodiments are effective as the countermeasures. The final concentration of the emulsion is preferably from 0.01 to 3 AgX mol/liter, more preferably from 0.05 to 3 AgX mol/liter.

However, the diameters of the fine grains sometimes become large during ultrafiltration. It is preferred in this case to add the emulsion to a seed crystal emulsion and perform ultrafiltration during the growth of the seed crystal. This procedure can be performed either continuous lyor intermittently. This process can be done in the time of from 1 to 100% of the total time of the growing step, preferably from 5 to 100%.

Concerning the details of ultrafiltration, the later-described literature 8 can be referred to.

The probability of the fine grain's passing through the membrane (the loss rate of the fine grains) in the ultrafiltration is preferably from 0 to 30% of the total amount of fine grains at the point of termination of filtration, more preferably from 0 to 5%, and still more preferably from 0 to 1%. When the fractional molecular weight of a filtering membrane is made small, the leak rate of the fine grains becomes small, but filtration speed becomes slow. Since gelatin molecules are adsorbed onto the fine grains, the fine grains leak with difficulty as compared with the case of fine grains alone. The fractional molecular weight of a filtering membrane is generally from 1,000 to $10^6$, preferably from $10^3$ to $10^5$, and most preferred molecular weight can be selected.

8. Method of Addition of Fine Grains

The fine grains can be added either continuously or intermittently. All the amount of the fine grains formed by a batch system can be added at a time, or can be added at 2 to $10^5$ times, preferably from 3 to $10^5$ times, or may be added continuously over 1 to $10^3$minutes. As the embodiment of suspending the addition in the case of continuous addition, there is a method of stopping the addition of the $Ag^+$ solution and the $X^-$ solution, pressing out the solution in the reaction pipe with air, feeding water to wash the inside of the pipe, discharging the water and resetting. The fine grains can be added on the liquid level of the seed crystal, or may be added into the solution. Addition can be reopened in case of necessity.

The effect of pH at the time of grain formation can be thought by corresponding with the pKa of the dispersion medium. The pKa value of each group is: alpha-$NH_2$ is 7.5, epsilon-$NH_2$ of Hly is 9.5, and epsilon-$NH_2$ of Lys is 10.7. The interaction between these groups and $Ag^+$ ($Ag^+$ in the solution and on the surfaces of the grains) is strengthened by pH higher than pKa, thus the effect of the present invention can be obtained. This is presumably because the formation frequency of reduced silver nuclei becomes high at pH 12 or more, and the pKa of the amine in amide bond (about 12) is also effective.

9. Flocculation Precipitation Washing of Fine Grains

After $AgBr_0$ or $AgI_0$ or $AgCl_0$ have been formed, a flocculation-precipitant may be added to flocculate and precipitate the emulsion, to remove a supernatant, and then the $AgBr_0$ or $AgI_0$ or $AgCl_0$ may be added to the seed crystal emulsion. Concerning the flocculation-precipitant, the later-described literature 1 can be referred to. Of these, the embodiment described in item (69) is more preferred. It is preferred that the flocculate is redispersed after removing a supernatant and then $AgBr_0$ or $AgI_0$ or $AgCl_0$ are added to the silver halide seed crystal emulsion. It is preferred that the amount of the emulsion is from 1 to 90% of the amount before precipitation, preferably from 5 to 60%.

10. Others

In the above item (5), an embodiment wherein at least one of the $Ag^+$ salt solution and the $X^-$ salt solution to be added, preferably both of them, contains from 0 to 0.01 mass % (i.e., weight %) of dispersion medium 3, may also be used.

When the tabular grains are grown by adding fine grains, the tabular grains are to be grown under the degree of low oversaturation which is prescribed in the solubility of the fine grains, the crystal defect parts of the tabular grains are grown more selectively as compared with the method of adding $Ag^+$ and $X^-$ as the ionic solutions. When the grain diameters of fine grains are increased, the effect becomes great, but when the diameters are too large, the solubility of the fine grains becomes lower than that of the edge parts of the tabular grains, thus tabular grains cannot be grown. The larger the diameter of the tabular grain and the thicker the thickness of the tabular grain, the lower is the solubility of the edge part of the tabular grain. Thus, the tabular grain can be grown with maintaining the thickness thin when grown by maintaining the relationship between both as the embodiment in item (83).

For exactly controlling the solubility, it is preferred that the diameter distribution of fine grains be more uniform, and the variation coefficient is preferably from 0.01 to 0.3, more preferably from 0.02 to 0.15. As one method of obtaining the fine grains having more uniform grain diameter distribution, the method described in item (94) is preferred. Only fine grains having diameters of from 0 to 80%, preferably from 0 to 40%, of the average diameter can vanish by performing ripening at low temperature and slowly.

In the embodiment in item (88), the temperature of the solution to be added becomes near the temperature of the reaction solution. Therefore, more preferred AgX grains can be formed. When the value of the hollow pipe length is from 0 to 0.2, the effect is small.

When the $Ag^+$ salt solution and the $X^-$ salt solution are simultaneously mixed and added at a high flow rate, the simultaneous addition characteristics of both solutions are liable to become uneven between the initial and the final stages, but the unevenness is inhibited by the embodiments in items (89) and (90), and so preferred. Further, in general, crystal defects are liable to be formed at the initial stage of nucleation, and the higher the flow rate, the easier is the formation. The embodiments in items (89) and (90) inhibit the formation of crystal defects.

Dispersion Medium

As dispersion medium 1 or 2 or 3, conventionally well-known water-soluble dispersion media can be used. The later-described literature 1 can be referred to. One or more kinds of these dispersion media can be used in concentration of from 0.1 to 20 mass %, preferably from 1 to 10 mass %. A preferred dispersion medium is gelatin. Gelatins described in items (13) to (30) are particularly preferred. The weight average molecular weight of the dispersion medium is from 3,000 to $10^6$, preferably from 5,000 to $10^5$. The CV of the molecular weight distribution of the dispersion medium or the low molecular weight gelatin is preferably from 0.01 to 0.6, more preferably from 0.01 to 0.3, and still more preferably from 0.01 to 0.1. The Met group content in the gelatin of from 0 to 60 $\mu$mol/g is usable, but the embodiment described in item (14) is more preferred.

1. Low Molecular Weight Gelatin

The low molecular weight gelatin described in item (19) can be preferably used. The low molecular weight gelatin described in item (19) can be obtained by the following specific examples. In the first place, a gelatin aqueous solution is made, 1) and the gelatin aqueous solution is hydrolyzed on an acidic condition of pH 3 or less or on an alkali condition of pH 10 or more; 2) the gelatin is heat-decomposed by heating in the neutral area of pH 3 to 10, preferably from 4 to 9; 3) the gelatin is decomposed by adding a gelatin-decomposing enzyme; 4) the gelatin is decomposed by the application of ultrasonic waves, electromagnetic waves (from 2 to $10^8$ eV/quantum), high energy corpuscular rays (from 5 to $10^8$ eV/quantum); and 5) the low molecular weight gelatin is synthesized by a peptide polymerization reaction with amino acid or polypeptide having a polymerization degree of from 2 to 100 as the starting material.

Processes 1) and 2) are performed at 30 to 200° C., preferably from 50 to 100° C., for 10 sec. to 100 days, preferably from 1 min. to 10 days. In process 3), after the decomposition of the gelatin, the gelatin-decomposing enzyme is deactivated by heating at 50 to 100° C., an oxidant of normal electrode potential (V) of from 0.1 to 3, preferably from 0.7 to 3 is added to oxidize the enzyme, to thereby reduce the Met group content to 0 to 90% of the content before oxidation, preferably from 0 to 50%, and more preferably from 0 to 10%.

With respect to the details of the demineralization and the dissociation purification described in item (23), the later-described literature 1 and 8 can be referred to.

When gelatin is decomposed at pH 0 to 3, Asp (aspartic acid)-Pro(proline) bond is primarily cut due to hydrolysis by acid, and a low molecular weight gelatin is obtained, which is preferred. This phenomenon occurs by any acid.

2. Dispersion Medium Which is not Subject to Gelation at Low Temperature

The condition described in item (16) can be realized by making use of the following phenomena. 1) The lower the average molecular weight, the lower is the viscosity of the dispersion medium solution, at the same mass % concentration and at the same temperature. Accordingly, it is preferred to use the molecular weight gelatin described in item (19). 2) In the case of gelatin, the lower the content of hydroxy-proline (Hyp), the lower is the ability of gelation at low temperature. 3) An aqueous solution of a water-soluble synthetic high polymer not containing a gelation-accelerating group, such as a Hyp group, is not subject to gelation even at low temperature, and so preferred. These are further described in detail below.

3. Gelatin Having Low Hyp Content

As the examples of gelatin having low Hyp content, gelatins extracted from the bone or skin of the animals living in the frigid sea, preferably gelatins extracted from the skin of the fish living in the frigid sea. The reason the gelatins are difficult to gel even at low temperature is that a Hyp content is low.

However, the gelatins are highly adsorptive onto AgX grains, since the gelatins have a high histidine (His) group content. Therefore, if these gelatins are present at the time of tabular grain formation, the thickness of the tabular grains formed is thick. For thinning the thickness, the following methods can be preferably used.

i) The Met group content of the gelatin is reduced to the embodiment as described in item (28).

ii) The His group content of the gelatin is reduced to the embodiment as described in item (28).

The reducing methods are as follows. b1) The above oxidant is added to the gelatin aqueous solution to oxidize the His groups, to thereby deactivate the gelatin. When the oxidant is added to the gelatin aqueous solution, the Met group is oxidized in the first place. The oxidation of the His groups begins with the increase of the addition amount of the oxidant and with the addition of the oxidant having more positive normal electrode potential. b2) A chemical modifier is added to the gelatin aqueous solution to modify the His groups, to thereby reduce the bonding strength between the His groups and $Ag^+$ (Gibbs standard free energy variation/mol) to 0 to 80% of the original bonding strength, preferably from 0 to 40%, and more preferably from 0 to 10%. From 1 to 100% of the total His groups are chemically modified, preferably from 30 to 100%, and still more preferably from 50 to 100%, i.e., (imidazole residue-$R^1$) is formed, wherein $R^1$ represents an organic compound group having from 1 to 50, preferably from 1 to 10, carbon atoms. Regarding the chemical modification, the later-described literature 13, 2) can be referred to. For example, ethoxyformic anhydride and methyl-p-nitrobenzenesulfonate are exemplified.

4. —COOH Group-modified Gelatin

As the chemical modifications of the —COOH group in the gelatin described in the above item (30), the examples include esterification ($—COOR^2$) and amidation ($—CONH_2$, $—CONHR^2$). These compounds are synthesized, e.g., by the following reactions. $—COOH+HO—R^2 \rightarrow —COOR^2+H_2O$, $—COOH+H_2N—R^2 \rightarrow —CONH—R^2+H_2O$, $—COOH+NH_3 \rightarrow —CONH_2+H_2O$, and $—COOH+R^2—NH—R^3 \rightarrow —CO—N—R^2(R^3)_0$, wherein $R^2$ and $R^3$ each represents an organic compound group having from 1 to 50, preferably from 1 to 10, carbon atoms.

Regarding the reaction of a carboxylic acid group and alcohols or amines, the later-described literature 7 can be referred to. For accelerating the reaction, a carboxylic acid group may be reacted after being converted to a more active group on reaction (e.g., —COCl). The higher increased the concentration of the reactant (e.g., alcohols or aminos), the higher is the rate of reaction, or the more lessened the product (e.g., $H_2O$) by removing by, e.g., evaporation, the higher is the rate of reaction. The preferred example is an esterified gelatin having from 1 to 5 carbon atoms.

The causes that the gelatin produces a good result are thought as follows. When the —$COO^-$ of gelatin is esterified, the water solubility of the gelatin lowers, as a result, the adsorbing property increases, that the —$COO^-$ is subjected to Coulomb repulsion on the grain surface of $Br^-$ body, but this is countervailed by the esterification and the property of protective colloid becomes good.

5. Adjustment of Met Group Content of Gelatin

The content of the Met groups of gelatin can be adjusted according to the following methods.

1) The content of the Met groups can be adjusted by adding the later-described oxidant to an aqueous solution of gelatin and converting the thioether group in Met to an —$SO_2H$ group, a sulfo group, an —S(O)— group or an —$S(O_2)$— group, preferably to an —S(O)— group. Specifically, an oxidant is added at 3 to 100° C., preferably from 10 to 80° C., and the aqueous solution of gelatin is allowed to stand as it is for 1 sec. to 100 days, preferably from 1 min. to 3 days. Gelatin oxidized by adding $H_2O_2$ is more preferred. Further, gelatin obtained by removing from 5 to 100% of the remaining oxidant, preferably from 20 to 100%, is preferred. The details thereof are disclosed in JP-A-11-282109.

2) As another method, the content of the Met groups can be adjusted by alkylating the thioether group (—$S(R^2)$—) by an alkylating agent (e.g., alkyl halide), or by converting the thioether group to thionium (—$S^+(R^2,R^3)$—). Regarding the details thereof, the later-described literature 24 can be referred to.

6. Pendent Type Gelatin

As dispersion medium 1 or 2 or 3, in particular as dispersion medium 2, dispersion medium Gel-$(A_1)n_1$ obtained by covalent bonding of an adsorptive compound and gelatin can be preferably used. $A_1$ represents the later-described adsorptive group. $n_1$ represents the average number of the adsorptive group bonded per one molecule of the gelatin, preferably from 0.1 to 80, and more preferably from 0.1 to 20. The bonding is carried out by the bonding reaction between functional groups and also the bonding is carried out via a linking group of a hardening agent, etc. Regarding the details of these compounds, the later-described literature 19 can be referred to.

As dispersion medium 1 or 2 or 3, in particular as dispersion medium 2, dispersion medium Gel-$(A_2)n_1$ can be preferably used. $A_2$ represents one or more groups of the later-described adsorptive group, a hydrophilic group or a hydrophobic group $n_1$ represents the average number of these groups bonded per one molecule of the gelatin, and the average number is preferably from 0.1 to 100. At least one group of these groups represented by $A_2$ is present in one molecule, but two or more groups may be contained. The compounds represented by formula (1-1) or (1-2) shown below are exemplified as these adsorptive groups.

It is preferred for the adsorptive groups to satisfy the definition in the above item (64). All the adsorptive groups in the present invention satisfy the characteristics.

7. Water-soluble Synthetic High Polymer

Since an aqueous solution of a 1 to 10 mass % water-soluble synthetic high polymer not substantially containing a gelation-accelerating group (e.g., a group which has a cyclic structure and forms hydrogen bond crosslinking between molecules such as Hyp in gelatin and pectic acid in pectin) is not subjected to gelation even at low temperature, and so preferably used in forming the fine grains at low temperature. Here, "not substantially containing" means that the characteristics follow the definition in item (31). A water-soluble synthetic high polymer is a compound capable of forming an aqueous solution of 1 mass % or more, preferably from 5 to 20 mass %, in water.

The monomer unit of from 0.01 to 100%, preferably from 0.1 to 50%, of the total number of the monomer unit in the high polymer contains from 1 to 10 hydrophilic groups by covalent bonding. "The hydrophilic group" used here means a polar group which interacts with water strongly. A group containing an oxygen, nitrogen or sulfur atom is generally a hydrophilic group, in particular, a group forming a salt is a strong hydrophilic group.

The specific examples of hydrophilic groups include —COOH, —OH, —$CONH_2$, —$NH_2$, —$NHCONH_2$, —$(OCH_2CH_2)_n$—, —$SO_3H$, —$OSO_3H$, nitrogen quaternary base, and the salts thereof, wherein n represents an integer of 1 or higher. Hydrophilicity is more quantitatively represented by heat of hydration [ΔH of the time when a hydrophilic group in the state of gas molecule is dissolved in water of infinite dilution (KJ/mol)], which is preferably from 0.5 to $10^4$ KJ/mol, more preferably from 1 to $10^3$ KJ/mol.

Further, it is preferred that the monomer unit of from 0.01 to 100%, preferably from 0.1 to 50%, of the total number of the monomer unit contains a group which is adsorbed onto an AgX grain by covalent bonding. As the examples of the adsorptive groups, —OH, —$NH_2$, —COOH, —$CONH_2$, —S—, —O—, —Se—, an imidazole group, an antifogging group, and the compounds described in the above a10) are exemplified. For example, when an antifoggant and a monomer unit form $(A_3)n_2$ (monomer unit) by covalent bonding, the antifogging group represents $A_3$. $A_3$ represents an antifogging group, and $n_2$ represents a molar ratio of $A_3$ to the monomer unit.

Further, it is preferred that the monomer unit of from 0.01 to 100% of the total number of the monomer unit, preferably from 0.1 to 50%, contains a hydrophobic group to water [a substance having 0.49 KJ/mol of the above-described heat of hydration] by covalent bonding. The hydrophobic group is an organic compound having from 1 to 60 carbon atoms, e.g., aliphatic and aromatic compounds. Representing the compound obtained by covalent bonding these groups as Poly-$(A_4)n_3$, $A_4$ represents one or more of the hydrophilic group, adsorptive group and hydrophobic group. It is preferred that the monomer unit of from 0.01 to 100% of the total number of the monomer unit, preferably from 0.1 to 50%, contains $A_4$ by covalent bonding.

Regarding the antifoggants, the later-described literature 1, 14 and 22 can be referred to, and with respect to the compounds described in a10), the later-described literature 10 can be referred to. The preferred compounds in a10) are compounds (i), and the more preferred compounds are compounds having from 1 to 5 cyclic groups of n conjugated system (a homo- or hetero-cyclic group) in one molecule. As the representative examples, TAI, PMT, TAI1 and PMT1 can be exemplified.

Regarding the high polymers composed of these groups by bonding, the later-described literature 1, 9 and 24 can be referred to.

TAI1

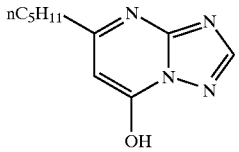

PMT1

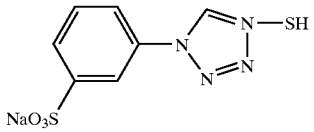

(1-1)

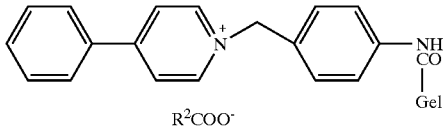

(1-2)

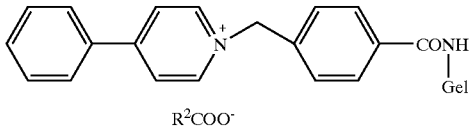

When these high polymers are classified by synthetic methods, an addition polymerization system, a polycondensation system, a polyaddition system, an addition condensation system and a ring-opening polymerization system are included, and when classifiedby fundamental structures, polyvinyl, polyamide, polyester, polyester carbonate, polyether, polyether sulfone, polyether ketone, and silicone polymers are included. Regarding these compounds, the later-described literature 1, 6 and 9 can be referred to.

Seed Crystal

Conventionally well-known every seed crystal can be used in the present invention, and the tabular grains shown in items (70) to (76) can be particularly preferably used. Regarding the details of these grains, the later-described literature 1, 11 and 12 can be referred to.

{111} Tabular seed crystals consist of tabular grains which are formed in dispersion medium solution 4 containing from $10^{-7}$ to 1 mol/liter, preferably from $10^{-5}$ to 0.1 mol/liter, of a {111} plane-forming compound shown in a11) below, and tabular grains formed without substantially containing a {111} plane-forming compound (less than $10^{-7}$ mol/liter, if it is contained). There are a method of growing the tabular grains in the state of containing the {111} plane-forming compound in that concentration, and a method of growing the tabular grains in the state of not containing the {1111} plane-forming compound. Concerning the details of these compounds, the later-described literature 10 can be referred to.

Compound a11):

(i) compounds containing one or more onium salt groups in one molecule and excluding gelatin and $NH_4$+, preferably compounds also excluding ammonium compounds having two or less carbon atoms, and more preferably compounds having from one to three pyridinium salt groups in one molecule, (ii) aromatic compounds having one or more iodide groups and one or more —OH groups substituted on an aromatic ring, (iii) nitrogen-containing heterocyclic compounds, which contains, in one molecule, one or more heterocyclic rings having two or more nitrogen atoms in a 4- to 7-membered ring, (iv) cyanine dyes, (v) compounds having a divalent sulfur group-containing heterocyclic group, (vi) thiourea compounds, (vii) amino thioethers, and (viii) divalent sulfur group-containing organic compounds having 25 or less total carbon atoms.

{111} Tabular seed crystal grains consist of an embodiment of grains in which from 60 to 100%, preferably from 90 to 100%, of the entire projected area of AgX grains comprises grains having two twin planes parallel to the principal planes, and an embodiment of grains in which from 60 to 100%, preferably from 90 to 100%, of the entire projected area of AgX grains comprises grains having three twin planes. In addition to the above grains, there is an embodiment of grains comprising the ratio of grains having two twin planes to the grains having three twin planes of 1/99 to 99/1.

{100} Tabular seed crystal grains consist of tabular grains which are formed by forming anisotropic growth defects in grains (called screw dislocation lines in the present invention) (the embodiment described in item (55)), and AgX tabular grains which are formed by adding $Ag^+$ and $X^-$ to dispersion medium solution 4 containing from $10^{-7}$ to 1 mol/liter of a {100} plane-forming compound shown in a12) below, preferably from $10^{-5}$ to 0.1 mol/liter. There are a method of growing the tabular grains in the state of containing the {100} plane-forming compound in that concentration, and a method of growing the tabular grains in the state of not containing the {100} plane-forming compound (less than $10^{-7}$ mol/liter, if it is contained).

Compound a12):

i) compounds having from 2 to $10^6$ —OH groups in one molecule, preferably from 4 to $10^4$, ii) compounds having one or more nitrogen n conjugated systems in one molecule, and iii) compounds having from 1 to $10^6$ adsorptive groups which accelerate {100} plane formation of AgBr grains by covalent bonding, preferably from 1 to $10^4$.

Regarding the details of these compounds, the later-described literature 12 can be referred to.

When the nucleus of a tabular seed crystal grain is formed at 30 to 60° C., the diameter of the grain described in item (75) becomes from 20 to 60 nm. This embodiment can also be used in the present invention, but for the purpose of forming a thin tabular grain, it is necessary that a small tabular nucleus as described in item (76) is formed, and the increase in the thickness of the nucleus is suppressed as far as possible and the edge side is grown. For that purpose, it is preferred that the nucleus is always grown in the maximum range of [(the growing speed of the edge side/the growing speed of the principal plane)]=A15 (from 60 to 100% of the maximum value, preferably from 80 to 100%, and more preferably from 90 to 100%). The maximum value can be obtained by growing the nucleus 0.1 μm or more at two to ten points during the growing process on various conditions to thereby obtain A15 value, and comparing the obtained values.

The growth include growth by ripening, growth by the addition of $Ag^+$ and $X^-$ salt solutions, and growth by the combination of both growth. As the growing conditions, the conditions are the combinations of temperature of from 0 to 80° C., pH of from 1 to 12, pBr of from 1 to 3, concentration of the dispersion medium of from 0.1 to 10 mass %, and when the dispersion medium is gelatin, Met group content of the gelatin of from 0 to 50 μmol/g, and His content of the gelatin of from 0 to 50 μmol/g, and addition rate of $Ag^+$ of from 0.1 to 50 nm/min in the growing speed of the grain, and preferably from 0.1 to 5 nm/min.

For forming a small nucleus, it is preferred to perform nucleation under the condition of solubility of AgX as low as possible (the conditions of the following a13)).

a13):

i) the temperature is preferably from 0 to 25° C., more preferably from 0 to 10° C., and still more preferably from 0 to 5° C., ii) at the same temperature, from the lowest solubility (A16) to 10×(A16) is preferred in the AgX solubility curve (the relationship between AgX solubility and $X^-$ concentration), more preferably from (A16) to 4×(A16), and most preferably from (A16) to 2×(A16), iii) nucleation can be performed at pH of from 1 to 11, but the pH is preferably from 1 to 9, and more preferably from 1 to 7, this is for the reason that an amino group works as an AgX solvent at high pH range when gelatin is used as the dispersion medium, iv) a water-soluble organic solvent (having the solubility of AgX of from 0.01 to 0.9 times as large as that of water), e.g., methanol and ethanol, is contained in an amount of from 1 to 90 mass %, preferably from 10 to 60 mass %. Regarding the solubility, the later-described literature 5 can be referred to.

Oxidation

For oxidizing the above-described reduced silver nuclei, Met groups and His groups, an oxidant is added to the emulsion. The examples of the oxidants for use in oxidation include i) inorganic oxidants, e.g., $H_2O_2$, ozone and adducts thereof (e.g., $NaBO_2 \cdot H_2O_2$), oxyacid salts (e.g., a peroxy acid group, a peroxy complex compound, permanganate, chromate), oxyacid (e.g., $HNO_3$, $H_2SO_4$), halogen elements (e.g., $Cl_2$, $Br_2$), perhalogenates, metal salts of high valency, and thiosulfonate, and ii) organic oxidants, e.g., quinones, organic peroxides, compounds releasing active halogen, organic thiosulfonate, and organic acids (e.g., formic acid).

The addition amount of oxidants is preferably from $10^{-8}$ to 1 mol/liter, and more preferably from $10^{-6}$ to 1 mol/liter. The more the addition amount of a compound and the larger the normal electrode potential, the higher is the oxidizing power of the compound. The pH of the solution at the time of oxidation is preferably from 0 to 11, and more preferably from 1 to 8. A compound having the most preferred oxidizing power can be used in the most preferred amount according to cases.

The oxidants having the normal electrode potential $E_0$ in the aqueous solution of from −0.2 to 3 V, preferably from 0.5 to 3 V, and more preferably from 1 to 2 V, are preferably used in the present invention, and the later-described literature 5, Chapter 12 and literature 14 can be referred to. The normal electrode potential $E_0$ shows the value with normal hydrogen electrode potential as 0.0 V. The electrode potential $E_1$ at the time when a Pt electrode is put in a solution at 25° C. is preferably from 0.2 to 3 V, and more preferably from 0.6 to 3 V.

The order of easiness of being reduced of silver ions is (AgI<AgBrI<AgBr<AgBrCl<AgCl<$Ag^+$). The higher the net charge a of ($Ag^+\alpha$ $X^-\alpha$), the more easily is received the electron (i.e., to be reduced) and the silver ion becomes Ag the more easily, and the formed silver nucleus is oxidized with difficulty.

More generally, when oxidant Ox, reacts with reducing agent $Red_1$, and the free energy change at the reaction [$Ox_1$+$Red_1$=$Ox_2$+$Red_2$] is taken as ΔG, the greater the value of (−ΔG=nFΔE), the greater is the driving force of the reaction, and so the reaction easily occurs. The greater the α of $Ag^+\alpha$, the more positive is the normal electrode potential $E^1$, and so the difference between the potential $E^1$ and the potential $E_2$ of the reducing agent, i.e., $\Delta E=(E_1-E_2)$, is greater, thus −ΔG becomes greater.

On the other hand, the reaction speed is in proportion to exp(−Ea/RT) (wherein Ea is an activated free energy ΔGa), which is approximated by Marcus equation (later-described literature 23 can be referred to). The shorter the approaching distance of $Ox_1$ and $Red_1$, the smaller is ΔGa, and so the reaction is accelerated.

Doping of Dopant to Fine Grains

It is preferred that a dopant has been added to $AgBr_0$ in advance in the embodiments described in items (51) to (57), and the $AgBr_0$ are added to seed crystal grains, to thereby dope the photographically useful dopant into the seed crystal grains. Further, it is also preferred to dope the dopant to $AgCl_0$ and $AgI_0$ in the embodiments described in items (51) to (57). Here, "photographically useful" indicates that the dopant is effective in the following points:

i) increase or decrease of sensitivity, ii) decrease of fog density, iii) improvement of reciprocity law characteristics, iv) increase or decrease of contrast, v) inhibition of pressure and Knick susceptibility (sensitization, desensitization, generation of fog), vi) improvement of photographic storage stability, and vii) increase of (maximum density/unit silver amount).

For doping a dopant into the fine grains, it is preferred to form the fine grains in the presence of a dopant in an amount of from $10^{-6}$ to 1 mol/liter. A dopant may be added to a dispersion medium solution at any time before adding fine grains into a seed crystal emulsion, it may be added before forming fine grains. All the amount of a dopant may be added at one time, alternatively it may be added over the period of 0.5 minutes or more. A dopant is preferably added over the period of 0.5 minutes or more after fine grains have been formed. The reason for this is that the formation of crystal defects can be inhibited by the doping.

The concentration of $X^-$ at doping [pX=−log ($X^-$ mol/liter)] is preferably from 1 to 5, and more preferably from 1.8 to 5.

1) Doping of Metal Atoms

The examples of metal ions include $Mn^{2+}$, $Ni^{2+}$, $Co^{2+}$, $Fe^{2+}$, $Cr^{3+}$, $V^{3+}$, $Co^{3+}$, $Mn^{4+}$, $Mo^{3+}$, $Rh^{3+}$, $Ru^{3+}$, $Pd^4$+, $Ir^{3+}$, $Pt^{4+}$, $Ru^{2+}$, $Os^{2+}$, and $In^{3+}$.

Metal ions may be added in the form of a metal salt or may be added in the form of a metal complex. The examples of the ligands of metal complex dopants include I_, Br_, $S^{2-}$, $SCN^-$, $SeCN^-$, Cl_, $NO_{3-}$, F_, OH, oxalate, $H_2O$, NCS_, $CH_3CN$, $NH_3$, EDTA, dipyridine, $NO_{2-}$, o-phenanthroline, phosphate, CN_, CO, NO, pyridine, pyrazine, thiazoles, 5-methylthiazole, and imidazole.

Regarding the specific examples of metal salts, relationships of ligands and metal complexes, the following compounds a13) and the later-described literature 1 and 16 can be referred to.

2) Thiosulfonyl Group-containing Compounds

Thiosulfonyl group-containing compounds oxidize the silver nuclei in an AgX emulsion to form silver sulfide, which is doped into grains in the following grain growing step, and so thiosulfonyl group-containing compounds can be said to have a function of an oxidant for silver nuclei and a function of a dopant for chalcogexide. To generalizing the thiosulfonyl group-containing compounds, they can be called chalcogenosulfonyl group-containing compounds. They can be represented by the following formulae, wherein Y represents a chalcogen-atom (S, Se, Te):

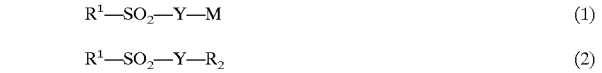

$$R^1—SO_2—Y—M \quad (1)$$

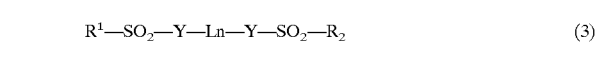

$$R^1—SO_2—Y—R_2 \quad (2)$$

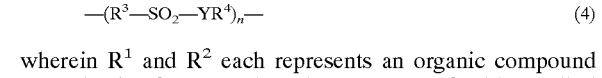

$$R^1—SO_2—Y—Ln—Y—SO_2—R_2 \quad (3)$$

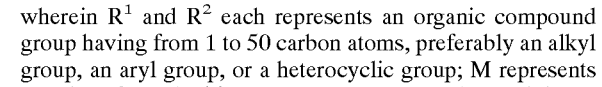

$$—(R^3—SO_2—YR^4)_n— \quad (4)$$

wherein $R^1$ and $R^2$ each represents an organic compound group having from 1 to 50 carbon atoms, preferably an alkyl group, an aryl group, or a heterocyclic group; M represents a cation; formula (4) represents a compound containing n groups of an $—(R^3—SO_2—Y—R^4)—$ group in one molecule; n is from 1 to $10_5$, which represents an average n number of the substance; and $R_3$ and $R^4$ each represents a divalent group of an organic compound having from 1 to 50 carbon atoms. Regarding the details of the compound, the later-described literature 16 can be referred to.

3) Doping of Chalcogen Atoms (S, Se, Te)

The examples of the dopants include a sulfur sensitizer, an Se sensitizer and a Te sensitizer. Regarding the details of the compound, the later-described literature 1 can be referred to.

These dopants are doped as chalcogenide metals. As the kinds of metals, the metal atoms described in item (52) can be used, specifically silver sulfide, gold sulfide, gold silver sulfide, and AgaAubZc are exemplified, wherein a, b and c each represents an average value of the aggregate and they can take every value of from 0.01 to 10, and Z represents a chalcogen atom.

4) Doping of Reduced Silver

When a reduced silver has been doped in fine grains, the reduced silver functions as a reduction sensitizer during seed crystal growth, thereby the seed crystal is reduction-sensitized. For doping a reduced silver, it is sufficient to make the atmosphere of a fine grain-forming solution a reducing atmosphere, i.e., it is preferred to make $E^1$ from 0 to 0.8 V, preferably from 0 to 0.5 V. Specifically, pH of the solution is made from 3 to 12, and preferably from 5 to 11, and a reducing agent having $E^0$ of from 0.8 to 2.5 V, preferably from 0.5 to −2 V, is present in an amount of from $10_{-8}$ to $10_{-1}$ mol/liter, preferably from $10^{-6}$ to $10_{-2}$ mol/liter.

In the next place, the silver halide grains finally formed in the present invention are described below. Silver halide grains obtained according to the present invention may be regular crystal grains such as cubic, octahedral, tetradecahedral or tetracosahedral grains, but preferably tabular grains. A tabular grain has parallel principal planes, and the principal planes may be {111} planes or may be {100} planes. The tabular grains have an average grain size (an equivalent-sphere diameter) of preferably from 0.1 to 5.0 μm, and particularly preferably from 0.2 to 3.0 μm. The tabular grain has a diameter of a circle having the same area as the projected area of a grain (an equivalent-circle diameter) of preferably from 0.3 to 30 μm, and particularly preferably from 0.5 to 10.0 μm. The thickness of the tabular grain is preferably 0.1 μm or less, and more preferably from 0.0001 to 0.05 μm or less. The diameter/thickness ratio of the tabular grain is preferably from 5 to 1,000, and particularly preferably from 10 to 300.

The grain size distribution in the present invention may be polydispersion or monodispersion, preferably-monodispersion.

The silver halide grain in the present invention may have a uniform structure or may have a so-called core/shell structure comprising a core part and a shell part surrounding the core part. Further, the silver halide grain may be a multi-phase structural grain comprising one or more phases having different halogen compositions between a core part and a shell part.

The halide composition of the emulsion obtained according to the present invention may be any of silver bromide, silver chloride, silver iodobromide, silver chlorobromide, silver chloroiodobromide and silver chloroiodide, and silver halide grains of microscopically uniform distribution can be obtained in any case. This is particularly conspicuous in the case of mixed crystals. However, since grains comprising a single silver halide composition, such as pure silver bromide or pure silver chloride, are also formed in the state not containing local silver excess region, uniform grains free of so called impurity, such as silver nuclei, can be obtained. In case of forming mixed crystals, fine grains for growth having silver halide composition corresponding to the objective silver halide composition are supplied.

When performing grain growth, fine grains for growth may be added at a constant velocity but they are preferably added at an accelerated velocity. The pH of a reaction vessel may be arbitrary but from neutral to acid region is preferred.

Ions or complex ions of metals belonging to group VIII of the Periodic Table, i.e., osmium, iridium, rhodium, platinum, ruthenium, palladium, cobalt, nickel and iron, can be used in the silver halide grains according to the present invention, alone or in combination of a plurality of kinds.

These metal ion-donating compounds can be incorporated into silver halide grains by adding them to a gelatin aqueous solution as a dispersion medium at silver halide grain formation, a halide aqueous solution, a silver salt aqueous solution, or other aqueous solutions, or by means of incorporating them in advance into a silver halide emulsion in the form of silver halide fine grains containing the metal ions and dissolving the emulsion. Further, metal ions can be incorporated into the grains before, during or immediately after grain formation, and the addition time can be changed depending upon where and how much amount the metal ions are added.

It is preferred in the present invention that 50 mol % or more, preferably 80 mol % or more, and more preferably 100 mol %, of the donating compound of the metal ion to be used is locally present in the surface layer corresponding to 50% or less of the grain volume from the surface of the silver halide grain. The volume of the surface layer is preferably 30% or less. To make a metal ion present locally in the surface layer of a silver halide grain is advantageous to suppress the increase of internal sensitivity and obtain high sensitivity. A metal ion-donating compound can be present locally in the surface layer of a silver halide grain by supplying the metal ion-donating compound conjointly with the addition of a silver salt aqueous solution and a halide aqueous solution for forming the surface layer after the silver halide grain of the part excluding a surface layer (core) has been formed.

Besides the metals belonging to group VIII, the silver halide emulsion for use in the present invention may contain various kinds of polyvalent metal ion impurities in the steps of grain formation and physical ripening. The addition amount of these compounds varies widely according to purposes but the amount is preferably from $10^{-9}$ to $10^{-2}$ mol per mol of the silver halide.

The silver halide emulsion for use in the present invention is generally chemically sensitized. As chemical sensitizing methods, gold sensitization by so-called gold compounds (e.g., U.S. Pat. Nos. 2,448,060 and 3,320,069), sensitization by metals, e.g., iridium, platinum, rhodium and palladium (e.g., U.S. Pat. Nos. 2,448,060, 2,566,245, and 2,566,263), sulfur sensitization by sulfur compounds (e.g., U.S. Pat. No. 2,222,264), selenium sensitization by selenium compounds, tellurium sensitization by tellurium compounds, and reduction sensitization by tin salts, thiourea dioxide, and polyamine (e.g., U.S. Pat. Nos. 2,487,850, 2,518,698 and 2,521,925) are exemplified. These sensitizing methods can be used alone or in combination.

The silver halide emulsions for use in the present invention are preferably emulsions subjected to gold sensitization known in the industry. The reason is that fluctuations in photographic performances can be further lessened-by being subjected to gold sensitization when the emulsions are scanning exposed by laser beams, etc. In gold sensitization, compounds, e.g., chloroauric acid or chloroaurate, gold thiocyanates and gold thiosulfates, can be used. The addition amount of these compounds varies by cases, but the amount is generally from $5\times10^{-7}$ to $5\times10^{-2}$ mol per mol of the silver halide, and preferably from $1\times10^{-6}$ to $1\times10^{-3}$ mol. These compounds are added until the termination of chemical sensitization.

It is also preferred in the present invention to perform gold sensitization in combination with other sensitization, e.g., sulfur sensitization, selenium sensitization, tellurium sensitization, reduction sensitization, or noble metal sensitization using compounds other than gold compounds.

present invention are preferably of the surface latent image type wherein the latent image is primarily formed on the surface.

For giving spectral sensitivity, e.g., green sensitivity and red sensitivity, to a light-sensitive silver halide for use in the present invention, a light-sensitive silver halide emulsion is spectrally sensitized with methine dyes and the like. Further, if necessary, a blue-sensitive emulsion may be spectrally sensitized in a blue region. The examples of the dyes include a cyanine dye, a merocyanine dye, a complex cyanine dye, a complex merocyanine dye, a holopolar cyanine dye, a hemicyanine dye, a styryl dye, and a hemioxonol dye. Specifically, the sensitizing dyes disclosed in U.S. Patent 4,617,257, JP-A-59-180550, JP-A-64-13546, JP-A-5-45828 and JP-A-5-45834 are exemplified.

These sensitizing dyes may be used alone or in combination, and combinations of sensitizing dyes are often used for the purpose of supersensitization or adjusting wavelength in spectral sensitization.

Dyes which themselves do not have a spectral sensitizing function or compounds which substantially do not absorb visible light but show supersensitization can be incorporated into an emulsion with sensitizing dyes (e.g., those disclosed in U.S. Pat. No. 3,615,641 and JP-A-63-23145).

Sensitizing dyes may be added to an emulsion at any stage, e.g., during, before or after chemical ripening, or they may be added before or after the nucleation of silver halide grains as disclosed in U.S. Pat. Nos. 4,183,756 and 4,225,666. These sensitizing dyes and supersensitizers may be added as a solution of an organic solvent, e.g., methanol, adispersion of gelatin and the like, orasolutionofa surfactant. The addition amount of them is in general from $10^{-8}$ to $10^{-2}$ mol or so per mol of the silver halide.

The photographic additives which can be used in the present invention are described in RD's and the locations related thereto are indicated in the following table.

| Type of Additives | RD 17643 (Dec., 1978) | RD 18716 (Nov., 1979) | RD 307105 (Nov., 1989) |
|---|---|---|---|
| 1. Chemical Sensitizers | page 23 | page 648, right column | page 866 |
| 2. Sensitivity Increasing Agents | — | page 648, right column | |
| 3. Spectral Sensitizers and Supersensitizers | pages 23–24 | page 648, right column to page 649, right column | pages 866–868 |
| 4. Brightening Agents | page 24 | page 647, right column | page 868 |
| 5. Light Absorbing Agents, Filter Dyes, and Ultraviolet Absorbing Agents | pages 25–26 | page 649, right column to page 650, left column | page 873 |
| 6. Binders | page 26 | page 651, left column | pages 873–874 |
| 7. Plasticizers and Lubricants | page 27 | page 650, right column | page 876 |
| 8. Coating Aids and Surfactants | pages 26–27 | page 650, right column | pages 875–876 |
| 9. Antistatic Agents | page 27 | page 650, right column | pages 876–877 |
| 10. Matting Agents | — | — | pages 878–87 |

The silver halide emulsion for use in the present invention may contain various compounds or precursors thereof for the purpose of preventing fog from generating or stabilizing photographic performances during the manufacturing process of photographic materials, during storage, or during photographic processing. The specific examples of these compounds which are preferably used are disclosed in JP-A-62-215272, pp. .39 to 72. The emulsions for use in the The silver halide emulsions in the present invention are protected from additional generation of fog by antifoggants, stabilizers and stabilizer precursors, and can be stabilized against the fluctuation in sensitivity during storage. The examples of appropriate antifoggants, stabilizers and stabilizer precursors which can be used alone or in combination include the thiazonium salts disclosed in U.S. Pat. Nos. 2,131,038 and 2,694,716, the azaindenes disclosed in U.S.

Pat. No. 2,886,437 and 2,444,605, the mercury salts disclosed in U.S. Pat. No. 2,728,663, the urazoles disclosed in U.S. Pat. No. 3,287,135, sulfocatechols disclosed in U.S. Pat. No. 3,235,652, the oximes, nitrons and nitroindazoles disclosed in British Patent 623,448, polyvalent metal salts disclosed in U.S. Pat. No. 2,839,405, the thiuroniums disclosed in U.S. Pat. No. 3,220,839, the palladium, platinum and gold salts disclosed in U.S. Pat. Nos. 2,566,263 and 2,597,915, the halogen-substituted organic compounds disclosed in U.S. Pat. Nos. 4,108,665and 4,442,202, the triazines disclosed in U.S. Pat. Nos. 4,128,557, 4,137,079, 4,138,365 and 4,459,350, and the phosphorus compounds disclosed in U.S. Pat. No. 4,411,985.

The antifoggants which are preferably used in the present invention are organic halogen compounds, e.g., the compounds disclosed in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809, U.S. Pat. Nos. 5,340,712, 5,369,000, and 5,464,737 are exemplified.

The antifoggants for use in the present invention can be added by any methods, e.g., as a solution, a powder, and a solid fine particle dispersion. Solid fine particle dispersions are produced by known pulverizing methods (e.g., using a ball mill, a vibrating ball mill, a sand mill, a colloid mill, a jet mill, a roller mill). A dispersing aid may be used for dispersing solid fine particles.

Photographic materials for use in the present invention may contain benzoic acids for the purpose of higher sensitization and preventing fogging. The benzoic acids for use in the present invention may be anybenzoic acid derivatives, and the preferred examples include the compounds disclosed in U.S. Pat. Nos. 4,784,939 and 4,152,160.

For the purpose of inhibiting or accelerating development to thereby control development, improving a spectral sensitizing effect, or improving storage stability before and after development of photographic materials, mercapto compounds, disulfide compounds and thione compounds may be used in the present invention.

Mercapto compounds having any structures can be used in the present invention, e.g., those represented by formulae Ar—SM and Ar—S—S—Ar are preferably used, wherein M represents a hydrogen atom or an alkali metal atom, and Ar represents an aromatic ring group or a condensed aromatic ring group having one or more nitrogen, oxygen, selenium or tellurium atoms. The preferred examples of heterocyclic aromatic rings include benzimidazole, naphthoimidazole, benzothiazole, naphthothiazole, benzoxazole, naphthooxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazoline. These heterocyclic aromatic rings may have a substituent selected from the group consisting of, e.g., halogen (e.g., Br and Cl), hydroxy, amino, carboxyl, alkyl (e.g., having 1 or more carbon atoms, preferably from 1 to 4), and alkoxyl (e.g., having 1 or more carbon atoms, preferably from 1 to 4). The examples of mercapto-substituted heterocyclic aromatic compounds include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis-benzothiazole, 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazoline, 7-trifluoromethyl-4-quinonethiol, 2,3,5,6-tetrachloro-4-pyridinethiol, 4-amino-6-hydroxy-2-mercaptopyrimidinemonohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidinehydrochloride, 3-mercapto-5-phenyl-1,2,4-triazole, and 2-mercapto-4-phenyloxazole, but the present is not limited thereto. The addition amount of these mercapto compounds to an emulsion layer is preferably from 0.001 to 1.0 mol per mol of the light-sensitive silver halide, more preferably from 0.01 to 0.3 mol.

It is also preferred to use a silver halide solvent in photographic materials according to the present invention. The examples of silver halide solvent which are preferably used in the present invention include, e.g., thiosulfate, sulfite, thiocyanate, the thioether compounds disclosed in JP-B-47-11386, the compounds having a 5- or 6-membered imido group, e.g., uracil and hydantoin disclosed in JP-A-8-179458, the compounds having a double bond of carbon-sulfur disclosed in JP-A-53-144319, and the meso-ionic thiolate compounds, e.g., trimethyltriazolium thiolate disclosed in *Analytica Chimica Acta*, Vol. 248, pp. 604 to 614 (1991). The compounds disclosed in JP-A-8-69097 which can fix and stabilize silver halide can also be used as a silver halide solvent.

The amount of a silver halide solvent which can be contained in a photographicmaterial is from 0.01 to 100 mmol/$m^2$, preferably from 0.1 to 50 mmol/$m^2$, and more preferably from 10 to 50 mmol/$m^2$. The amount of a silver halide solvent in a molar ratio to the coating silver amount of the light-sensitive silver halide in a photographic material is from 1/20 to 20 times, preferably from 1/10 to 10 times, and more preferably from 1/3 to 3 times. A silver halide solvent may be added to a solvent, e.g., water, methanol, ethanol, acetone, dimethylformamide, or methyl propyl glycol, or an alkali or acid aqueous solution, or may be added to a coating solution as a solid fine particle dispersion. A silver halide solvent may be used alone or a plurality of silver halide solvents may be used in combination.

The photographic material according to the present invention contains a dye-forming coupler.

The examples of the couplers which can be preferably used in the present invention include compounds which are generally called active methylene, 5-pyrazolone, pyrazoloazole, phenol, naphthol, pyrrolotriazole. The compounds cited in RD, No. 38957, pp. 616to624, "X. Dye imageformersandmodifiers" (Sep., 1996) can be preferably used as such couplers. These couplers can be classified into 2-equivalent couplers and 4-equivalent couplers.

As the groups which function as an anionic releasing group of 2-equivalent couplers, a halogen atom (e.g., a chlorine atom and a bromine atom), an alkoxyl group (e.g., methoxy and ethoxy), an aryloxy group (e.g., phenoxy, 4-cyanophenoxy and 4-alkoxycarbonylphenyl) ,analkylthiogroup (e.g., methylthio, ethylthio and butylthio), an arylthio group (e.g., phenylthio and tolylthio), an alkylcarbamoyl group (e.g., methylcarbamoyl, dimethylcarbamoyl, ethylcarbamoyl, diethylcarbamoyl and dibutylcarbamoyl), a heterocyclic carbamoyl group (e.g., piperidylcarbamoyl and morpholylcarbamoyl), an arylcarbamoyl group (e.g., phenylcarbamoyl, methylphenylcarbamoyl, ethylphenylcarbamoyl and benzylphenylcarbamoyl), a carbamoyl group, an alkylsulfamoyl group (e.g., methylsulfamoyl, dimethylsulfamoyl, ethylsulfamoyl, diethylsulfamoyl, and dibutylsulfamoyl), a heterocyclic sulfamoyl group (e.g., piperidylsulfamoyl and morpholylsulfamoyl), an arylsulfamoyl group (e.g., phenylsulfamoyl, methylphenylsulfamoyl, ethylphenylsulfamoyl, and benzylphenylsulfamoyl), a sulfamoyl group, a cyano group, an alkylsulfonyl group (e.g., methanesulfonyl and ethanesulfonyl), an arylsulfonyl group (e.g., phenylsulfonyl, 4-chlorophenylsulfonyl, and p-toluenesulfonyl) , an alkylcarbonyloxy group (e.g., acetyloxy, propionyloxy and butyroyloxy), an arylcarbonyloxy group (e.g., benzoyloxy, toluyloxyandanisyloxy) , and a nitrogen-containing heterocyclic group (e.g., imidazole and benzotriazole) are exemplified.

As the groups which function as a cationic releasing group of 4-equivalent couplers, a hydrogen atom, a formyl group, a carbamoyl group, a methylene group having a substituent (as the substituents, an aryl group, a sulfamoyl group, a carbamoyl group, an alkoxyl group, an amino group, and a hydroxyl group are exemplified), an acyl group, and a sulfonyl group are exemplified. In addition to the compounds described in RD, No. 38957, the following couplers can be preferably used.

The examples of active methylene couplers include the. couplers represented by formula (I) or (II) in EP-A-502424; the couplers represented by formula (I) or (2) in EP-A-513496; the coupler represented by formula (I) in claim 1 in EP-A-568037; the coupler represented by formula (I) 11. 45 to 55, column 1 in U.S. Pat. No. 5,066,576; the coupler represented by formula (I) in paragraph [0008] in JP-A-4-274425; the coupler disclosed in claim 1, p. 40 in EP-A-498381; the coupler represented by formula (Y), p. 4 in EP-A-447969; and the couplers represented by formula (II), (III) or (IV), 11. 36 to 58, column 7 in U.S. Pat. No. 4,476,219.

The examples of preferred 5-pyrazolone couplers include the compounds disclosed in JP-A-57-35858 and JP-A-51-20826.

The examples of preferred pyrazoloazole couplers include imidazo[1,2-b]pyrazoles disclosed in U.S. Pat. No. 4,500,630, pyrazolo[1,5-b] [1,2,4]triazoles disclosed in U.S. Pat. No. 4,540,654, and pyrazolo[5,1-c] [1,2,4] triazoles disclosed in U.S. Pat. No. 3,725,067. Of these, pyrazolo[1,5-b] [1,2,4]triazoles are preferred for the light fastness. Further, the following pyrazoloazole couplers can also be preferably used in the present invention, i.e., the pyrazoloazole couplers wherein a branched alkyl group is directly bonded to the 2-, 3- or 6-position of the pyrazolotriazole group disclosed in JP-A-61-65245, the pyrazoloazole couplers containing a sulfonamido group in the molecule disclosed in JP-A-61-65245, the pyrazoloazole couplers having an alkoxyphenylsulfonamido ballast group disclosed in JP-A-61-147254, the pyrazolotriazole couplers having an alkoxyl group and an aryloxy group at the 6-position disclosed in JP-A-62-209457 or JP-A-63-307453, and the pyrazolotriazole couplers having a carbonamido group in the molecule disclosed in JP-A-2-201443.

The preferred examples of phenol couplers include 2-alkylamino-5-alkylphenol couplers disclosed in U.S. Pat. Nos. 2,369,929, 2,801,171, 2,772,162, 2,895,826 and 3,772,002, 2,5-diacylaminophenol couplers disclosed in U.S. Pat. Nos. 2,772,162, 3,758,308, 4,126,396, 4,334,011, 4,327,173, West German Patent Laid-Open 3,329,729, and JP-A-59-166956, and 2-phenylureido-5-acylaminophenol couplers disclosed in U.S. Pat. Nos. 3,446,622, 4,333,999, 4,451,559 and 4,427,767.

The preferred examples of naphthol couplers include 2-carbamoyl-1-naphthol couplers disclosed in U.S. Pat. Nos. 2,474,293, 4,052,212, 4,146,396, 4,228,233 and 4,296,200, and 2-carbamoyl-5-amido-1-naphthol couplers disclosed in U.S. Pat. No. 4,690,889.

The preferred examples of pyrrolotriazole couplers include the couplers disclosed in EP-A-488248, EP-A-491197 and EP 545300. In addition, couplers having the structures of condensed phenol, imidazole, pyrrole, 3-hydroxypyridine, active methine, 5,5-condensed heterocyclic ring and 5,6-condensed heterocyclic ring can be used. As the condensed phenol couplers, the couplers disclosed in U.S. Pat. Nos. 4,327,173, 4,564,586 and 4,904,575 can be used.

As the imidazole couplers, the couplers disclosed in U.S. Pat. Nos. 4,818,672and 5,051,347can be used. As the pyrrole couplers, the couplers disclosed in JP-A-4-188137 and JP-A-4-190347 can be used. As the 3-hydroxypyridine couplers, the couplers disclosed in JP-A-1-315736 can be used. As the active methine couplers, the couplers disclosed in U.S. Pat. Nos. 5,104,783 and 5,162,196 can be used.

As the 5,5-condensed heterocyclic couplers, the pyrrolopyrazole couplers disclosed in U.S. Pat. No. 5,164,289, and the pyrroloimidazole couplers disclosed in JP-A-4-174429 can be used. As the 5,6-condensed heterocyclic couplers, the pyrazolopyrimidine couplers disclosed in U.S. Pat. No. 4,950,585, the pyrrolotriazine couplers disclosed in JP-A-4-204730, and the couplers disclosed in EP 556700 can be used.

In addition to the above-described couplers, the couplers disclosed in West German Patent-A-3,819,051, West German Patent 3,823,049, U.S. Pat. Nos. 4,840,883, 5,024,930, 5,051,347, 4,481,268, EP-A-304856, EP 329036, EP-A-354549, EP-A-374781, EP-A-379110, EP-A-386930, JP-A-63-141055, JP-A-64-32260, JP-A-64-32261, JP-A-2-297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731 and JP-A-4-204732 can also be used in the present invention. They are used in an amount of from 0.05 to 10 mmol/$m^2$, preferably from 0.1 to 5 mmol/$m^2$ as to each color.

The photographic materials in the present invention may contain the functional couplers as described below.

Couplers the Colored Dyes of Which Have an Appropriate Diffusibility:

The couplers disclosed in U.S. Pat. No. 4,366,237, British Patent 2,125,570, EP-B-96873 and German Patent 3,234,533 are preferred as couplers the colored dyes of which have an appropriate diffusibility.

Couplers for Correcting the Unnecessary Absorption of Colored Dres:

The examples of preferred couplers for correcting the unnecessary absorption of colored dyes include the yellow colored cyan couplers represented by formula (CI), (CII), (CIII) or (CIV) disclosed on page 5 in EP-A-456257 (in particular, YC-86 on page 84); the yellow colored magenta couplers ExM-7 (p. 202), EX-1 (p. 249), and EX-7 (p. 251) disclosed in EP-A-456257; the magenta colored cyan couplers CC-9 (column 8) and CC-13 (column 10) disclosed in U.S. Pat. No. 4,833,069; the coupler (2) (column 8) disclosed in U.S. Pat. No. 4,837,136; and the colorless masking couplers represented by formula (A) disclosed in claim 1 in WO 92/11575 (in particular, the exemplified compounds disclosed on pp. 36 to 45).

The examples of compounds (inclusive of couplers) which release photographically useful residual groups of compounds upon reacting with the oxidation product of a developing agent include the following:

Development Inhibitor-releasing Compounds:

the compounds represented by formula (I), (II), (III) or (IV) disclosed on page 11 in EP-A-378236 (in particular, T-101 (p. 30), T-104 (p. 31), T-113 (p. 36), T-131 (p. 45), T-144 (p. 51) and T-158 (p. 58);

the compounds represented by formula (I) disclosed on page 7 in EP-A-436938 (in particular, D-49 (p. 51));

the compounds represented by formula (I) disclosed in EP-A-568037 (in particular, compound (23) (p. 11); and the compounds represented by formula (I), (II) or (III) disclosed on pages 5 and 6 in EP-A-440195 (in particular, I-(1) on p. 29);

B1 eaching Accelerator-releasing Compounds:

the compounds represented by formula (I) or (I') disclosed on page 5 in EP-A-310125 (in particular, compounds (60) and (61) on p. 61); and the compounds represented by formula (I) disclosed in claim 1 in JP-A-6-59411 (particularly compound (7) on p. 7);

Ligand-releasing Compounds:

the compounds represented by LIG-X disclosed in claim 1 in U.S. Pat. No. 4,555,478 (in particular, the compounds in 11. 21 to 41, column 12);

Leuco Dye-releasing Compounds:

compounds 1 to 6, columns 3 to 8 disclosed in U.S. Pat. No. 4,749,641;

Fluorescent Dye-releasing Compounds:

the compounds represented by COUP-DYE disclosed in claim 1 in U.S. Pat. No. 4,774,181 (in particular, compounds 1 to 11, columns 7.to 10);

Development Accelerator Releasing- or Fogging Agent-releasing Compounds:

the compounds represented by formula (1), (2) or (3), column 3 in U.S. Pat. No. 4,656,123 (in particular, (I-22) column 25); and compound ExZK-2, 11. 36 to 38, p. 75 in EP-A-450637; and Compounds which Release Dyes the Color of which is Restored After Elimination:

the compounds represented by formula (I) disclosed in claim 1 in U.S. Pat. No. 4,857,447 (in particular, Y-1 to Y-19, columns 25 to 36).

Preferred additives other than couplers are listed below:

Dispersion Media of Oil-soluble Organic Compound:

P-3, P-5, P-16, P-19, P-25, P-30, P-42, P-49, P-54, P-55, P-66, P-81, P-85, P-86 and P-93 (pp. 140 to 144) in JP-A-62-215272;

Latexes for Impregnation of Oil-soluble Organic Compound:

the latexes disclosed in U.S. Pat. No. 4,199,363;

Scavengers for the Oxidation Product of a Developing Agent:

the compounds represented by formula (I), 11. 54 to 62, column 2 in U.S. Pat. No. 4,978,606 (in particular, I-(1), I-(2), I-(6) and I-(12), columns 4 and 5), and the compounds represented by the formula disclosed in 11. 5 to 10, column 2 in U.S. Pat. No. 4,923,787 (in particular, compound 1, column 3);

Stain Inhibitors:

the compounds represented by formula (I) , (II) or (III) , 11. 30 to 33, p. 4 in EP-A-298321 (in particular, I-47, I-72, III-1 and III-27, pp. 24 to 48);

Discoloration Inhibitors:

A-6, A-7, A-20, A-21, A-23, A-24, A-25, A-26, A-30, A-37, A-40, A-42, A-48, A-63, A-90, A-92, A-94 and A-164 (pp. 69 to 118) disclosed in EP-A-298321, II-1 to III-23, columns 25 to38 in U.S. Pat. No. 5,122,444 (in particular, 111-10), I-1 to II1-4, pp. 8 to 12 in EP-A-471347 (in particular, 10-2), and A-1 to A-48, columns 32 to 40 in U.S. Pat. No. 5,13 9,931 (in particular, A-39 and A-42);

Compounds for Reducing the Using Amounts of Color Intensifiers and Color Mixing Preventives:

I-1 to 33-15, p p. 5 to 24 in EP-A-41132 (in particular, 1-46);

Formaldehyde Scavengers:

SCV-1 to SCV-28, pp. 24 to 29 in EP-A-477932 (in particular, SCV-8);

Hardening Agents:

H-1, H-4, H-6, H-8 and H-14 on p.17 in JP-A-i-214845, the compounds represented by any of formulae (VII) to (XII), columns 1 3 to 23 in U.S. Pat. No. 4,618,573 (H-1 to H-54), the compounds represented by formula (6) right lower column, p. 8 in JP-A-2-214852 (H-1 to H-76) (in particular, H-14), and the compounds in claim 1 in U.S. Pat. No. 3,325,287;

Development Inhibitor Precursors:

P-24, P-37 and P-39, pp. 6 and 7 in JP-A-62-168139, and the compounds disclosed in claim 1 in U.S. Pat. No. 5,019,492 (in particular, compounds 28 and 29, column 7);

Antiseptics and Antifungal Agents:

I-1 to III-43, columns 3 to, 15 in U.S. Pat. No. 4, 923,790 (in particular, II-1, II-9, II-10, II-18 and III-25);

Stabilizers and Antifoggants:

I-1 to (14), columms 6 to 16 in U.S. Pat. No. 4 ,923,793 (in particular, I-1, 60, (2) and (13)); and compounds 1 to 65, columns 25 to 32 in U.S. Pat. No. 4,952,483 (in particular, compound 36);

Chemical Sensitizers:

triphenylphosphine selenide, and compound 50 disclosed in JP-A-5-40 324;

Dyes:

a-1 to b-20, pp. 15 to 18 disclosed in JP-A-3-156450 (in particular, a-1, a-12, a-18, a-27, a-35, a-36, and b-5), and V-1 to V-23, pp. 27 to 29 (in particular, V-1), F-I-1 to F-II-43, pp. 33 to 55 in EP-A-445627 (in particular, F-I-11 and F-II-8), III-1 to III-36, pp. 17 to 28 in EP-A-457153 (in particular, III-1 and III-3), crystallite dispersions of Dye-1 to Dye-124, pp. 8 to 26 in WO 88/04794, compounds 1 to 22, pp. 6 to 11 in EP-A-319999 (in particular, compound 1), compounds D-1 to D-87 represented by any of formulae (1) to (3), pp. 3 to 28 in EP-A-519306, compounds 1 to 22 represented by formula (I), columns 3 to 10 in U.S. Pat. No. 4,268,622, and compounds (1) to (31) represented by formula (I), columns 2 to 9 in U.S. Pat. No. 4,923,788;

Ultraviolet Absorbing Agents:

compounds (18b) to (18r) represented by formula (1), 101 to 427, pp. 6 to 9 in JP-A-46-3335, compounds (3) to (66) represented by formula (I), pp. 10 to 44, and compounds HBT-1 to HBT-10 represented by formula (III), p. 14 in EP-A-520938, and compounds (1) to (31) represented by formula (1), columns 2 to 9 in EP-A-521823.

It is preferred that these functional couplers and additives are used in an amount of 0.05 to 10 times the mol of the above couplers contributing to coloring, preferably from 0.1 to 5 times.

Hydrophobic additives such as couplers and color developing agents can be added to a light-sensitive layer according to well-known methods as disclosed, e.g., in U.S. Pat. No. 2,322,027. In this case, if necessary, the high boiling point organic solvents as disclosed in U.S. Pat. Nos. 4,555,470, 4,536,466, 4,536,467, 4,587,206, 4,555,476, 4,599,296 and JP-B-3-62256 can be used in combination with low boiling point organic solvents having a boiling point of from 50 to 160° C. These dye-forming couplers and high boiling point organic solvents can be used in combination of two or more kinds.

The amount of high boiling point organic solvents is 10 g or less per 1 g of the hydrophobic additives to be used, preferably 5 g or less, and more preferably from 1 to 0.1 g. Further, the amount is 1 ml or less per 1 g of the binder, preferably 0.5 ml or less, and particularly preferably 0.3 ml or less.

These compounds can also be added to photographic materials as polymer dispersions according to the methods as disclosed in JP-B-51-39853 and JP-A-51-59943, and as fine particle dispersions as disclosed in JP-A-62-30242.

In the case where compounds are substantially water-insoluble, they can be added as fine particle dispersions to a binder as well as the above methods.

When hydrophobic compounds are dispersed in a hydrophilic colloid, various kinds of surfactants can be used. For example, the surfactants exemplified in JP-A-59-157636, pp. 37 and 38 and the above RD can be used. The phosphate type surfactants disclosed in JP-A-7-56267 and JP-A-7-228589, and West German Patent-A-1,932,299 can also be used.

Various antifoggants and photographic stabilizers can be used in the photographic material according to the present invention. For example, the azoles and azaindenes described in RD, No. 17643, pp. 24 and 25 (1978), the nitrogen-containing carboxylic acids and phosphoric acids disclosed in JP-A-59-168442, the mercapto compounds and the salts thereof disclosed in JP-A-59-111636, and the acetylene compounds disclosed in JP-A-62-87957 can be used.

When a diffusion resisting reducing agent or a color developing agent is used, if necessary, an electron transfer agent and/or an electron transfer agent precursor can be used in combination in a photographic material in the present invention for accelerating electron transfer between the diffusion resisting reducing agent or color developing agent and developable silver halide. It is preferred the electron. transfer agent and/or the electron transfer agent precursor should have greater transferability than that of the diffusion resisting reducing agent (an electron donor). Particularly useful electron transfer agents are 1-phenyl-3-pyrazolidones and aminophenols.

The light-sensitive material in the present invention can comprise at least one light-sensitive layer on a support. In a typical embodiment, the silver halide photographic material according to the present invention comprises at least one light-sensitive layer consisting of a plurality of silver halide emulsion layers having substantially the same spectral sensitivity but different degrees of light sensitivity on a support. The light-sensitive layer is a unit light-sensitive layer having a spectral sensitivity to any of blue light, green light and red light. In the multilayer silver halide color photographic material, the unit light-sensitive layers are generally arranged in the order of a red-sensitive layer, a green-sensitive layer and a blue-sensitive layer from the support side. However, the order of arrangement can be reversed depending on the purpose, alternatively, the unit light-sensitive layers may be arranged in such a way that a layer having a different spectral sensitivity is interposed between layers having the same spectral sensitivity. Light-insensitive layers may be provided between the above-described silver halide light-sensitive layers, and on the uppermost layer and beneath the lowermost layer of the silver halide light-sensitive layers. These light-insensitive layers may contain the above-described couplers, developing agents, DIR compounds, color mixing preventives and dyes. As the plurality of silver halide emulsion layers constituting each unit light-sensitive layer, a two-layer structure of a high-speed emulsion layer and a low-speed emulsion layer can be preferably used with the emulsion layers being arranged so as to decrease in sensitivity toward a support in turn as disclosed in German Patent 1,121,470 and British Patent 923,045. A light-insensitive layers maybe provided between these silver halide emulsion layers. In addition, a low-speed emulsion layer may be provided farther from the support and a high-speed emulsion layer may be provided nearer to the support as disclosed in JP-A-57-112751, JP-A-62-200350, JP-A-62-206541 and JP-A-62-206543.

In one specific example, a low-speed blue-sensitive layer (BL)/a high-speed blue-sensitive layer (BH)/a high-speed green-sensitive layer (GH)/a low-speed green-sensitive layer (GL)/a high-speed red-sensitive layer (RH)/a low-speed red-sensitive layer (RL), or BH/BL/GL/GH/RH/RL, or BH/BL/GH/GL/RL/RH can be arranged in this order from the side farthest from the support. A blue-sensitive layer/GH/RH/GL/RL can be arranged in this order from the side farthest from the support as disclosed in JP-B-55-34932. Further, a blue-sensitive. layer/GL/RL/GH/RH can be arranged in this order from the side farthest from the support as disclosed in JP-A-56-25738 and JP-A-62-63936.

Further, useful arrangements include the arrangement in which there are three layers having different degrees of sensitivities with the sensitivity being lower towards the support such that the uppermost layer is a silver halide emulsion layer having the highest sensitivity, the middle layer is a silver halide emulsion layer having a lower sensitivity than that of the uppermost layer, and the lowermost layer is a silver halide emulsion layer having a lower sensitivity than that of the middle layer, as disclosed in JP-B-49-15495. In the case of the structure of this type comprising three layers having different degrees of sensitivity, the layers in the unit layer of the same spectral sensitivity may be arranged in the order of a medium-speed emulsion layer/a high-speed emulsion layer/a low-speed emulsion layer, from the side farthest from the support, as disclosed in JP-A-59-202464. Alternatively, the layers can be arranged in the order of a high-speed emulsion layer/a low-speed emulsion layer/a medium-speed emulsion layer, or a low-speed emulsion layer/a medium-speed emulsion layer/a high-speed emulsion layer. Moreover, the arrangement may be varied as indicated above in the case where there are four or more layers.

For improving color reproducibility, a donor layer (CL) for an interlayer effect having different spectral sensitivity distribution from a main light-sensitive layer such as BL, GL and RL may preferably be provided contiguously or closely to the main light-sensitive layer, as disclosed in U.S. Pat. Nos. 4,663,271, 4,705,744,4,707,436, JP-A-62-160448 and JP-A-63-89850.

As described above, various layer constitutions and arrangements can be selected according to various purposes of photographic materials.

A silver halide emulsion, a dye-forming coupler and a color developing agent and/or a precursor thereof may be contained in the same layer, but they can be added to different layers separately so long as they can react upon each other. For example, the shelf life of a photographic material is improved when a layer containing a color developing agent is independent of a layer containing a silver halide emulsion.

Spectral sensitivity of each layer and the relationship of hues of couplers are arbitrary, but when a cyan coupler is used in a red-sensitive layer, a magenta coupler is used in a green-sensitive layer, and a yellow coupler is used in a blue-sensitive layer, the photographic material can be used in direct projection exposure for conventional color papers. Various kinds of light-insensitive layers, e.g., a protective layer, an undercoating layer, an intermediate layer, a yellow filter layer, and an antihalation layer, may be provided between the above-described silver halide light-sensitive layers, and on the uppermost layer and beneath the lowermost layer of the silver halide light-sensitive layers of photographic materials. Further, a variety of auxiliary layers, e.g., a backing layer, can be provided on the side of the support opposite to the side on which the silver halide emulsion layers are provided.

Specifically, the layers disclosed in the above patents, the undercoating layers as disclosed in U.S. Pat. No. 5,051,335, the intermediate layers containing a solid pigment as disclosed in JP-A-1-167838 and JP-A-61-20943, the intermediate layers containing a reducing agent or a DIR compound as disclosed in JP-A-1-120553, JP-A-5-34884 and JP-A-2-64634, the intermediate layers containing an electron transfer agent as disclosed in U.S. Pat. Nos. 5,017,454, 5,139,919and JP-A-2-235044, and the protective layers containing a reducing agent as disclosed in JP-A-4-249245 can be provided, or these layers can be provided in combination with each other. As the dyes which can be used in a yellow filter layer and an antihalation layer, dyes which are decolored or eliminated on development and do not contribute to the density after processing are preferably used. The terminology "a dye in a yellow filter layer and an antihalation layer is decolored or eliminated on development" means that the amount of the dye which remains after processing is ⅓ or less of the amount at coating, preferably 1/10 or less. The ingredients of the dye may be transferred from the photographic material to the processing material or the ingredients maybe changed to a colorless compound by reaction on development.

Specifically, the dyes disclosed in EP-A-549489 and the dyes ExF2 to ExF6 disclosed in JP-A-7-152129 can be exemplified as such dyes. The dispersed solid dyes disclosed in JP-A-8-101487 can also be used. A dye can be mordanted in a mordant and a binder. In this case, mordants and dyes well-known in the photographic field can be used, e.g., the mordants disclosed in U.S. Pat. No. 4,500,626, columns 58 and 59, JP-A-61-88256, pp. 32 to 41, JP-A-62-244043 and JP-A-62-244036 can be exemplified.

It is also possible to use a reducing agent and a compound which releases a diffusible dye by reaction with a reducing agent to release a movable dye by the alkali at development,. to thereby transfer the dye to a processing material and eliminate. These techniques are disclosed in U.S. Pat. Nos. 4,559,290, 4,783,396, EP-A-220746, Kokai Giho 87-6119.

Leuco dyes which are decolored can also be used, and silver halide photographic materials containing leuco dyes which have been colored in advance by developers of organic acid metal salts are specifically disclosed in JP-A-1-150132. Leuco dyes are decolored by reaction with developer complexes by heat or an alkali agent.

Well-known leuco dyes can be used in the present invention, e.g., Moriga, Yoshida, *Senryo to Yakuhin (Dyes and Chemicals)*, No. 9, p. 84, Kaseihin Kogyo Kyokai, *Shinpan Senryo Binran (New Edition Dye Handbook)*, p. 242, Maruzen Co., Ltd. (1970), R. Garner *Reports on the Progress of Appl. Chem.*, No. 56, p. 199 (1971), *Senryo to Yakuhin (Dyes and Chemicals)*, No. 19, p.230, Kaseihin KogyoKyokai (1974), *Shikizai (Coloring Materials)*, No. 62, p. 288 (1989), and *Senshoku Kogyo (Dyeing Industry)*, No. 32, p. 208 can be referred to. As developers, organic acid metal salts are preferably used as well as acid clay developers, phenol-formaldehyde resins. The examples of organic acid metal salts include metal salts of salicylic acids, metal salts of phenol-salicylic acid-formaldehyde resins, and metal salts of rhodanate and xanthogenate, and zinc is particularly preferred as the metal. Of the above developers, regarding oil-soluble zinc salicylates, those disclosed in U.S. Pat. Nos. 3,864,146, 4,046,941 and JP-B-52-1327 can be used.

The coated layer of the photographic material in the present invention is preferably hardened with a hardening agent. The hardening agents disclosed in column 41 in U.S. Pat. Nos. 4,678,739, 4,791,042, JP-A-59-116655, JP-A-62-245261, JP-A-61-18942, and JP-A-4-218044 are used in the present invention. More specifically, aldehyde-based hardening agents (formaldehyde), aziridine-based hardening agents, epoxy-based hardening agents, vinylsulfone-based hardening agents (N,N'-ethylene-bis (vinylsulfonylacetamide)ethane), N-methylol-based hardening agents (dimethylolurea) ,boric acid, metaboric acid, and high polymer hardening agents (e.g., the compounds disclosed in JP-A-62-23415) are exemplified. These hardening agents are used in an amount of from 0.001 to 1 g per gram of the hydrophilic binder, preferably from 0.005 to 0.5 g.

Various antifoggants or photographic stabilizers and precursors thereof can be used in photographic materials in the present invention. The compounds described in the above RD, U.S. Pat. Nos. 5,089,378, 4,500,627, 4,614,702, JP-A-64-13564, pp. 7 to 9, 57 to 71 and 81 to 97, U.S. Pat. Nos. 4,775,610, 4,626,500, 4,983,494, JP-A-62-174747, JP-A-62-239148, JP-A-1-150135, JP-A-2-110557, JP-A-2-178650, and RD, No.17643, pp. 24 and 25 (1978) are exemplified as the specific examples. The addition amount of these compounds is from $5\times10^{-6}$ to $1\times10^{-1}$ mol per mol of the silver, and more preferably from $1\times10^{-5}$ to $1\times10^{-2}$ mol.

The photographic materials in the present invention can use surfactants for various purposes, e.g., for assisting coating, for improving separation, for improving a sliding property, for preventing static charge, for accelerating development, etc. The specific examples of surfactants are described in *Kochi Gijutsu (Known Techniques)*, No. 5, pp. 136 to 138 (Mar. 22, 1991) published by Aztec Co., Ltd., JP-A-62-173463 and JP-A-62-183457.

The photographic materials in the present invention may contain organofluoro compounds for the purpose of preventing a sliding property, preventing static charge, and improving separation. The representative examples of organofluoro compounds include hydrophobic fluoro compounds, e.g., oily fluoro compounds, such as fluorine surfactants and fluoro oils, and solid state fluorine compound resins, such as ethylene tetrafluoride resins disclosed in columns 8 to 17 in JP-B-57-9053, JP-A-61-20944, and JP-A-62-135826. For the purpose of compatibility of wettability and antistatic property of photographic materials, fluorine surfactants having a hydrophilic group can also be preferably used.

It is preferred for the photographic material in the present invention to have a sliding property. A layer containing a sliding agent is preferably provided on both sides of light-sensitive layer surface and backing layer surface. A preferred sliding property is a dynamic friction coefficient of from 0.25 to 0.01. The sliding property is measured by using a stainless steel ball having a diameter of 5 mm at a transporting speed of 60 cm/min (25° C., 60% RH). In this evaluation, when the opposite material is replaced with a light-sensitive layer surface, almost the same level of a value can be obtained.

The examples of the sliding agents which can be used in the present invention include polyorganosiloxane, higher fatty acid amide, higher fatty acid metal salt, higher fatty acid and higher alcohol ester. As polyorganosiloxane, polydimethylsiloxane, polydiethylsiloxane, polystyrylmethylsiloxane, and polymethylphenylsiloxane can be used. Sliding agents are preferably added to the outermost layer of emulsion layers or a backing layer. Polydimethylsiloxane and esters having a long chain alkyl group are particularly preferred. Silicone oils and paraffin chloride are preferably used for preventing stress marks and desensitization.

Further, antistatic agents are preferably used in the present invention. The examples of antistatic agents include high polymers containing carboxylic acid, carboxylate, and sulfonate, cationic high polymers, and ionic surfactant compounds. The most preferred antistatic agents are fine particles of a crystal line metal licoxide of at least one particle selected from ZnO, $TiO_2$, $SnO_2$, $Al_2O_3$, $In_2O_3$, $SiO_2$, MgO, BaO, $MoO_3$ and $V_2O_5$ having a volume resistivity of preferably $10^7\Omega\cdot$cm or less, more preferably $10^5\Omega\cdot$cm or less and having a particle size of from 0.001 to 1.0 $\mu$m, or fine particles of composite oxides of them (Sb, P, B, In, S, Si, C), further, fine particles of a metallic oxide in the form of sol or fine particles of these composite oxides. The addition amount of these antistatic agents to a photographic material is preferably from 5 to 500 mg/$M^2$ and particularly preferably from 10 to 350 mg/$M^2$. The ratio of the conductive crystalline oxides or composite oxides thereof to a binder is preferably from 1/300 to 100/1 and more preferably from 1/100 to 100/5. It is also preferred to coat waterproof polymers as disclosed in JP-A-8-292514 on the back surface of the support of a photographic material.

Various kinds of polymer latexes can be used in a photographic material and the later-described processing materials (including a backing layer) for the purpose of the improvement of physical properties of films, such as dimensional stability, curling prevention, adhesion prevention, prevention of cracking of films, and prevention of pressure sensitization and desensitization. Specifically, any polymer latexes disclosed in JP-A-62-245258, JP-A-62-136648 and JP-A-62-110066 can be used. In particular, when polymer latexes having a low glass transition point (40° C. or less) are used in a mordant layer, cracking of the mordant layer can be prevented, and when polymer latexes having a high glass transition point are used in a backing layer, curling can be prevented.

The photographic material in the present invention can also contain a matting agent. A matting agent may be added to either of the emulsion layer side or the backing layer side but it is particularly preferred to be added to the outermost layer of the emulsion layer side on a support or to the outermost. layer of backing layer side. A matting agent may be either soluble or insoluble in a processing solution, and both types of matting agents can be used in combination. For example, polymethyl methacrylate, poly (methyl methacrylate/methacrylic acid=9/1 to 5/5 (mol ratio)), and polystyrene particles are preferably used. The average particle size of a matting agent is preferably from 0.8 to 10 $\mu$m, and particle size distribution is preferably narrow, preferably 90% or more of the entire particle number are included in the range of 0.9 to 1.1 times the average particle size. For increasing a matting property, it is also preferred to add fine particles having a particle size of 0.8 $\mu$m or less at the same time. For example, polymethyl methacrylate (0.2 $\mu$m), poly (methyl methacrylate/methacrylic acid=9/1 (mol ratio) , 0.3 $\mu$m) , polystyrene particles (0.25 $\mu$m), and colloidal silica (0.03 $\mu$m) are exemplified.

Specifically, JP-A-61-88256, p. 20 can be referred to. In addition, the compounds disclosed in JP-A-63-274944 and JP-A-63-274952, such as benzoguanamine resin beads, polycarbonate resin beads, and AS resin beads are exemplified. The compounds described in RD can also be used.

These matting agents can be used as a dispersion, if necessary, by being dispersed in various kinds of binders as described above in the item of binders. In particular, various gelatins, e.g., dispersions of acid-processed gelatins are easy to prepare a stable coating solution, and it is preferred to optimize pH, ionic strength and binder concentration according to necessity.

Transparent supports resistive to the processing temperature are used as the support for the photographic material in the present invention. In general, photographic supports, e.g., paper, synthetic high polymer (film) described in Nippon Shashin Gakkai compiled, *Shashin Kogaku no Kiso—Gin—en Shashin Hen-(The Elementary of Photographic Engineering—Volume of Silver Salt Photography)*, pp. 223 to 240, Corona Publishing Co. are exemplified. Specifically, polyethylene terephthalate, polyethylene naphthalate, polycarbonate, polyvinyl chloride, polystyrene, polypropylene, polyimide, celluloses (e.g., triacetyl cellulose) are exemplified.

Besides the above supports, the supports disclosed on pp. 29 to 31 in JP-A-62-253159, on pp. 14 to 17 in JP-A-1-161236, JP-A-63-316848, JP-A-2-22651, JP-A-3-56955 and U.S. Pat. No. 5,001,033 can be used in the present invention. These supports can be subjected to heat treatment (controlling of crystallinity and orientation) , monoaxial andbiaxial stretching (controlling of orientation), blending of various polymers, and surface treatment for improving optical properties and physical properties.

Particularly when heat resistance and curling properties are strictly required, the supports disclosed in JP-A-6-41281, JP-A-6-43581, JP-A-6-51426, JP-A-6-51437 and JP-A-6-51442 can be preferably used as the support of a photographic material.

Supports of styrene polymers mainly comprising syndiotactic structure can also be preferably used in the present invention. The thickness of the support in the present invention is preferably from 5 to 200 $\mu$m and more preferably from 40 to 120 $\mu$m.

The polyester supports for use in the present invention are described below, but details including photographic materials besides the above, processing, cartridges and examples are disclosed in Kokai-Giho, Kogi No. 94-6023 (Hatsumei-Kyokai, Mar.15, 1994). The polyesters for use in the present invention comprise diol and aromatic dicarboxylic acid as essential components, and as aromatic dicarboxylic acids, 2,6-, 1,5-, 1,4- and 2,7-naphthalenedicarboxylic acid, terephthalic acid, isophthalic acid, and phthalic acid, and as diols, diethylene glycol, triethylene glycol, cyclohexanedimethanol, bisphenol A, and bisphenol can be exemplified. The polymers thereof include homopolymers such as polyethylene terephthalate, polyethylene naphthalate, polycyclohexanedimethanol terephthalate and the like. Polyesters comprising from 50 mol % to 100 mol % of 2,6-naphthalenedicarboxylic acid are particularly preferred. Polyethylene 2,6-naphthalate is preferred above all. The average molecular weight of them is about 5,000 to 200,000. Tg of the polyester for use in the present invention is 50° C. or more, and 90° C. or more is preferred.

The polyester support is heat treated at 40° C. or more and less than Tg, more preferably Tg minus 20° C. or more to less than Tg for the purpose of being reluctant to get curling habit. The heat treatment may be carried out at constant temperature within this range or may be carried out with cooling. The heat treatment time is from 0.1 hours to 1,500 hours, preferably from 0.5 hours to 200 hours. The heat treatment of the support may be carried out in a roll state or may be performed in a web state while transporting. The surface of the support may be provided with concavities and convexities (e.g., coating conductive inorganic fine particles such as $SnO_2$ or $Sb_2O_5$) to improve the surface state. It is also preferred to make some designs such that the edge is knurled to slightly increase the height only of the edge, to thereby prevent the difference in level due to the edge from imparting the evenness of support wound thereon. The heat treatment may be performed at any stage after formation of the support, after the surface treatment, after coating of a backing layer (an antistatic agent, a sliding agent, etc.), or after undercoating, but preferably conducted after coating of an antistatic agent.

An ultraviolet absorbing agent may be incorporated into the polyester support. Further, light piping can be prevented by incorporating the commercially available dye or pigment for polyester such as Diaresin manufactured by Mitsubishi Kasei Corp. or Kayaset manufactured by Nippon Kayaku Co., Ltd.

To ensure adhesion of the support and the constitutional layers of a photographic material, surface activation treatment is preferably performed, e.g., chemical treatment, mechanical treatment, corona discharge treatment, flame treatment, ultraviolet treatment, high frequency treatment, glow discharge treatment, active plasma treatment, laser treatment, mixed acid treatment, and ozone oxidation treatment. Of these surface treatments, ultraviolet irradiation treatment, flame treatment, corona discharge treatment, and glow discharge treatment are preferred.

An undercoating layer is described below. An undercoating layer may be a single layer or may be two or more layers. The binder for an undercoating layer include copolymers with monomers selected from vinyl chloride, vinylidene chloride, butadiene, methacrylic acid, acrylic acid, itaconic acid and maleic anhydride being starting materials, as well as polyethyleneimine, an epoxy resin, grafted gelatin, nitrocellulose, gelatin, polyvinyl alcohol, and modified polymers of these compounds. Compounds for swelling a support include resorcin and p-chlorophenol. The examples of gelatin hardening agents for an undercoating layer include chromium salt (chrome alum), aldehydes (formaldehyde, glutaraldehyde), isocyanates, active halide compounds (2,4-dichloro-6-hydroxy-s-triazine), epichlorohydrin resins, and active vinyl sulfone compounds. $SiO_2$, $TiO_2$, inorganic fine particles or polymethyl methacrylate copolymer fine particles (0.01 to 10 $\mu$m) may be contained as a matting agent.

It is preferred to use supports having a magnetic recording layer disclosed in JP-A-4-124645, JP-A-5-40321, JP-A-6-35092 and JP-A-6-31787 and record photographing information.

A magnetic recording layer is a layer coated on a support with an aqueous or organic solvent-based coating solution comprising magnetic particles dispersed in a binder. The examples of the magnetic particles which can be used in the present invention include ferromagnetic iron oxide such as $\gamma$-$Fe_2O_3$, Co-adhered$\gamma$-$Fe_2O_3$, Co-adheredmagnetite, Co-containing magnetite, ferromagnetic chromiumdioxide, ferromagnetic metal, ferromagnetic alloy, hexagonal system Ba ferrite, Sr ferrite, Pb ferrite, and Ca ferrite. Co-adhered ferromagnetic iron oxide such as Co-adhered $\gamma$-$Fe_2O_3$ is preferred. The figure of the particle may be any of an acicular figure, an ellipsoidal figure, a spherical figure, a cubic figure, or a plate-like figure. The specific surface area ($S_{BET}$) is preferably 20 $m^2/g$ or more, and particularly preferably 30 $m^2/g$ or more. The saturation magnetization ($\sigma_s$) of the ferromagnetic substance is preferably from $3.0\times10^4$ to $3.0\times10^5$ A/m and particularly preferably from $4.0\times10^4$ to $2.5\times10^5$ A/m. The ferromagnetic particles may be surface treated with silica and/or alumina and organic materials. Further, the surfaces of the magnetic particles may be treated with a silane coupling agent or a titanium coupling agent as disclosed in JP-A-6-161032. In addition, the magnetic particles the surfaces of which are covered with inorganic or organic substances as disclosed in JP-A-4-259911 and JP-A-5-81652 can also be used. The binders which can be used in the present invention for the magnetic particles includes the thermoplastic resins, thermosetting resins, radiation curable resins, reactive type resins, acid-, alkali- or biodegradable polymers, natural polymers (e.g., cellulose derivatives, sugar derivatives), and mixtures of them disclosed in JP-A-4-219569. The above described resins have a Tg of from −40° C. to 300° C., and a mass average molecular weight of from 2,000 to 1,000,000. The examples of the binders include vinyl copolymers, cellulose derivatives, e.g., cellulose diacetate, cellulose triacetate, cellulose acetate propionate, cellulose acetate butyrate and cellulose tripropionate, acrylic resins, and polyvinyl acetal resins. Gelatin is also preferably used as the binder. Cellulose di(tri)acetate is particularly preferably used. The binder can be subjected to curing treatment by adding epoxy based-, aziridine based- or isocyanate based-crosslinking agent. The examples of the isocyanate-based crosslinking agents include isocyanates such as tolylenediisocyanate, 4,4'-diphenyl-methanediisocyanate, hexamethylenediisocyanate and xylene-diisocyanate, reaction products of these isocyanates with polyalcohols (e.g., a reaction product of 3 mol of tolylenediisocyanate with 1 mol of trimethylolpropane), and polyisocyanate formed by condensation of these isocyanates, and these compounds are disclosed in JP-A-6-59357. The above magnetic substances are dispersed in a binder preferably using, as disclosed in JP-A-6-35092, a kneader, a pin type mill, and an annular type mill, and the combined use of them is also preferred. The dispersants disclosed in JP-A-5-88283 or other well-known dispersants can be used. The thickness of a magnetic recording layer is from 0.1 $\mu$m to 10 $\mu$m, preferably from 0.2 $\mu$m to 5 $\mu$m, and more preferably from 0.3 $\mu$m to 3 $\mu$m. The mass ratio (i.e., the weight ratio) of the magnetic particles to the binder is preferably from 0.5/100 to 60/100, and more preferably from 1/100 to 30/100. The coating amount of the magnetic particles is from 0.005 to 3 $g/m^2$, preferably from 0.01 to 2 $g/m^2$, and more preferably from 0.02 to 0.5 $g/m^2$. Transmission yellow density of a magnetic recording layer is preferably from 0.01 to 0.50, more preferably from 0.03 to 0.20, and particularly preferably from 0.04 to 0.15.

A magnetic recording layer can be provided on the back surface of a photographic support entirely or in stripe by coating or printing. Coating of a magnetic recording layer can be performed by means of air doctor coating, blade coating, air knife coating, squeeze coating, impregnation coating, reverse-roll coating, transfer-roll coating, gravure coating, kiss coating, cast coating, spray coating, dip coating, bar coating, or extrusion coating, and the coating solution disclosed in JP-A-5-341436 is preferably used.

A magnetic recording layer maybe provided with functions of lubrication improvement, curling adjustment, antistatic property, adhesion prevention and head abrasion, or other functional layers having these functions may be provided, and at least one kind or more of the particles are preferably abrasives of non-spherical inorganic particles having Mohs' hardness of 5 or more. The composition of the non-spherical inorganic particle is preferably oxide such as aluminum oxide, chromium oxide, silicon dioxide, titanium dioxide, etc., carbide such as silicon carbide and titanium carbide, and fine powders such as diamond. The surfaces of these abrasives may be treated with a silane coupling agent or a titanium coupling agent. These particles may be added to a magnetic recording layer, or may be overcoated on a magnetic recording layer (e.g., a protective layer, a lubricating layer). The above described binders can be used at this time, preferably the same binder as the binder in the magnetic recording layer is used. Photographic materials having a magnetic recording layer are disclosed in U.S. Pat. Nos. 5,336,589, 5,250,404, 5,229,259, 5,215,874 and EP 466130.

A film patrone preferably used in the present invention is described below. The main material of the patrone for use in the present invention may be metals or synthetic plastics. Preferred plastic materials are polystyrene, polyethylene, polypropylene, polyphenyl ether, etc. Further, the patrone for use in the present invention may contain various antistatic agents, and carbon black, metal oxide particles, nonionic, anionic, cationic and betaine surfactants or polymers can be preferably used. A statically prevented patrone is disclosed in JP-A-1-312537 and JP-A-1-312538. In particular, those having the resistivity of $10^{12}\Omega$ or less at 25° C., 25% RH are preferred. Usually, a plastic patrone is produced by using plastics incorporating a carbon black or a pigment to give light shielding. The size of a patrone may be 135 size of the present as it is, or it is effective to decrease the diameter of a cartridge of 25 mm of the present 135 size to 22 mm or less for the miniaturization of a camera. The capacity of the case of a patrone is 30 $cm^3$ or less and preferably 25 $cm^3$ or less. The mass of the plastics used for a patrone and a patrone case is preferably from 5 g to 15 g.

Further, the patrone may be a type of sending out the film by revolving a spool. Further, it may be the structure such that the tip of the film is encased in the body of the patrone and the tip of the film is sent to outside through the port of the patrone by revolving the axle of a spool in the feeding direction of the film. These structures of a patrone are disclosed in U.S. Pat. Nos. 4,834,306 and 5,226,613.

The above-described photographic materials according to the present invention can be preferably used in the film units equipped with lenses as disclosed in JP-B-2-32615 and JP-B-U-3-39784 (the term "JP-B-U" as used herein means an "examined Japanese utility model publication").

The film unit equipped with a lens is a unit comprising a packaged unit body equipped with a lens for photographing and a shutter, and an unexposed color photographic material in a sheet state or in a roll state encased directly or in a container., and the unit is further encased in an outer package.

The package case body is further equipped with a finder, a mechanism of sending frames of a photographic material, and a mechanism of taking in and out of a photographed color photographic material. The finder may be equipped with a parallax adjusting support and the photographing mechanism maybe equipped with an auxiliary lighting mechanism as disclosed in JP-A-U-1-93723 (the term "JP-A-U" as used herein means an "unexamined published Japanese utility model application"), JP-A-U-1-57738, JP-A-U-1-57740, JP-A-1-93723 and JP-A-1-152437.

Since a photographic material is encased in the packaged unit body in the present invention, it is preferred that the humidity in the packaged unit is conditioned from 40 to 70% at 25° C., preferably from 50 to 65%. Materials which are impermeable to moisture or non-hygroscopic materials having a hygroscopicity of 0.1% or less according to the ASTM D-570 are used as outer packaging materials. Sheets laminated with an aluminum foil or aluminum foils are preferably used.

As the container of a photographed photographic material equipped in the packaged unit body, cartridges for an outer packaging unit or generally used patrone, e.g., containers as disclosed in JP-A-54-111822, JP-A-63-194255, U.S. Pat. Nos. 4,832,275and 4,834,306are used. The sizes of the photographic materials for use in the film units equipped with lenses are a size 110, a size 135, half the sizes thereof, and a size 126.

The plastic materials for use in the packaging unit in the present invention can be produced by addition polymerization of olefins having a double bond of carbon-carbon, ring-opening polymerization of compounds having a small-membered ring, polycondensation (condensation polymerization) and polyaddition of two or more polyfunctional compounds, and addition condensation of phenol derivatives, urea derivatives, or melamine derivatives with compounds having aldehyde.

The photographic material according to the present invention can be development processed by ordinary methods described, e.g., in RD, No. 17643, pp. 28 and 29, RD, No. 18716, p. 651, from left to right columns, and RD, No. 307105, pp. 880 and 881. As the development processing of color negative films for use in the present invention, C-41 processing by Eastman Kodak Company and CN-16 processing by Fuji Photo Film Co., Ltd. can be exemplified. Development processing of color reversal films for use in the present invention is described in detail in *Kochi Gijutsu (Known Techniques)*, No. 6, from line 5, page 1 to line 5, page 10, and from line 8, page 15 to line 2, page 24 (Apr. 1, 1991) published by Aztec Co., Ltd., which can be preferably applied to the present invention. As the preferred development processing including the above contents, E-6 processing by Eastman Kodak Company and CR-56 processing by Fuji Photo Film Co., Ltd. can be exemplified.

The image of the photographic material in the present invention can also be formed by activator processing and development with a processing solution containing a developing agent and a base. Activator processing means a processing method of having incorporating a color developing agent in a photographic material and performing development processing with a processing solution not containing a color developing agent. The processing solution in this case is characterized in that it does not contain a color developing agent which is contained in the components of ordinary development processing solutions, and other components (e.g., an alkali and an auxiliary developing agent) may be contained. Activator processing is described in well-known literature, e.g., EP-A-545491 and EP-A-565165.

It is also preferred to form the image of the photographic material in the present invention by heat development after image exposure.

Heat treatment of a photographic material is well known in the field of the industry, and a photothermographic material and the development process thereof are described, e.g., in *Shashin Kogaku no Kiso* (*The Elementary of Photographic Engineering*), pp. 553 to 555, Corona Publishing Co. (1970), *Eizo Joho* (*Image Information*), p. 40 (April 1978) *Nabletts Handbook of Photogrwaphy and Reprograpy*, 7th Ed., pp. 32 and 33, Van Nos trand and Reinhold Company, U.S. Pat. Nos. 3,152,904, 3,301,678, 3,392,020, 3,457,075, British Patents 1,131,108, 1,167, 1777, and RD, No. 17029, pp. 9 to 15 (1978).

Image informations can be taken in without removing a developed silver generated by development and the undeveloped silver halide in the present invention, but image informations can be taken in after elimination in the latter case, means of eliminating these compounds simultaneously with the development or after development can be applied to the present invention.

For removing the developed silver in a light-sensitive element simultaneously with the development or complexing or solubilizing silver halide, it is possible to incorporate into a processing element in advance an oxidant of silver which functions as a bleaching agent and a re-halogenating agent, or a silver halide solvent which functions as a fixing agent, and cause reaction of these compounds at heat development. It is also possible to apply a second element containing an oxidant of silver and a re-halogenating agent, or a silver halide solvent in advance to a photographic material after development for forming an image, to thereby cause removal of the developed silver, or complexing or solubilization of silver halide. It is preferred in the present invention to perform these processes so as not to hinder reading of image information after photographing and succeeding image-forming development. In particular, since the undeveloped silver halide causes high haze in a gelatin film and increase the background density of the image, it is preferred to decrease haze by the above-described complexing agents, or to eliminate all or a part of undeveloped silver halide from a gelatin film by solubilization. Further, it is also preferred to use tabular grains having a high aspect ratio or a high silver chloride content for the purpose of reducing the haze of silver halide itself.

Ordinarily used silver bleaching agents can be arbitrarily used in the processing element in the present invention, e.g., the bleaching agents described in U.S. Pat. Nos. 1,315,464, 1,946,640, Photographic Chemistry, Vol.12, Chapter 30, Foundation Press, London, England can be used. These bleaching agents effectively oxidize and solubilize a photographic silver image. As the useful examples of silver bleaching agents, alkali metal bichromate and alkali metal ferricyanide are exemplified. Preferred bleaching agents are soluble in water, e.g., ninhydrin, indandione, hexaketocyclohexane, 2,4-dinitrobenzoic acid, benzoquinone, benzenesulfonic acid, and 2,5-dinitrobenzoic acid are included in such preferred bleaching agents. In addition, there are metal organic complexes, e.g., ferric salt of cyclohexyldialkylaminotetraacetic acid, ferric salt of ethylenediaminetetraacetic acid, and ferric salt of citric acid. As fixing agents, silver halide solvents which can be contained in the processing element for developing the above light-sensitive element (the first processing element) are exemplified. The binders, supports and other additives which can be used in the first processing element can be used in the second processing element. The coating amount of bleaching agents should be varied depending upon the silver content of the light-sensitive element to be stuck together, and the amount is from 0.01 to 10 mol of the coating silver amount of the light-sensitive silver halide per unit area of the light-sensitive element, preferably from 0.1 to 3 mol per mol of the coating silver of the light-sensitive element, and more preferably from 0.1 to 2 mol per mol of the coating silver of the light-sensitive element.

Literature:

1. *Research Disclosure*, Item 17643 (December, 1978), and ibid., Item 38957 (September 1996).
2. JP-A-4-34544, JP-A-189644, JP-A-4-184326 to 184330, JP-A-2-167819, JP-A-2-172816, JP-A-4-125630, JP-A-4-181240, JP-A-4-330427, JP-A-5-5966, JP-A-5-19392, JP-A-5-210191, JP-A-6-3759, JP-A-6-230490, JP-A-6-27558, JP-A-11-202435, JP-A-11-212193, JP-A-11-271898, JP-A-11-52506, and JP-A-58-113926 to 113928.
3. JP-A-6-242526, JP-A-6-142478, JP-A-6-86923, JP-A-6-11779, JP-A-5-337350, JP-A-5-61134, JP-A-5-45757, JP-A-5-11377, JP-A-4-340538, JP-A-3-246534, JP-A-3-200952, JP-A-3-155539, and JP-A-4-193336.
4. JP-A-3-21339, JP-A-4-193336, JP-A-4-330427, and JP-A-4-283741.
5. *Kagaku Binran, Kiso-hen* (*Chemical Handbook, Elementary Course*), Maruzen Co., Ltd. (1984 and 1993), U.S. Pat. Nos. 5,733,718, 5,030,552, JP-A-11-202435, *Denki Kagaku Binran* (*Electrochemical Handbook*), Chaps. 3 to 6, Maruzen Co., Ltd. (1985), JP-A-10-104769, JP-A-8-69069, *Shin Jikken Kagaku Koza* (*New Experimental Chemical Course*), Vol. 15, "Sanka to Kangen (Oxidation and Reduction)", Maruzen Co., Ltd. (1976), Minoru Imoto Ed., *Koza Yuki Hanno Kiko* (*Lectures on Organic Reaction Mechanisms*), Vol. 10, Tokyo Kagaku Dohjin (1965), Yoshiro Ogata Ed., *Yuki Kagobutsu no Sanka to Kangen* (*Oxidation and Reduction of Organic Compounds*), Nankodo Co. (1963), JP-A-61-3134, *Sekai Kagaku Dai-Jiten* (*World Chemical Encyclopedia*), "Sanka Kangen (Oxidation Reduction)", "Sanka Kotei (Oxidizing Processes)" and "Sankazai (Oxidants)", Kodansha Co., Ltd. (1977).
6. *Kagaku Binran, Ohyo Kagaku-hen* (*Chemical Handbook, Applied Chemistry Course*), Maruzen Co., Ltd. (1986 and 1995).
7. R. T. Morison et al., translated by Koji Nakanishi et al., *Yuki Kagaku* (*Organic Chemistry*), Tokyo Kagaku Dohjin (1994).
8. *Saishin no Maku Shori Gijutsu to sono oyo* (*The Latest Membrane Processing Techniques and Applications*), Fuji Techno System (1984), Nippon Kagaku-Kai Ed., *Bunri Seisei Gijutsu Handbook* (*Technical Handbook of Separation and Purification Techniques*), Maruzen Co., Ltd. (1993), edited by Manabu Senoo et al., *Bunri Kagaku Handbook* (*Handbook of Chemistry of Purification*) , Kyoritsu Shuppan Co. (1993), catalogs on ultrafiltration apparatus of Nippon Pole Co., Ltd., Asahi Chemical Industry Co., Ltd., Nippon Gaishi Co., Ltd. and Toso Co., Ltd., U.S. Pat. Nos. 4,334,012, 5,250,403, and EP-A-795445.
9. JP-A-6-324454, JP-A-7-11143, JP-A-7-175169, JP-A-10-186557, JP-A-11-174612, JP-A-11-338090, JP-A-2000-227641, *Nippon Shashin Gakkai-Shi* (*Bulletin of Japan Photographic Society*), Vol. 30, pp. 10-30 (1967); *ibid.*, Vol. 33, pp. 151-159 (1970), U.S. Pat. Nos. 3,860,428, 3,713,833 and 5,932,404.

10. JP-A-10-104769 and JP-A-2001-183766.
11. JP-A-58-113926, JP-A-2-838, JP-A-7-28153, JP-A-8-82883, JP-A-7-175147, JP-A-2-222940, JP-A-3-239240, JP-A-5-204.069, JP-A-10-104769, JP-A-8-87087, EP-A-701164, EP 503700EP 754964.
12. EP-A-534395, JP-A-2001-183766, JP-A-2001-201810, JP-A-6-308648, JP-A-7-146522, JP-A-7-234470, JP-A-8-339044 and JP-A-11-271900.
13. 1) Kazutaka Yazawa et al., *Tanpakushitsu no Kagaku Shushoku* (*Chemical Modifications of Proteins*), Hirokawa Shoten Co. (1991), 2) *Shinsei Kagaku Jikken Koza* 1 (*Lecture on New Chemical Experiments*, 1), "Tanpakushitsu IV (Protein IV)", Tokyo Kagaku Dohjin (1992), 3) *Nikawa to Gelatin* (*Glue and Gelatin*), Maruzen Co., Ltd. (1997), 4) *Seikagaku Jikken Koza* 1 (*Lecture on Biochemical Experiments,* 1), "Tanpakushitsu no Kagaku III (Chemistry of Protein, III)", Tokyo Kagaku Dohjin (1976).
14. *The Theory of the Photographic Process*, Macmillan Co. (1996).
15. JP-A-8-339044, JP-A-11-271900 and EP-A-0534395.
16. JP-A-11-202435.
17. JP-A-2001-255611.
18. Inouchi Seieido, catalogs of integrated instruments for research, *Kagaku Daijiten* (*Encyclopaedia Chimica*), item of "Kanzai (Freezing mixture)"., Kyoritsu Shuppan Co. (1963), 98/99 *Kagaku Kiki Soran* (98/99 *Comprehensive Bibliography of Scientific Instruments*), Kagaku Kiki Kyokai (1998).
19. JP-A-4-226449 and JP-A-3-37643.
20. *Kagaku Jiten* (*Cyclopedia of Chemistry*), appendix 5, Tokyo Kagaku Dohjin (1994).
21. *Muki Kagobutsu, Sakutai Jiten* (*Cyclopedia of Inorganic Compounds, Complexes*), Kodansha Co. (1997), EP 699944 to EP 699951.
22. *Shashin Kogaku no Kiso—Gin-en Shashin Hen—*(*The Elementary of Photographic Engineering—Volume of Silver Salt Photography*), Corona Publishing Co. (1979).
23. *Rikagaku Jiten* (*Cyclopedia of Physics and Chemistry*), item of "Theory of Marcus", Iwanami Shoten Co. (1998).
24. JP-A-2-301742 and JP-A-11-271900.

Regarding AgX emulsions in the present invention and the applications thereof, JP-A-2000-201810, paragraphs [0067] to [0087] can be referred to, in addition to the above.

EXAMPLE

The present invention will be illustrated in more detail with reference to examples below, but these are not to be construed as limiting the present invention.

The agitation during grain formation was always carried out. The constant addition of $Ag^+$ and $X^-$ was always performed by using high precise constant flow rate pump.

Example I-1 (Including Comparative Examples)

(A) One hundred milliliters of {111} tabular crystal emulsion Tal, 100 ml of fine grain emulsion B1 and 2.4 ml of KBr-1 (a 10mass % (i.e., weight %) aqueous solution) were put in are action vessel and ripened at 40° C. with stirring for 50 minutes. Subsequently to the above process, the following processes were performed, i.e., (100 ml of B1 and 2.4 ml of KBr-1 were added and ripening was performed for 45 minutes)→(150 ml of B1 and 3.6 ml of KBr-1 were added and ripening was performed for 45 minutes)→(150 ml of B1 and 3.6 ml of KBR-1 were added and ripening was performed for 40 minutes)→(150 ml of B1 and 3.6 ml of KBr-1 were added and ripening was performed for 45 minutes).

One milliliter of the obtained emulsion was taken out, dye 1 was saturation adsorbed onto the emulsion grain, and the (Au/Pd shadow carbon) replica film of the grain was photographed by TEM. The characteristics of the figure of the formed {111} tabular grain are shown in Table 1. In Table 1, pH represents the pH at the time of formation of B1, and $a_1$ represents [average diameter (μm) of tabular grains/thickness (μm)].

After 80% of the saturation adsorption amount of dye 1 had been adsorbed onto the emulsion, 5 ml of KI-1 solution (containing 10 g of KI in 1 liter) was added thereto through a hollow pipe type porous film 1. Forty ml of Bi was added after 15 minutes, and 90% of the saturation adsorption amount of dye 1 was added after 15 minutes. A precipitant was added after 15 minutes, the temperature was lowered to 35° C., pH was adjusted to about 4.0, to thereby flocculate and precipitate the emulsion, and the emulsion was washed with water. A gelatin solution was added thereto and the emulsion was re-dispersed at pH 6.4 and pBr 2.7.

Antifoggant TAI (4-hydroxy-6-methyl-1,3,3a,7-tetra-azaindene) was added to the emulsion in an amount of $2\times10^{-3}$ mol/mol AgX and the temperature was raised to 50° C. Chemical sensitizer 1 [$Na_2S_2O_3$/chemical sensitizer 2=3/1] was added in total mol amount of $6\times10^{-6}$ mol/mol AgX, after 3 minutes gold sensitizer 1 [a solution of $10^{-3}$ mol/liter of $HAuCl_4$/NaSCN=1/20 in molar ratio] was added in an Au mol amount of $10^{-6}$ mol/mol AgX, followed by ripening for 25 minutes. The temperature was lowered to 40° C., a thickener and a coating aids were added, the emulsion was coated on a TAC support together with a protective layer and the coated layers were dried, thereby a coated sample was obtained.

Photographic characteristics obtained are shown in Table 1. It was confirmed that the figure and photographic characteristics of a tabular grain obtained were superior when the emulsion was formed by adding fine grains formed at a high pH condition $a_2$ in Table 1 represents the ratio of (sensitivity/granularity).

Ta1 and B1 were prepared as follows.

1) Preparation of Ta1

Dispersion medium solution 1 (containing 1,200 g of $H_2O$, 0.5 g of KBr and 4.0 g of GL2, and pH was adjusted to 3.0 with $HNO_3$) was put in a reaction vessel, the temperature was maintained at 2° C., and Ag-1 solution (containing 100 g of $AgNO_3$ per liter) and X-1 solution (containing 71 g of KBr per liter) were added to dispersion medium solution 1 at an addition velocity of 45 ml/min. with stirring dispersion medium solution 1. X-1 solution and Ag-1 solution were added simultaneously for 60 seconds with the start of the addition of X-1 solution preceding that of Ag-1 solution by 1 second. Subsequently, 28 ml of a gelatin solution (containing 35 ml of $H_2O$ and 5 g of GL2, pH 3.0) and 28 ml of a KBr solution (a 10 mass % solution) were added to adjust the pH to 3.5, and then the temperature was increased to 60° C. over 18 minutes. After ripening was performed for further 15 minutes, the temperature was lowered to 25° C., the pH was adjusted to 6.0 with NaOH, and the obtained seed crystal was designated Ta1.

2) Preparation of B1

Dispersion medium solution 2 (containing 1,200 g of $H_2O$, 16 g of GL2 and 0.5 g of KBr, and pH was adjusted to Z1 value with $HNO_3$ and NaOH) was put in a reaction vessel, the temperature was maintained at 8° C., and Ag-2 solution (containing 300 g of $AgNO_3$ per liter) and X-2 solution (containing 211 g of KBr and 10 g of GL 2 per liter) were added to the solution by a double jet method at a velocity of 20 ml/min. through a rubber elastic hollow pipe type porous film (number of pores: $10^3$, a rubber elasticity: $5\times10^6$ N/m$^2$, a pore diameter at addition time: about 100 $\mu$m, a pore diameter at ceasing time of addition: about 0 $\mu$m) at an addition velocity of 20 ml/min. with stirring the solution directly under surface. Ag-2 solution was added for 3 minutes. Since the start of the addition of X-2 solution preceded the addition of Ag-2 solution by 1 second, X-2 solution was added for 3 minutes and 1 second. In the next place, Ag-2 solution was added to CDJ solution together with X-2 solution at a velocity of 20 ml/min. for 12 minutes through the porous film with maintaining pBr at 2.4. The pH was maintained constant within the range of ±0.1 with a pH stat during grain formation. After the termination of the addition, the pH of the emulsion was adjusted to 6.0, by adding $HNO_3$ or NaOH aqueous solution the emulsion was designated B1. Ten pH values (Z1 values) shown in Table 1 were experimented. Constant temperature of 8° C. was maintained by circulating cooling water through the constant temperature bath of the reaction vessel with a commercially available constant temperature cooling water circulating apparatus.

3) Characteristics of B1

The following experiments a) and b) were performed for examining the characteristics of the formed fine grains.

a) Three hundred grams of B1 and 60 g of dispersion medium 1 (a 10 mass % aqueous solution of gelatin GL1) were put in a reaction vessel, the temperature of the reaction vessel was maintained at 20° C., and KBr-1 solution (containing 100 g of KBr in one liter) was added thereto to adjust the pBr at 2.0. With maintaining 20° C. and pBr 2.0, Ag-2 solution and X-3 solution (containing 214 g of KBr and 10 g of GL1 in one liter) were added thereto at a velocity of not generating new nuclei, and the grains were grown until the average size of about 0.1 $\mu$m. Subsequently, 300 g of the emulsion and 60 g of dispersion medium 2 (a 10 mass % aqueous solution of GL2) were put in another reaction vessel. With maintaining the temperature at 20° C. and pBr 1.7, Ag-2 solution and X-3 solution were added thereto at a velocity of not generating new nuclei, and the grains were grown until the average diameter of about 0.32 $\mu$m.

The replica film of the formed grain was photographed by TEM, and (A11) and (A12) were obtained from the figure of the grain. The results obtained are shown in Table 1 below.

In the fine grains formed at pH 4 or less and 12 or more, (A11) and (A12) values were high, but at pH 7.3 to 11.8, the values were low, and (A12) was 0.5% or lower.

b) Three hundred grams of B1, 60 g of dispersion medium 3 (a 10 mass % aqueous solution of GL3), and KBr-1 solution were put in a reaction vessel, the temperature of the reaction vessel was set at 20° C. and pBr at 1.7. The temperature was raised to 60° C. and ripening was performed for 7 minutes. With maintaining 60° C. and pBr 1.7, Ag-1 solution and X-4 solution (containing 77 g of KBr and 10 g of GL2 in one liter) were added thereto at a velocity of not generating new nuclei, and the grains were grown until the average size of about 0.3 $\mu$m. (A11) was obtained from the TEM image of the formed grain similarly to the above.

c) One milliliter of emulsion B1 was taken out, dye 1 was added and saturation adsorbed onto the emulsion grains, and then the emulsion was centrifuged. The emulsion was re-dispersed by water, and put on a mesh on which a collodion film had been formed and carbon had been deposited, and dried. The thus prepared replica film of the grain was cooled to −120° C. or less and photographed by TEM. Any of the average grain sizes of the fine grains prepared at pH 7.3 to 11.8 was 0.025 $\mu$m or less.

Photographic Characteristics

The obtained coated sample was subjected to exposure with red and green light through an optical wedge for 0.1 sec., development with MAA-1 developing solution (*Journal of Photographic Science*, Vol. 23, pp. 249 to 256 (1975)) at 20° C. for 10 minutes, stopping, fixing, washing and drying. The sample was then subjected to sensitometry; the ratio of (sensitivity/granularity) was obtained. The relative value ($a_2$) is shown in Table 1. Sensitivity is the reciprocal of the exposure amount (lux·sec) giving the density of fog+0.2. Granularity is obtained as rms granularity a by the procedure of exposing uniformly a sample with the exposure amount giving the density of fog+0.2.for $10^{-2}$ sec, developing, measuring the dispersion of density by a circular opening having a diameter of 48 $\mu$m with a micro densitometer. The details thereof are described in the above T. H. James, *The Theory of the Photographic Process*, Chapter 21, section E.

Explanation of GL1 to GL11:

GL0 is alkali-processed ossein gelatin having an average molecular weight of about $10^5$.

GL1 is low molecular weight gelatin of GL0 obtained by acid-hydrolyzing GL0 in an acid aqueous solution of $HNO_3$, and then $NO_3^-$ is demineralized to 500 ppm or less by ultra-filtration by adding water. The Met content of GL1 is about 40 $\mu$mol/g, and the weight average molecular weight is about 15,000. The pH of the solution was adjusted to 6.5 by addition of NaOH solution.

GL2 is gelatin obtained by adding $H_2O_2$ to GL1 to be mixed with GL1, and being allowed to stand at 40° C. for 12 hours, to thereby oxidize all the Met groups to change to sulfinyl groups. The weight average molecular weight of GL2 is about 15,000.

GL3 is gelatin obtained similarly by oxidizing GL0 in an aqueous solution containing $H_2O_2$, to thereby oxidize all the Met groups to change to sulfinyl groups. GL4 is gelatin obtained by esterification of making reaction of 35% of the carboxyl groups of GL1 with methyl alcohol. GL5 is gelatin obtained by decomposing GL0 with a pronase decomposing enzyme, and the weight average molecular weight of GL5 is about 15,000.

GL6 is gelatin obtained by adding an aqueous solution of $H_2O_2$ to GL5, to thereby oxidize all the Met groups in the gelatin and the enzyme. GL7 is gelatin extracted from the skin of codfish. GL8is gelatin obtained by making the molecular weight of GL7 low (having a weight average molecular weight of 15,000) similarly to GL1, and then demineralization. GL9 is gelatin obtained by adding $H_2O_2$ to GL8, to thereby oxidize all the Met groups. GL10 is gelatin obtained by carbethoxylating 60% of the imidazole groups of His with ethoxyformic anhydride. GL11 is gelatin obtained by phthalating about 85% of the amino groups of GL1.

GL13 is gelation whose weight average molecular weight is about 10,000, obtained by $H_2SO_4$ acid-hydrolyzing GLO. The Met content is reduced to 0 gmol/g by the $H_2O_2$ oxidation, and the salt content is reduced to about 3,000 ppm by the ultrafiltration.

TABLE 1

| No. | pH | $a_1$ | $a_2$ | A11 | A12 | A10 | Remarks |
|---|---|---|---|---|---|---|---|
| I-1-1 | 2 | 1.5/0.053 | 80 | 3 | 20 | 32 | Comparison |
| I-1-2 | 4 | 1.6/0.052 | 90 | 1 | 7 | 12 | Comparison |
| I-1-3 | 6 | 1.7/0.051 | 100 | 0.3 | 2 | 3 | Comparison |
| I-1-4 | 7.3 | 1.95/0.049 | 110 | 0.010 | 0.07 | 0.1 | Invention |
| I-1-5 | 8.0 | 2.0/0.047 | 130 | 0.002 | 0.01 | 0.01 | Invention |
| I-1-6 | 9.5 | 2.05/0.046 | 140 | 0.000 | 0.00 | 0.001 | Invention |
| I-1-7 | 11 | 2.1/0.045 | 150 | 0.000 | 0.00 | 0.000 | Invention |
| I-1-8 | 11.3 | 2.1/0.045 | 150 | 0.000 | 0.00 | 0.000 | Invention |
| I-1-9 | 11.8 | 2.1/0.045 | 152 | 0.000 | 0.00 | 0.000 | Invention |
| I-1-10 | 12.4 | 1.6/0.052 | 92 | 0.9 | 6 | 10 | Comparison |

TABLE 2

| | PH | $a_2$ | A11 | A10 |
|---|---|---|---|---|
| 1 | 7.3 | 120 | 0.005 | 0.050 |
| 2 | 8.0 | 140 | 0.001 | 0.005 |
| 3 | 9.5 | 150 | 0.000 | 0.000 |
| 4 | 11 | 162 | 0.000 | 0.000 |
| 5 | 11.3 | 160 | 0.000 | 0.000 |
| 6 | 11.8 | 163 | 0.000 | 0.000 |

Dye 1

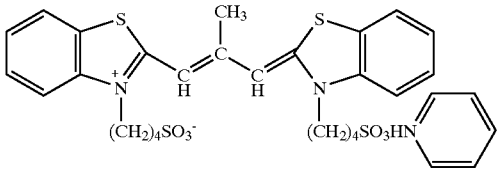

Chemical Sensitizer 2

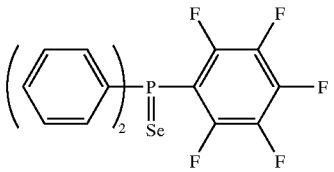

(A10), (A11) and (A12) each represents the value defined in the item (II-1). In the following Tables 1 to 5, $a_1$ represents [average diameter ($\mu$m) of tabular grains/thickness ($\mu$m)], and $a_2$ represents the ratio of (sensitivity/granularity).

Example I-2

Fine grains were formed in the same manner as in the preparation of B1 in Example I-1, except that Ag-2 solution was replaced with Ag-1 solution, X-2 solution was replaced with X-5 solution (containing 71 g of KBr and 10 g of GL2 in one liter), and the addition speed was changed to 60 ml/min. The formed fine grains were subjected to ultrafiltration (a cross flow type, a hollow pipe type, fractional molecular weight: 5K) and the total solution amount was reduced to 70% of the total solution amount of B1 of 1,800 ml, i.e., 1,260 ml. This emulsion was designated B2.

The same experiments as in Example I-1 were performed except that B2 was used in place of B1, and the use amount (ml) was 70% of the amount of B1. The results obtained are shown in Table 2. The values of $a_2$, (A11) and (A10) were improved. The reason is probably due to the fact that the added solution was thinner, as a result the formation of crystal defects was inhibited. This fact also indicates that a smaller reaction vessel can be used for the production of the same mole AgX grain emulsion.

Example I-3

1) Preparation of Fine Grains by Continuous System

The mixer shown in FIG. 2(*a*) (capacity of the mixer: 0.5 ml, the top and bottom directions of the figure are thin) was used. KBr-2 solution (containing 70.8 g of KBr and 40 g of GL2 in one liter, pH was adjusted to Z1 value (shown in Table 3, at 20° C.) was added at a rate of 10 ml/min., and the addition of Ag-1 solution was started 5 sec. behind KBr-2 solution at a constant flow rate of 10 ml/min. When three minutes had elapsed, the flowing solution was taken in a container and this was put in a reaction vessel, 6.4 g of dispersion medium 1 was added thereto, and the grains were grown until 0.32 $\mu$m in the same manneras in a) in 3) in Example I-1. (A11) and (A10) were obtained and shown in Table 3. Low values could be obtained at pH of from 7.3 to 11.3.

2) Ta1 (450 ml) and 70 g of dispersion medium 3 were put in a reaction vessel and the temperature was set at 40° C. Fine grain emulsion in 1) (Ag-1 and KBr-2 solutions were added at a velocity of 10 ml/min) was formed by the continuous system and the addition to the reaction vessel was started, pBr of the vessel emulsion was maintained at 1.7 throughout, and the temperature was raised to 60° C. over 7minutes simultaneously with the start of the addition. Fine grains were added at the same velocity for 10 minutes after the temperature reached 60° C., and then ripening was performed for 12 minutes. Both solutions were then added at accelerated flow rate of additional 1.2 ml/min. for 40 minutes. After the termination of the addition, ripening was performed for 12 minutes.

The emulsion (1 ml) was taken and the characteristics of the figure of the formed grains were obtained in the same manner as in Example I-1. The results obtained are shown in Table 3 below. In the next place, after 80% of the saturation adsorption amount of dye 1 had been adsorbed onto the emulsion, 23 ml of KI-1 solution was added thereto. After 15 minutes, the fine grain emulsion (each solution was added at a rate of 40 ml/min) was added for 2 minutes, followed by ripening for 15 minutes, and then 90% of the saturation adsorption amount of dye 1 was added. Processes such as the demineralization and the like were performed in the same manner as in Example I-1 hereafter, and a coated sample was obtained through coating on a support and drying. The photographic characteristics obtained are shown in Table 3 below. In the fine grains formed at pH of 7.3 to 11.8, particularly excellent photographic characteristics could be obtained.

Example I-4

Figure 4:
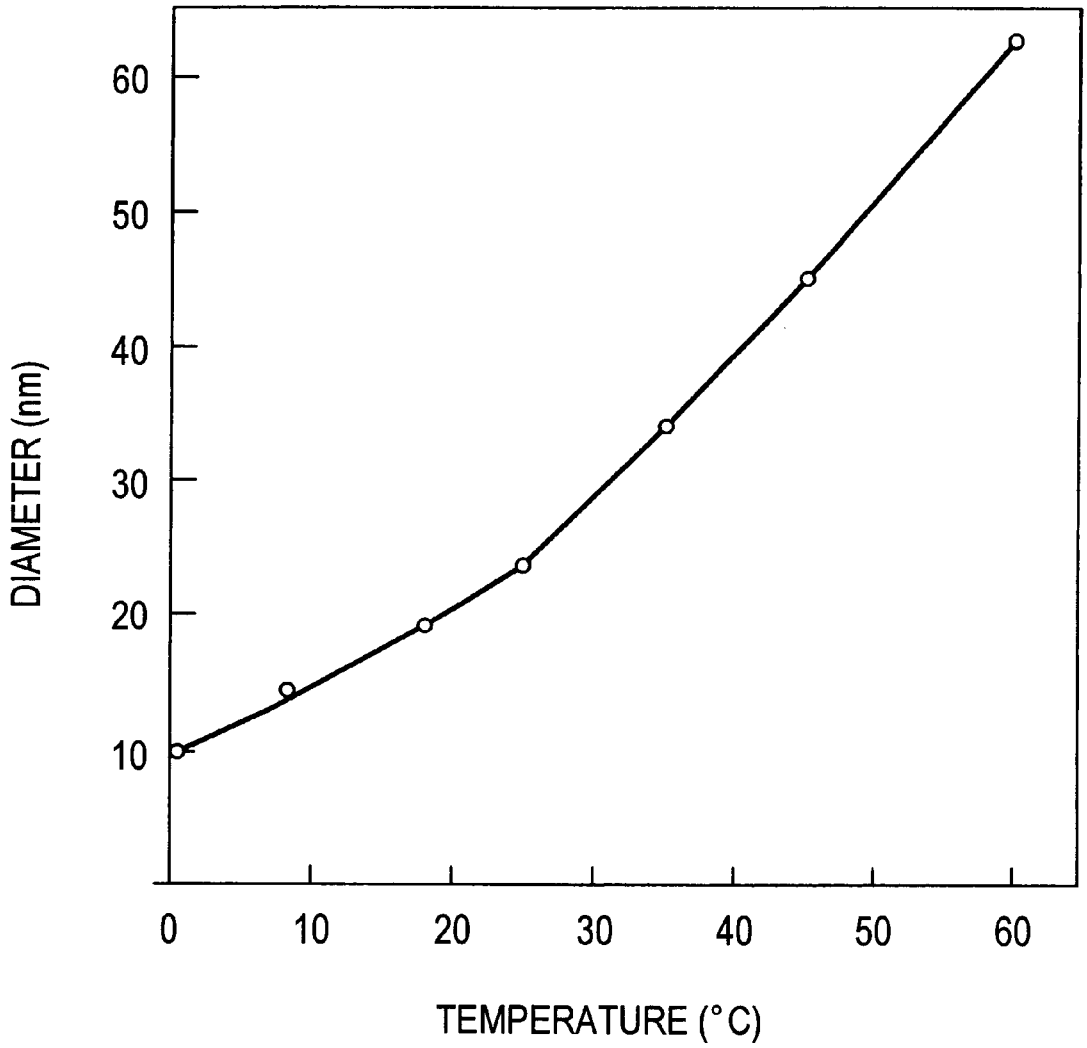
FIG. 4 is a graph showing the relationship between the grain-forming temperature (° C.) and the diameters of grains formed.

I-4-1) Fine grains were formed in the same manner as the formation of B1 in Example I-1 except for changing only grain-forming temperature. In Table 4 below, the results obtained at 35° C. and 1° C. are shown. The experiment in Example I-1 (A) was -carried out by using the obtained fine grains. The obtained results (sensitivity/granularity) are shown in Table 4. Excellent results could be obtained in the pH range of from 7.3 to 11.8 at both temperatures. AgX grains could be formed until 1° C. The lower the grain-forming temperature, the smaller was the grain diameter formed as shown in FIG. 4. Excellent results could be obtained at 1 to 25° C., particularly at 1 to 18° C.

Example I-5

Experiments were performed in the same manner as in the formation of B1 in Example I-1 except that the temperature of grain formation was changed to 15° C., pH was changed to 9.5, and further the following items were changed.

I-5-0: GL2 was replaced with GL0.

I-5-1: GL2 was replaced with GL1.

I-5-2: GL2 was used.

I-5-3: GL2 was replaced with GL3.

I-5-4 to I-5-11: In each experiment, GL2 was replaced with GLn, wherein n represents from 4 to 11.

I-5-12: GL2 was replaced with GL1, 4 ml of $H_2O_2$ (31 mass %) was added after grain formation, and the fine grains were stored in a refrigerator for 3 days, by which the Met content of gelatin became zero. The results obtained are shown in Table 5 below. The effects in the above items (14), (15), (19), (20), (22), (23), (24), (28), (29), (30), (34) and (62) were confirmed.

TABLE 3

| | pH | $a_1$ | $a_2$ | A11 | A10 | Remarks |
|---|---|---|---|---|---|---|
| 1 | 2 | 1.45/0.055 | 75 | 6 | 61 | Comparison |
| 2 | 4 | 1.55/0.054 | 86 | 2 | 21 | Comparison |
| 3 | 6 | 1.65/0.052 | 100 | 0.5 | 5.2 | Comparison |
| 4 | 7.3 | 1.90/0.051 | 112 | 0.025 | 0.26 | Invention |
| 5 | 8.0 | 1.94/0.048 | 132 | 0.005 | 0.06 | Invention |
| 6 | 9.5 | 2.0/0.047 | 143 | 0.002 | 0.02 | Invention |
| 7 | 11 | 2.05/0.046 | 152 | 0.000 | 0.00 | Invention |
| 8 | 11.3 | 2.04/0.047 | 150 | 0.001 | 0.01 | Invention |
| 9 | 11.8 | 2.05/0.046 | 150 | 0.001 | 0.01 | Invention |
| 10 | 12.4 | 1.58/0.053 | 88 | 1.9 | 19 | Comparison |

TABLE 4

| | Temperature (° C.) | |
|---|---|---|
| pH | 1 | 35 |
| 2 | 83 | 75 |
| 4 | 93 | 83 |
| 6 | 110 | 93 |
| 7.3 | 118 | 103 |
| 8.0 | 137 | 123 |
| 9.5 | 147 | 134 |
| 11 | 159 | 144 |
| 11.3 | 155 | 143 |
| 11.8 | 158 | 144 |
| 12.4 | 95 | 85 |

TABLE 5

| Example No. | $a_2$ | GL |
|---|---|---|
| I-5-0 | 100 | 0 |
| I-5-1 | 120 | 1 |
| I-5-2 | 138 | 2 |
| I-5-3 | 110 | 3 |
| I-5-4 | 137 | 4 |
| I-5-5 | 105 | 5 |
| I-5-6 | 125 | 6 |
| I-5-7 | 90 | 7 |
| I-5-9 | 115 | 9 |
| I-5-9 | 122 | 9 |
| I-5-10 | 140 | 10 |
| I-5-11 | 130 | 11 |
| I-5-12 | 133 | GL1 → Oxidation |
| I-5-13 | 140 | 13 |

Example I-6

Preparation of Seed Crystal Ta61

Figure 6:
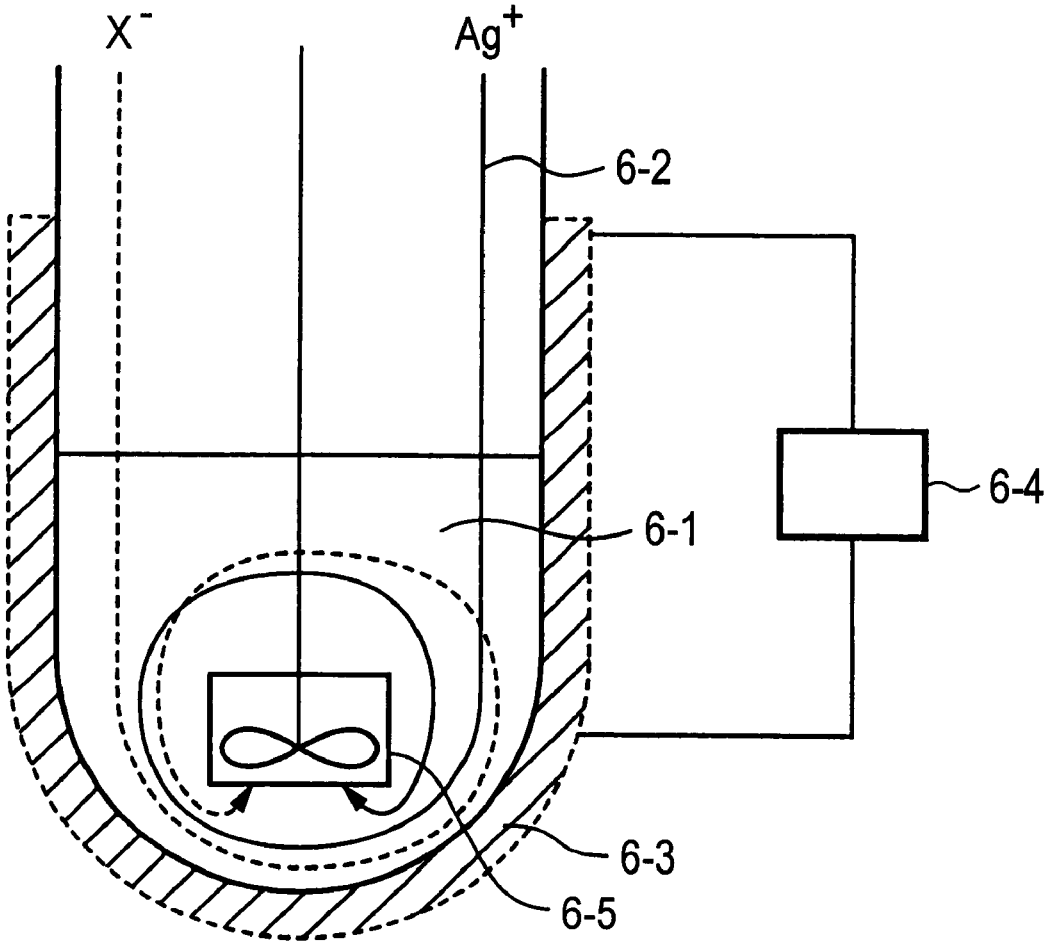
FIG. 6 is a cross-sectional drawing of the side view of the reaction apparatus.
Figure 7:
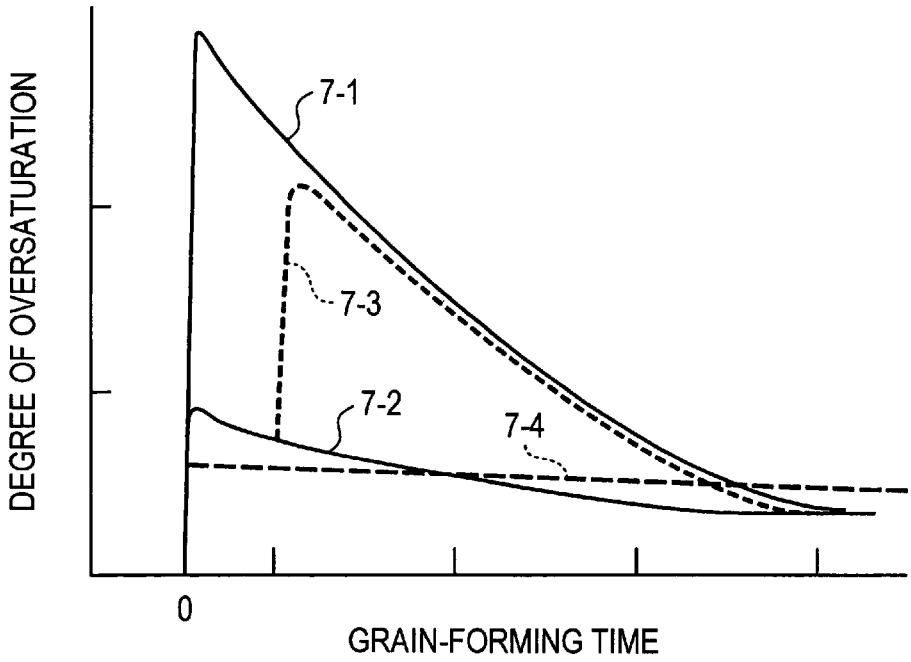
FIG. 7 is a graph showing the relationship between the grain-forming time and the degree of oversaturation of the reaction solution.
Figure 8:
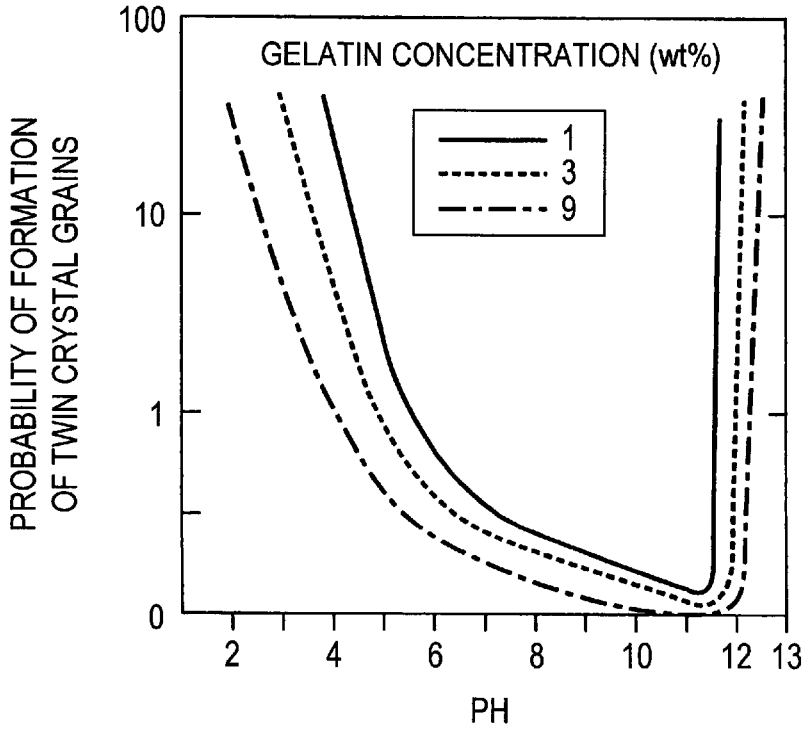
FIG. 8 is a graph showing the relationship between the probability of formation of the number of multiple twin crystal grains and the pH and the gelatin concentration of the reaction solution.

Dispersion medium solution 61 (a solution containing 2 g of GL2, 1.05 g of NaBr and 1 kg of water, dissolved at 45° C. and then pH was adjusted to 6.5) was put into the reaction vessel shown in FIG. 6, and 300 g of ice of pure water and 200 g of water were further added thereto. The temperature of the solution became about 1° C. by the addition. Further, cooling water was circulated through thermostatic jacket 6-3 to maintain the temperature of the solution at about 1° C. Ag-60 solution (containing 50 g of $AgNO_3$ in one liter) and X-60 solution (containing 31.1 g of NaBr and 10 g of GL2 in one liter, pH was 6.5) were simultaneously mixed and added to the reaction solution through hollow pipes at a flow rate of 25 ml/min for 60 seconds. The inside diameter of the reaction vessel was 160 mm, and each hollow pipe was connected with the mixing chamber in the solution after passing through the solution by 600 mm. The temperature of each added solution reached within 3° C. of the temperature of the reaction solution while passing through solution 61, and then added to the mixing chamber. The cross-sectional view of the reaction apparatus was shown in FIG. 6.

The circulating water was let out of the thermostatic jacket and well water of about 18° C. was put into the jacket, and the jacket after being allowed to stand for 10 minutes was connected with the high temperature water-circulating apparatus.

After Gel solution 62 (containing 40 g of water and 5 g of GL2) and 25.1 ml of an NaBr solution (10 wt %) were added to the reaction solution to adjust pH to 6.5, the temperature of the reaction solution was raised to 60° C. over 38 minutes. After ripening the solution for 2 minutes, the temperature of the reaction solution was lowered to 35° C. over 7 minutes. The emulsion was ultrafiltered by using a flat membrane type ultrafiltration apparatus (made of polysulfone synthetic high polymer having a differential molecular weight of 5 K) having an aspect ratio of 100 or more, the emulsion was further ultrafiltered with adding water. An aqueous solution containing 10 g of GL3 was added, thereby the pH was adjusted to 6.5 and pBr to 1.9, and the final volume of the emulsion was about 33% (about 550 ml) of the original volume.

It was confirmed from the TEM image of the emulsion grains photographed that the thus obtained grains were AgBr tabular seed crystals having an average diameter of 0.195 μm, an average thickness of 0.034 μm, the coefficient of variation of diameter distribution (CVD) of 0.29, and the coefficient of variation of thickness distribution (CVT) of 0.12.

Preparation of $AgBr_0$ Fine Grains B61

Dispersion medium solution 62 (a solution containing 1,250 g of water, 50 g of GL13, and 0.31 g of NaBr, and pH was adjusted to 10.2 with an NaOH solution) was put into the reaction vessel shown in FIG. 6, and the temperature of the solution was maintained at 18° C. by circulating cooling water. Ag-6 solution (containing 200 g of $AgNO_3$ in one liter) and X-62 solution (1 liter of an aqueous solution containing 122 g of NaBr and 15 g of GL13 in one liter, pH was adjusted to 10.2 with an NaOH solution) were simultaneously mixed and added to the reaction solution at a flow rate of 7 ml/min for the initial and terminal 12 seconds respectively, and 35 ml/min for about 12 minutes of the intermediate period. The total addition amount of each solution was 425 ml. The pH was adjusted to 6.5 by adding an $H_2SO_4$ solution, thereby the addition was finished. The pattern of addition was shown as the model chart in row 61 of column $AgBr_0$ in Table 6.

The emulsion was ultrafiltered and concentrated with the flat membrane type ultrafiltration apparatus used in Example I-6, and an aqueous solution containing 20 g of GL3 was added, to thereby adjust the pH to 6.5 and pBr to 2.45. The final yield of the emulsion was about 50% (about 860 ml) of the original volume.

Figure 9:
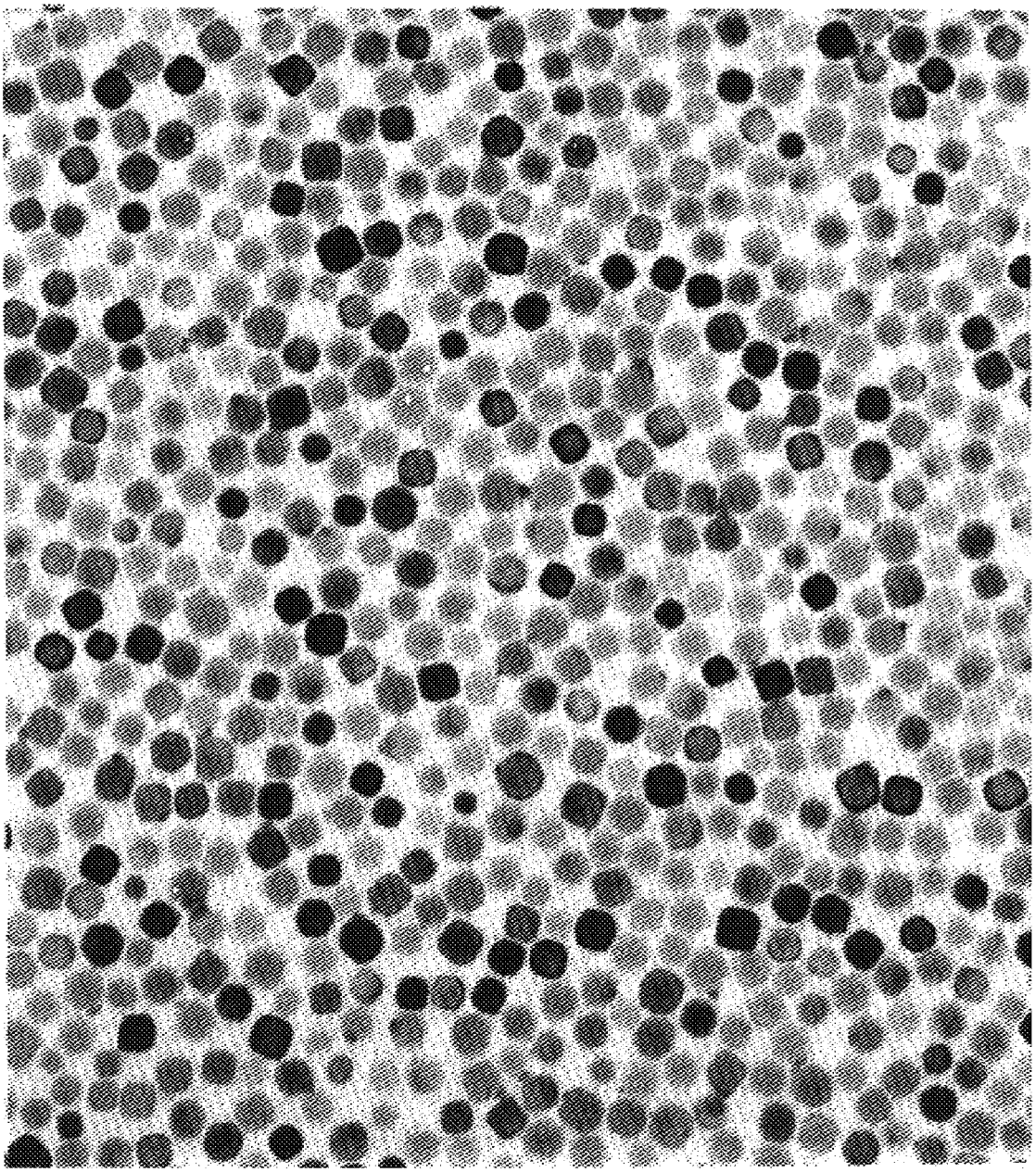
FIG. 9 is a TEM image by the direct method of B61 AgBr fine grain at −130° C. The magnification is about $26\times10^4$ times.

It was found from the TEM image of the emulsion grains at −130° C. photographed that the average diameter of the emulsion grains was 29 nm and CVD was 0.10. This image was shown in FIG. 9. The shape of the grain was a cubic shape having rounded corners. As a result of measuring the area ratio of {100} plane of the grain according to the method of T. Tani, about 95% was {100} plane. The thus obtained emulsion was designated as B61.

Preparation of B62 to 64

Emulsions were prepared in the same manner as in the preparation of emulsion B61 except for changing the patterns of addition of Ag-6 solution and X-62 solution to those shown in rows 62 to 64 of the column of $AgBr_0$ in Table 6. The total addition amount of each solution was 425 ml, which was the same as in B61. The addition patterns were different from the pattern of B61 in the point whether the initial and final slow flow rate addition (7 ml/min) for 12 seconds was performed or not.

Preparation of B65

Emulsion B65 was prepared in the same manner as in the preparation of B61 except for changing the length of each hollow pipe in the reaction solution for feeding Ag-6 and X-62 from 600 mm to 50 mm.

Characteristic of Fine Grain Emulsion

The characteristic of each fine grain emulsion obtained was examined in the same manner as in 3) in Example I-1. The results obtained are shown in Table 6 below.

Growth of Seed Crystal

Emulsion Ta61 (350 ml) was put in a reaction vessel maintained at 75° C., and then 1) 73 ml of B61 was added thereto and the mixture was stirred with a rotary stirrer having propeller blades. After 13 minutes, 2) 152 ml of B61 and an NaBr solution were added. After 18 minutes, 3) 187 ml of B61 and an NaBr solution were added. After 29 minutes, 4) 278 ml of B61 and an NaBr solution were added, and the mixture was ripened for 31 minutes.

Figure 11:
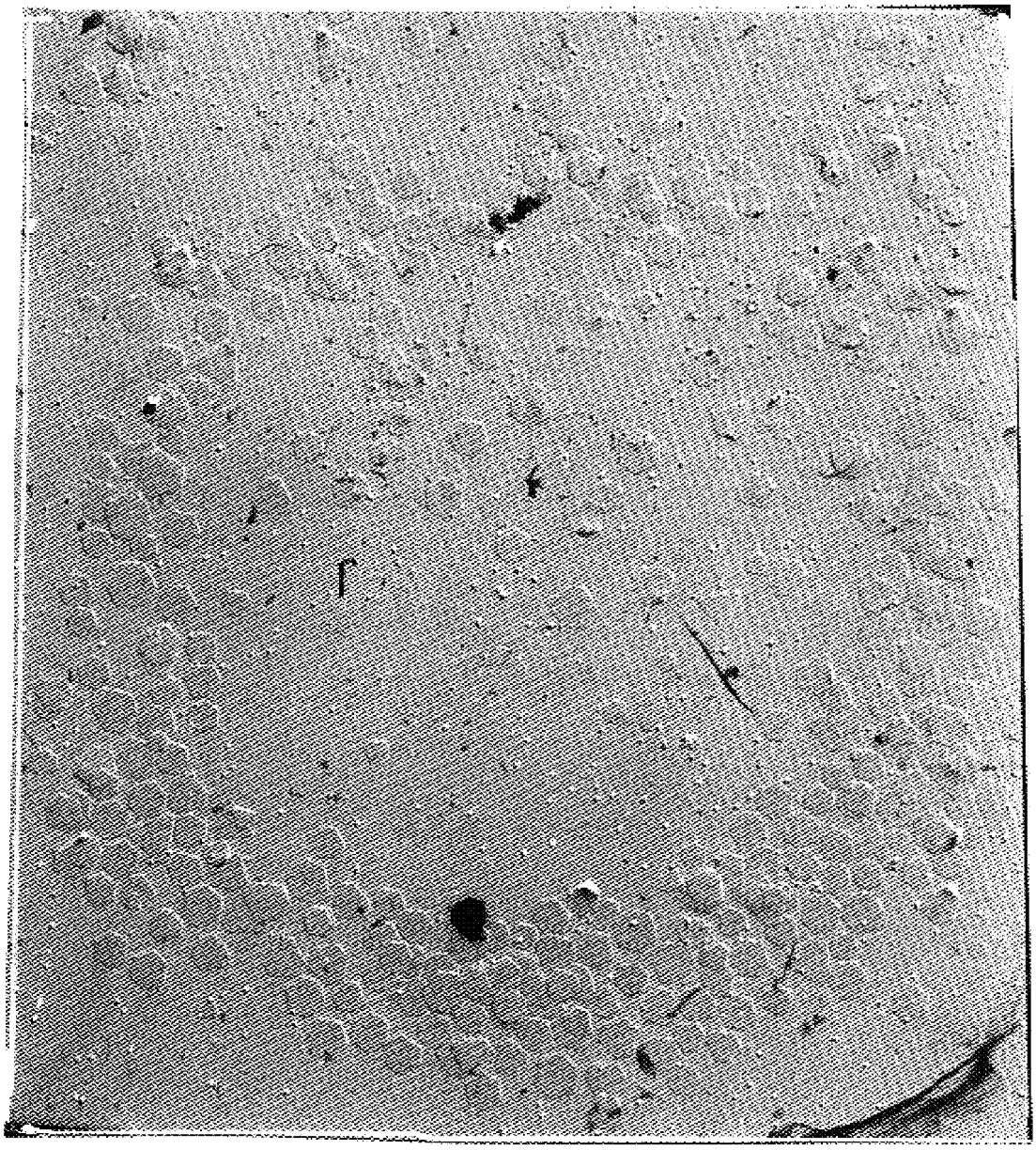
FIG. 11 shows the grain structure of {111} tabular grain obtained in Example I-6. The magnifications are about 2,500 times.

During the growing, the pH was maintained at 6.5 and the pBr at 1.95. The TEM image of the emulsion grains taken out at this point was photographed, and the image was shown in FIG. 11. It was found from the TEM image that the average diameter of the emulsion was 2.5 μm, CVD was 0.17 and the average thickness was 41 nm.

As a result of observation of the TEM image of the emulsion grains taken out just before additions 2) to 4), almost all the fine grains added had disappeared.

In the next place, after Dye 2 was adsorbed onto the grains by 70% of the saturation adsorption amount, 10 ml of KI-1 was added to the emulsion grains through porous membrane 1. After 15 minutes, 50 ml of B61 was added, and after 17 minutes, Dye 2 was added to the level of 90% of the saturation adsorption amount. Hereafter, desalting, redispersion, chemical sensitization, coating and drying were carried out in the same manner as in Example I-1, thus Sample 61 was obtained.

B62 to B65 were also subjected to the same processes and Samples 62 to 65 were obtained. The photographic characteristic of these samples was examined in the same manner as in Example I-1. The results obtained are shown in Table 6as column $a_2$. Each value was shown as the relative value taking the result of Sample 65 as 100. The above-described effect due to temperature control of the solutions added by long pipes and the addition pattern of $Ag^+$ and $X^-$ solutions confirmed.

TABLE 6

| $AgBr_0$ | Pattern of Addition | $10^5$ A10 | $10^5$ A11 | $10^5$ A12 | $a_2$ | Long Pipe |
|---|---|---|---|---|---|---|
| 61 | | 1 | 0.2 | 0.8 | 145 | present |
| 62 | | 8 | 1.5 | 6 | 130 | present |
| 63 | | 15 | 3 | 12 | 120 | present |
| 64 | | 30 | 6 | 20 | 110 | present |
| 65 | | 30 | 6 | 20 | 100 | absent |

Example I-7

Figure 10:
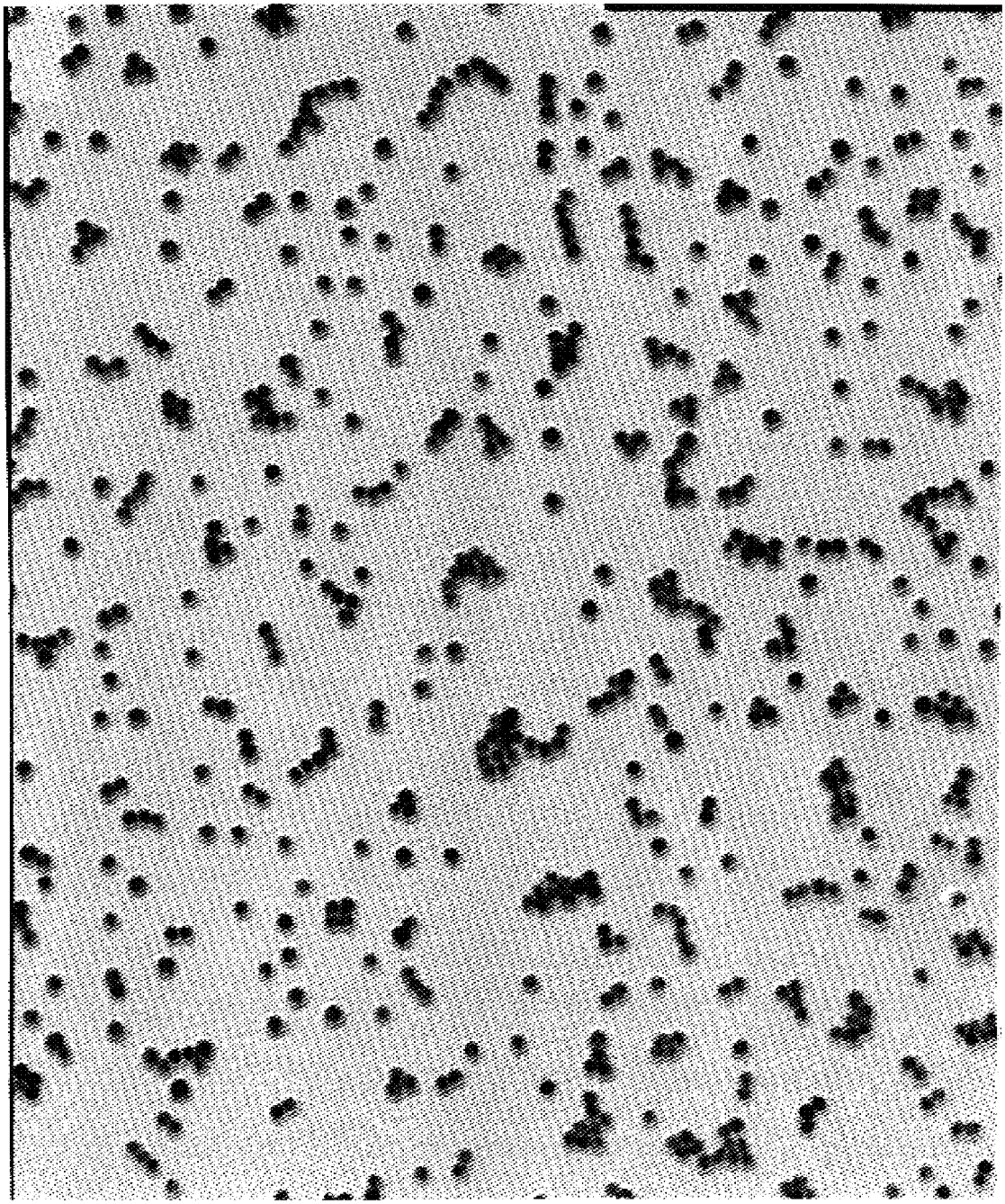
FIG. 10 is a TEM image of B611 AgBr fine grain. The magnification is about 85,000 times.

After emulsion B61 was stored in the refrigerator for 14 days, a TEM image of the grains was photographed. The image was shown in FIG. 10. The grains had an average diameter of 30 nm and the coefficient of variation of diameter distribution of 0.076, which showed that very fine grains vanished by aging. This emulsion was designated as B611.

Growth of Seed Crystal

Figure 12:
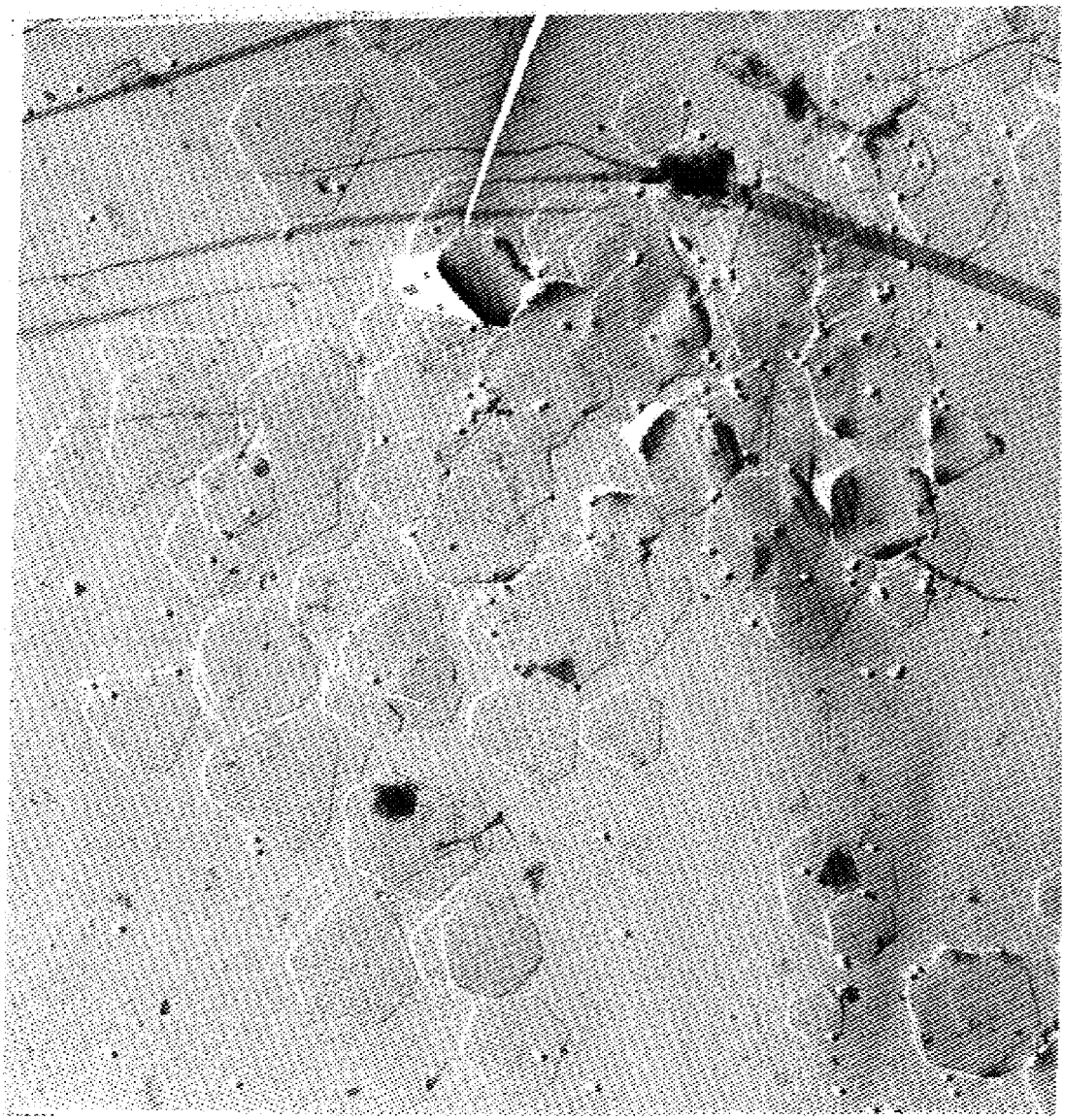
FIG. 12 shows the grain structure of {111} tabular grain obtained in Example 1-7. The magnifications are about 4,700 times.

Seed crystal was grown by adding B611 to Ta61 in the same manner as in Example I-6. In Example I-7, the temperature of the reaction vessel was maintained at 60° C., the ph was 6.0 and the pBr was 1.7, and B611 was added five times. The TEM image of the emulsion grains taken out after completion of the growth was shown in FIG. 12. The average diameter of the grains was 3.5 μm, the coefficient of variation of diameter distribution was 0.20 and the average thickness was 43 nm. As a result of observation of the TEM image of the emulsion grains taken out just before additions 2) to 5), almost all the fine grains added had disappeared.

Sample 71 was prepared by performing the same sensitizing processes as above on and after the adsorption of Dye 2 in Example I-6.

Sample 72 was prepared by using Ta61 and B61 in the same manner as above. The photographic characteristic was examined in the same manner as in Example I-1. $a_2$ value of Sample 71 was 112 when that of Sample 72 was taken as 100. The average diameter of the tabular grains of Sample 71 was 3.4 μm, the coefficient of variation of diameter distribution was 0.23 and the average thickness was 45 nm. The improving effect by aging $AgBr_0$ was apparent.

In the next place, tabular grains were grown by using Ta61 and B61 with the same temperature, pH and pBr. However, in this case, B61 was added continuously for the same time. That is, 350 ml of Ta61 was put in the reaction vessel, and then 73 ml of B61 was added thereto over 13 minutes. In the next place, 152 ml of B61was added over 18minutes. Subsequently, 187 ml of B61 was added over 29 minutes, and then 278 ml of B61 was added over 31 minutes. The mixture was ripened for 5 minutes. From the TEM image of the grains photographed, it was confirmed that many fine grains added were left. The emulsion was designated as emulsion 73.

Emulsion 73 was prepared in the same manner as above except for changing each addition time of B61 to 1.5 times. In this emulsion grains, almost all the fine grains had vanished. This was designated as emulsion 74. Emulsions 73 and 74 were subjected to the same sensitizing processing as in Example I-6, thereby Samples 73 and 74 were prepared.

The photographic characteristic of these samples was examined in the same manner as in Example I-1. The $a_2$ value of Sample 73 was 70 and that of Sample 74 was 93.

Example I-8

Preparation of $AgI_0$

Dispersion medium solution 71 (containing 1,250 g of water, 35 g of GL1, 0.09 g of NaI, pH of 6.5) was put in the reaction vessel shown in FIG. 6, and the temperature was maintained at 40° C. Ag-6 solution and X-81 solution (containing 17.663 g of KI and 2 g of GL1 in 100 ml, pH of 6.5) were simultaneously mixed and added at a flow rate of 5 ml/min for the initial and terminal 12 seconds respectively, and 20 ml/min for 12 minutes of the intermediate period. The total addition amount of each solution was 240 ml. After stirring the emulsion for 2 minutes, the temperature was lowered to 36° C.

The emulsion was ultrafiltered and concentrated in the same manner as above, and an aqueous solution containing 15 g of GL3 was added, to thereby adjust the pH to 6.5 and the pI to 3.1. The final yield of the emulsion was about 50% (about 865 ml) of the original volume. This emulsion was designated as B81. It was found from the TEM image of the emulsion grains photographed that the average diameter of the emulsion grains was about 25 nm. This emulsion was designated as B81.

Emulsion Ta61 (400 ml) was put in a reaction vessel maintained at 75° C., and then 71 ml of B61 and 3.8 ml of B81 were added thereto. After 14 minutes, 150 ml of B61 and 8 ml of B81 were added. After 19 minutes, 180 ml of B61 and 9.6 ml of B81 were added. After 30 minutes, 275 ml of B61 and 14.7 ml of B81 were added. During the growing, the pH was maintained at 6.5 and the pBr at 1.9. The TEM image of the emulsion grains taken out at this point was photographed. It was found from the TEM image that the average diameter of the tabular grains formed was about 2.1 μm, and the average thickness was 43 nm. Almost all the fine grains had disappeared. This was designated as emulsion 81.

Emulsion 82 was prepared in the same manner as in the preparation of emulsion 81 except that an equimolar NaI aqueous solution was continuously added during each ripening period in place of B81. The average diameter of the tabular grains formed was about 2 μm, the average thickness was about 47 nm, and almost all the fine grains had disappeared.

Samples 81 and 82 were prepared by performing the same sensitizing processes as above on and after the adsorption of Dye 2 in Example I-6. The photographic characteristic was examined in the same manner as in Example I-1. The relative sensitivity of Sample 81 was 118 with taking that of Sample 82 as 100.

Example I-9

Preparation of Fine Grains for Doping

Emulsions 91 to 100 were prepared as follows: In the formation of B61 in Example 1-6, metal complex aqueous solutions were added in an equimolar amount during the period of 3 minutes after the start of formation until 1 minute before termination. The ratio of addition velocity ($Ag^+$/metal complex ion=$1/10^{-5}$) was in molar ratio. Other processes were the same as the preparation of B61.

Growth of Seed Crystal

Samples 91 to 100 were prepared by using emulsion Ta61 and emulsions B91 to B100 respectively in the same manner as in the preparation of Sample 61. The photographic characteristic of each sample was examined in the same manner as in Example I-1. The results obtained are shown in Table 7 as the column of $a_2$ with the result of comparative example. Exposure was performed for $10^{-4}$ seconds and the sensitivity of the comparative sample was taken as 100.

Comparative Samples

Samples 911 to 1001 were prepared by continuously adding an equimolar amount with each of B91 to B100 of a dopant as an aqueous solution when seed crystals were grown by using Ta61 and B61, and other processes were the same as the preparation of Samples 91 to 100. The effect of the present invention was confirmed.

Emulsions B91 to B100 were taken out after formation, each emulsion was centrifuged, and the supernatant was taken out and the remaining dopant in the supernatant was examined, but almost all the dopant had vanished. From 90 to 100% of the added amount of the metal complexes of B91 to B96 had been doped in Agk grains.

TABLE 7

| $AgBr_0$ | Dope | $a_2$ |
|---|---|---|
| 91 | $K_4Fe(CN)_6$ | 112 |
| 92 | $K_4RU(CN)_6$ | 114 |
| 93 | $K_3Rh(CN)_6$ | 106 |
| 94 | $K_2IrCl_6$ | 109 |
| 95 | $K_2[IrCl_5(thiazole)]$ | 114 |
| 96 | $K_2[IrCl_5(5\text{-methylthiazole})]$ | 115 |
| 97 | $K_2[IrCl_5(H_2O)]$ | 109 |
| 98 | 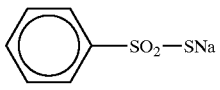 | 112 |
| 99 | KSeCN | 110 |
| 100 | $SnCl_2$ | 109 |
| 101 | Thiourea dioxide | 110 |

Example I-10

In the preparation of emulsion B61, precipitation-water washing was performed in place of ultrafiltration. A precipitating agent (polyisobutylene-cosodium malenoate) was added to the emulsion, the pH was adjusted to 4.0, stirring was stopped, and the emulsion was coagulated and precipitated. The supernatant was removed, 2 liters of water was added and the emulsion was stirred and mixed. This procedure was repeated one more time, and then an aqueous solution containing 20 g of GL3 was added thereto, thereby the pH was adjusted to 6.5 and pBr to 2.45. The yield was about 860 ml. This was designated as B611.

Sample 611 was prepared by using Ta61 and B611 by the same processing as in the preparation of Sample 61. The photographic characteristic of the sample was examined in the same manner as in Example I-1. The $a_2$ value of Sample 611 was 110 and that of Sample 61 was 112 with taking the $a_2$ value of Comparative Sample 612 as 100.

Comparative Samples

The ultrafiltration was omitted in the preparation of B61. Accordingly, the amount of the emulsion was 1,800 ml. This was designated as B612. Sample 612 was prepared by using the equimolar amount of B612 with Ta61 and by the same processing as in the preparation of Sample 61.

It was confirmed that the (sensitivity/granularity) ratio of AgX grain emulsions was improved by the embodiments of the present invention.

Example II-1 (Formation of Fine Grains for Growth)

a. Preparation of Pure Silver Bromide Fine Grains

The following solutions were prepared.

A: A 9 mass % silver nitrate aqueous solution

B: A 0.59 M KBr aqueous solution

C: A 5 mass % aqueous solution of oxidation-processed gelatin (molecular weight: 20,000)

Solutions A, B and C were continuously poured into the inlet of the mixer as disclosed in JP-A-10-239787 (the capacity of the mixing chamber: 0.5 ml) at a flow rate of 20 ml/min (average residence time t=0.5 sec). The temperature of the mixer and solutions A, B and C was maintained at the temperature shown in Table 8 below. The emulsion which was discharged from the exhaust port of the mixer was photographed with a transmission electron microscope with cooling and the grain size was examined.

b. Preparation of Silver Iodobromide Fine Grains

Silver iodobromide fine grains were prepared in the same manner as in Example I-1 except for replacing solution B with a 0.59 M halogen solution containing 3 mol % of KI and 97 mol % of KBr. The grain size of the fine grains formed was measured in the same manner as in Example I-1. The results obtained are shown in Table 8.

TABLE 8

| Emulsion No. | Silver Iodide Content (mol/mol Ag) | Fine-Grain Forming Temperature (° C.) | Average Equivalent-Sphere Diameter (nm) | Variation Coefficient (%) |
|---|---|---|---|---|
| 1 | 0 | 30 | 25 | 24 |
| 2 | 0 | 15 | 26 | 22 |
| 3 | 0 | 10 | 15 | 18 |
| 4 | 0 | 5 | 12 | 16 |
| 5 | 3 | 30 | 22 | 26 |
| 6 | 3 | 15 | 18 | 22 |
| 7 | 3 | 10 | 12 | 18 |
| 8 | 3 | 5 | 10 | 18 |

A variation coefficient is a value obtained by dividing a standard deviation by the average value and multiplying 100.

It can be seen from the results in Table 8 that grains having a small grain size can be produced when grains are formed at low temperature.

Example II-2 a. Preparation of {111} Tabular Grains

Into 1.2 liters of water were added 0.44 g of KBr and 1.0 g of oxidation-processed gelatin (molecular weight: 20,000) and the reaction solution was maintained at 27° C. With stirring the reaction solution, 13.5 ml of an aqueous solution of silver nitrate (containing 1.2 g of silver nitrate) and 13.5 ml of an aqueous solution of KBr (containing 0.96 g of KBr) were added by a double jet method for 1 minute. Five minutes after the termination of the addition, 200 g of a 10 mass % aqueous solution of oxidation-processed gelatin (molecular weight: 100,000) was added to the reaction solution. The temperature in the reaction vessel was increased to 75° C. in the succeeding 25 minutes. After temperature up, silver bromide fine grains for growth were formed in the same manner as in Example I-1, and added continuously to the reaction vessel. The addition velocity of solutions A, B and C to the mixer at the initial stage of the addition was 20 ml/min and the velocity just before the termination of the addition was 36 ml/min. The addition required 60 minutes and the amount of silver nitrate added was 90 g. KBr was added to maintain pBr at 2.6 during the period. After the obtained emulsion was water-washed by an ordinary flocculation method, 60 g of inert gelatin was added to adjust pH to 6.0 and pAg to 8.8. Tabular grains accounted for 95% or more of the entire projected area of the obtained emulsion. The grain size of the obtained emulsion is shown in Table 9 below. After the emulsion was filtered through a filter having a pore diameter of 0.1 $\mu$m, the silver halide in the filtrate was dissolved with aqueous sodium thiosulfate, and the silver amount in the solution was obtained by an atomic absorption method. The remaining amount of the fine grains was obtained from the silver amount in the filtrate, and shown in Table 9 as the proportion to the added amount.

TABLE 9

| Emulsion No. | Fine Grain-Forming Temperature (° C.) | Average Equivalent-Circle Diameter (nm) | Thickness (nm) | Remaining Amount of Fine Grains (proportion to the added amount (%)) | Remarks |
|---|---|---|---|---|---|
| 1 | 30 | 1.56 | 55 | 12 | Comparison |
| 2 | 15 | 1.60 | 52 | 8 | Comparison |
| 3 | 10 | 1.80 | 45 | 0 | Invention |
| 4 | 5 | 1.85 | 43 | 0 | Invention |
| 5 | 30 | 1.49 | 59 | 15 | Comparison |
| 6 | 15 | 1.55 | 55 | 12 | Comparison |
| 7 | 10 | 1.75 | 49 | 0 | Invention |
| 8 | 5 | 1.82 | 45 | 0 | Invention |

As shown in Table 9, the thickness of the tabular grain largely decreased when the forming temperature of fine grains for growth is 10° C. or lower. Further, in the case where the fine grains formed at low temperature were used, the fine grains did not remain.

Example II-3

Evaluation of Photographic Characteristics

After compounds 1 and 2 were added to each of emulsions 1 to 8, sensitizing dyes 1 and 2 were added. The temperature of each emulsion was then raised to 60° C., and potassium thiocyanate, chloroauric acid, sodium thiosulfate, and N,N-dimethylselenourea were added, thereby chemical sensitization was performed optimally. Compounds 3 and 4 were added at the end of chemical sensitization. "Chemical sensitization was performed optimally" means that each sensitizing dye and compound was added in the range of from $10^{-1}$ to $10^{-8}$ mol per mol of the silver halide.

Compound 1

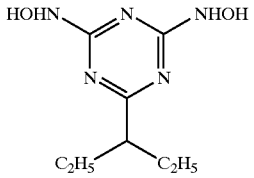

Compound 2

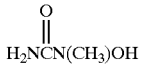

Sensitizing Dye 1

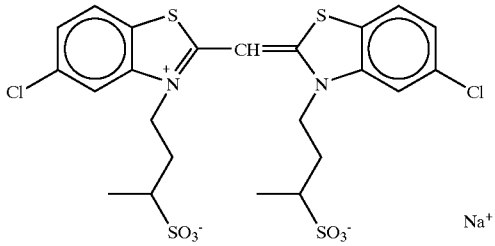

Sensitizing Dye 2

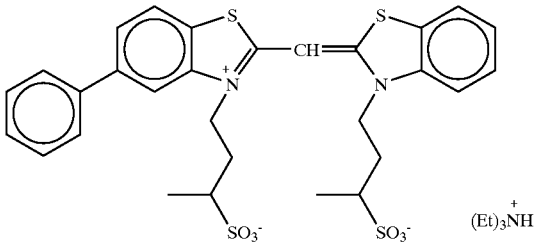

-continued

Compound 3

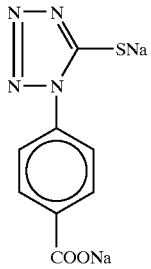

Compound 4

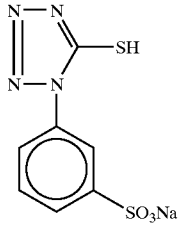

Each of the thus-obtained emulsions 1 to 8 and a protective layer were coated on a cellulose triacetate film support having an undercoating layer on the following conditions and a coated sample was prepared. For improving a coating property, the following surfactant was arbitrarily added.

Surfactant

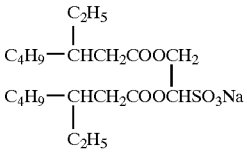

Coating conditions of emulsion

| | | |
|---|---|---|
| (1) | Emulsion layer | |
| | Emulsions 1 to 8 | $3.6 \times 10^{-2}$ mol/m$^2$ as silver |
| | The following coupler | $1.5 \times 10^{-3}$ mol/m$^2$ |
| | Coupler 1 | 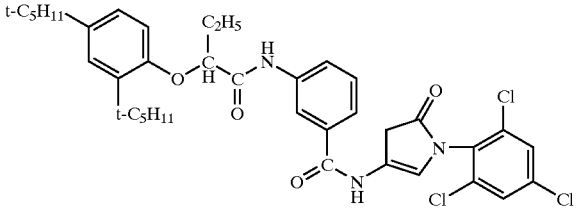 |
| | Tricresyl phosphate | 1.10 g/m$^2$ |
| | Gelatin | 2.30 g/m$^2$ |
| (2) | Protective layer | |
| | Sodium 2,4-dichloro-6-hydroxy-s-triazine | 0.08 g/m$^2$ |
| | Gelatin | 1.80 g/m$^2$ |

These samples were allowed to stand under the condition of 40° C. 70% RH for 14 hours, then subjected to exposure through either a blue filter or a yellow filter and a continuous wedge for 1/100 sec. and then the following color development.

Color Development

| Step | Processing Time | Processing Temperature (° C.) |
|---|---|---|
| Color Development | 2 min 00 sec | 40 |
| Bleach-Fixing | 3 min 00 sec | 40 |
| Washing (2) | 20 sec | 35 |
| Washing (1) | 20 sec | 35 |
| Stabilization | 20 sec | 35 |
| Drying | 50 sec | 65 |

The compositions of each processing solution are shown below.

Composition of Color Developing Solution

| | |
|---|---|
| Diethylenetriaminepentaacetic acid | 1.0 g |
| 1-Hydroxyethylidene-1,1-disulfone | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-(N-Ethyl-N-β-hydroxyethylamino)-2-methylaniline sulfate | 4.5 g |
| Water to make | 1.0 liter |
| pH | 10.05 |

Composition of Bleach-Fixing Solution

| | |
|---|---|
| Ammonium ethylenediaminetetraacetato ferrate dihydrate | 90.0 g |
| Disodium ethylenediaminetetraacetate | 5.0 g |
| Sodium sulfite | 12.0 g |
| Aqueous ammonium thiosulfate solution (70%) | 260.0 ml |
| Acetic acid (98%) | 5.0 ml |
| Bleach accelerating agent 1 shown below | 0.01 mol |
| Water to make | 1.0 liter |
| pH | 6.0 |

Bleach accelerating agent 1

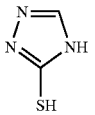

Washing Water

City water was passed through a mixed bed column packed with an H-type cation exchange resin (Amberlite IR-120B manufactured by. Rohm & Haas) and an OH-type anion exchange resin (Amberlite IR-400 manufactured by Rohm & Haas) and treated so as to reduce the calcium ion and magnesium ion concentrations to 3 mg/liter or less, and then 20 mg/liter of sodium isocyanurate dichloride and 1.5 g/liter of sodium sulfate were added thereto.

The pH of this washing water was in the range of from 6.5 to 7.5.

Stabilizing Solution

| | |
|---|---|
| Formalin (37%) | 2.0 ml |
| Polyoxyethylene-p-monononylphenyl ether (average polymerization degree: 10) | 0.3 mg |
| Disodium ethylenediaminetetraacetate | 0.05 mg |
| Water to make | 1.0 liter |
| pH | 5.0 to 8.0 |

Sensitivity was expressed by the relative value of the logarithmic value of the reciprocal of the exposure amount (represented by lux-sec) giving the density of fog+0.1 with the sensitivity of emulsion 1 being taken as 1.0. The results obtained are shown in Table 10 below.

TABLE 10

| Emulsion No. | Fog | Relative Sensitivity: Blue Filter | Relative Sensitivity: Yellow Filter | Remarks |
|---|---|---|---|---|
| 1 | 0.02 | 1.00 | 1.00 | Comparison |
| 2 | 0.02 | 1.02 | 1.02 | Comparison |
| 3 | 0.02 | 1.02 | 1.10 | Invention |
| 4 | 0.02 | 1.05 | 1.12 | Invention |
| 5 | 0.02 | 1.26 | 1.26 | Comparison |
| 6 | 0.02 | 1.26 | 1.30 | Comparison |
| 7 | 0.02 | 1.30 | 1.40 | Invention |
| 8 | 0.02 | 1.30 | 1.41 | Invention |

As shown in Table 10, the emulsions according to the invention showed high sensitivity in particular in spectral sensitization region.

EFFECT OF THE INVENTION

According to the present invention, tabular grains having a thin thickness can be obtained with the improved fine grain addition-growing method not particularly using crystal phase controlling agent. By using silver halide emulsions containing such grains, high sensitivity silver halide photographic materials can be obtained.

The entitle disclosure of each and every foreign patent application from which the benefit of foreign priority has been claimed in the present application is incorporated herein by reference, as if fully set forth herein.

While the invention has been described in detail and with reference to specific examples thereof, it will be apparent to one skilled in the art that various changes and modifications can be made therein without departing from the spirit and scope thereof.

What is claimed is:

1. A producing method of a silver halide emulsion comprising the steps of adding silver halide fine grains $AgX_0$ to a silver halide seed crystal emulsion containing at least water, dispersion medium land silver halide crystal, and growing the seed crystal by dissolving the added $AgX_0$, wherein $AgX_0$ are formed in dispersion medium solution 2 containing dispersion medium 2, the pH of dispersion medium solution 2 of the time when $AgX_0$ are formed is from 7.3 to 12.2, the average equivalent-circle projected area diameter of $AgX_0$ is from 0.001 to 0.2 $\mu$m, and $AgX_0$ are non-twin crystal grains not substantially having twin planes.

2. The producing method of a silver halide emulsion as claimed in claim 1, wherein the silver halide fine grains are silver halide fine grains having an AgBr content of from 60 to 100 mol %.

3. The producing method of a silver halide emulsion as claimed in claim 1, wherein the temperature of dispersion medium 2 of the time when $AgX_0$ are formed is from 0 to 10° C.

4. The producing method of a silver halide emulsion as claimed in claim 1, wherein the variation coefficient of the equivalent circle diameter of $AgX_0$ is 20% or less.

5. The producing method of a silver halide emulsion as claimed in claim 1, wherein the average equivalent-circle diameter of $AgX_0$ is 20 nm or less.

6. The producing method of a silver halide emulsion as claimed in claim 1, wherein $AgX_0$ are fine grains formed by a batch system of adding a silver salt solution and a halide salt solution to dispersion medium solution 2 in a reaction vessel by a double jet method.

7. The producing method of a silver halide emulsion as claimed in claim 1, wherein $AgX_0$ are fine grains formed by a continuous system of continuously supplying a silver ($Ag^+$) salt solution and a halide ($X^-$) salt solution to a continuous mixer through a hollow pipe, mixing both solutions in the mixer, and continuously discharging the mixed solution through a feed pipe.

8. The producing method of a silver halide emulsion as claimed in claim 6, wherein at least one of a silver ($Ag^+$) salt solution and a halide ($X^-$) salt solution to be added contains from 0.01 to 15 mass % of dispersion medium 3.

9. The producing method of a silver halide emulsion as claimed in claim 7, wherein at least one of a silver ($Ag^+$) salt solution and a halide ($X^-$) salt solution to be added contains from 0.01 to 15 mass % of dispersion medium 3.

* * * * *